US010034595B2

(12) United States Patent
Park et al.

(10) Patent No.: US 10,034,595 B2
(45) Date of Patent: Jul. 31, 2018

(54) DISHWASHER AND CONTROLLING METHOD THEREOF

(71) Applicant: Samsung Electronics Co., Ltd., Suwon-si (KR)

(72) Inventors: Chan Young Park, Suwon-si (KR); Chang Wook Lee, Seoul (KR); Seung Gee Hong, Suwon-si (KR); Soo Hyung Yoo, Incheon (KR); Min Ho Jung, Suwon-si (KR); Sang Soo Choi, Taebaek-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/501,950

(22) Filed: Sep. 30, 2014

(65) Prior Publication Data

US 2015/0128999 A1 May 14, 2015

(30) Foreign Application Priority Data

Nov. 11, 2013 (KR) ..... 10-2013-0136015
Dec. 31, 2013 (KR) ..... 10-2013-0169374
Jan. 6, 2014 (KR) ..... 10-2014-0001525

(51) Int. Cl.
*A47L 15/42* (2006.01)
*A47L 15/16* (2006.01)

(52) U.S. Cl.
CPC ..... *A47L 15/4282* (2013.01); *A47L 15/16* (2013.01); *A47L 15/4223* (2013.01);
(Continued)

(58) Field of Classification Search
CPC ..... A47L 2301/04; A47L 2501/36; A47L 2501/20; A47L 2401/06; A47L 2401/34;
(Continued)

(56) References Cited

U.S. PATENT DOCUMENTS 2,236,791 A 4/1941 Forsberg
2008/0186170 A1* 8/2008 Schleifer ..... A47L 15/0049 340/540
(Continued)

FOREIGN PATENT DOCUMENTS

CN 101277638 10/2008
CN 103284674 9/2013
(Continued)

OTHER PUBLICATIONS

International Search Report dated Nov. 11, 2013 in International Patent Application No. PCT/KR2014/010441.
(Continued)

*Primary Examiner* — David G Cormier
(74) *Attorney, Agent, or Firm* — Staas & Halsey LLP

(57) ABSTRACT

A dishwasher includes a tub that accommodates dishes; a nozzle assembly that sprays washing water; a vane assembly that is moved between a first position and a second position of an inside of the tub and changes a progression path of the washing water so that the sprayed washing water can be directed toward the dishes; and a controller that moves the vane assembly to the second position if the vane assembly is disposed at the first position. When a linear washing portion washes a small quantity of dishes by spraying washing water while making a reciprocal motion in part of an inside of a washing chamber, a washing time can be reduced, and concentrated washing can also be performed.

20 Claims, 47 Drawing Sheets

(52) U.S. Cl.
CPC ..... *A47L 15/4278* (2013.01); *A47L 2301/04* (2013.01); *A47L 2301/08* (2013.01); *A47L 2401/06* (2013.01); *A47L 2401/30* (2013.01); *A47L 2401/34* (2013.01); *A47L 2501/20* (2013.01); *A47L 2501/36* (2013.01)

(58) Field of Classification Search
CPC .. A47L 15/16; A47L 15/4223; A47L 15/4221; A47L 15/4282
See application file for complete search history.

(56) References Cited

U.S. PATENT DOCUMENTS

| | | | |
|---|---|---|---|
| 2009/0056754 | A1 | 3/2009 | Rolek |
| 2012/0031432 | A1 | 2/2012 | Beaudet et al. |

FOREIGN PATENT DOCUMENTS

| | | |
|---|---|---|
| DE | 10121083 | 10/2002 |
| EP | 2030556 | 3/2009 |
| EP | 2671494 | 12/2013 |
| JP | 2-95327 | 4/1990 |
| JP | 2008-279137 | 11/2008 |

OTHER PUBLICATIONS

Australian Notice of Acceptance dated May 10, 2017 in Australian Patent Application No. 1057389.
Partial European Search Report dated May 16, 2017 in European Patent Application No. 14859609.1.
Australian Office Action dated Jan. 20, 2017 in Australian Patent Application No. 2014347388.
Extended European Search Report dated Aug. 21, 2017 in European Patent Application No. 14859609.1.
Chinese Office Action dated Mar. 26, 2018 in Chinese Patent Application No. 201480072548.5.
U.S. Appl. No. 15/992,391, filed May 30, 2018, Chan Young Park, et al., Samsung Electronics Co., Ltd.

* cited by examiner (a)

(a)

DISHWASHER AND CONTROLLING METHOD THEREOF

CROSS-REFERENCE TO RELATED APPLICATIONS

This application claims the priority benefit of Korean Patent Application No. 10-2013-0169374 filed on Dec. 31, 2013, Korean Patent Application No. 10-2013-0136015 filed on Nov. 11, 2013 and Korean Patent Application No. 10-2014-0001525 filed on Jan. 6, 2014 in the Korean Intellectual Property Office, the disclosures of which are incorporated herein by reference.

BACKGROUND

1. Field

The following description relates to a dishwasher and a method of controlling the same, and more particularly, to a dishwasher that sprays washing water toward dishes while making a reciprocal motion in a tub, and a method of controlling the dishwasher.

2. Description of the Related Art

In general, dishwashers are devices that wash dishes by spraying washing water with a high pressure toward dishes, and generally undergo a washing operation and a rinsing operation. In the washing operation, the dishwashers spray washing water and simultaneously cause detergent to be supplied by a detergent supply unit so that washing of the dishes can be performed.

In general, a dishwasher includes a body in which a washing chamber is formed, a pump that generates a washing water pressure, a dish basket that accommodates the dishes and is installed in a washing tub to advance and retreat, a plurality of nozzle assemblies that spray washing water toward the dish basket, a connection flow path that connects the pump and the plurality of nozzle assemblies, and a valve assembly that selectively moves washing water to the plurality of nozzle assemblies from the pump. The dishes are washed with the washing water sprayed by the nozzle assemblies.

Conventional nozzle assemblies are rotation type nozzle assemblies that are disposed at upper and lower sides of an upper dish basket and at an upper side of a lower dish basket. Such rotation type spraying units are rotated by reaction in which washing water with a high pressure is sprayed. However, when the nozzle assemblies are disposed to be rotated, a blind spot, in which sprayed washing water does not reach edges of the washing tub disposed in a rectangular shape, is formed.

SUMMARY

Therefore, it is an aspect of the present disclosure to provide a dishwasher in which washing water is capable of being sprayed toward edges of a washing tub, and a method of controlling the dishwasher.

It is an aspect of the present disclosure to provide a dishwasher in which washing water is sprayed toward only part of a washing tub so that a washing time can be reduced and consumed energy can be reduced, and a method of controlling the dishwasher.

Additional aspects of the disclosure will be set forth in part in the description which follows and, in part, will be obvious from the description, or may be learned by practice of the disclosure.

In accordance with an aspect of the present disclosure, a dishwasher includes: a tub that accommodates dishes; a nozzle assembly that sprays washing water; a vane assembly that is moved between a first position and a second position of an inside of the tub and changes a progression path of the washing water so that the sprayed washing water can be directed toward the dishes; and a controller that moves the vane assembly to the second position if the vane assembly is disposed at the first position.

The dishwasher may further include a vane guide that guides movement of the vane assembly, wherein the nozzle assembly may be installed at one end of the vane guide.

The first position may be disposed adjacent to the nozzle assembly.

If the vane assembly is not disposed at the first position, the controller may move the vane assembly to the first position.

The second position may be formed at the other end of the vane guide, and the controller may detect a movement time at which the vane assembly is moved to the second position.

If the movement time is equal to or greater than a predetermined reference time, the controller may stop the movement of the vane assembly.

The dishwasher may further include a position detector that detects whether the vane assembly is disposed at the first position.

The position detector may include: a position identification member that is installed at the vane assembly; and a position detection sensor that is installed at the first position and detects the position identification member.

If the position detection sensor detects the position identification member, the controller may move the vane assembly to the second position.

The position identification member may include a permanent magnet that generates a magnetic field, and the position detection sensor may include a hall sensor that senses the magnetic field.

The dishwasher may further include an input unit through which division washing instructions are input from a user.

The controller may move the vane assembly between a third position, between the first position and the second position, and the first position according to the division washing instructions.

The controller may move the vane assembly between a fourth position, between the first position and the second position, and the second position according to the division washing instructions.

The dishwasher may further include an input unit through which a division washing area is input from a user.

The controller may move the vane assembly between a fifth position and a sixth position that correspond to the input division washing area.

In accordance with an aspect of the present disclosure, a dishwasher includes: a tub that accommodates dishes; a linear washing portion that washes the dishes while moving between a first position and a second position of an inside of the tub; and a controller that determines whether the linear washing portion is disposed at the first position and that moves the linear washing portion to the second position.

The first position may be a rear position of the inside of the tub.

If the linear washing portion is not disposed at the first position, the controller may move the linear washing portion to the first position.

The second position may be a forward position of the inside of the tub, and the controller may detect a movement time at which the linear washing portion is moved to the second position.

If the movement time is equal to or greater than a predetermined reference time, the controller may stop movement of the vane assembly.

The dishwasher may further include a position detector that detects whether the linear washing portion is disposed at the first position.

The position detector may include: a position identification member disposed at the linear washing portion; and a position detection sensor that is disposed at the first position and detects the position identification member.

In accordance with an aspect of the present disclosure, a method of controlling a dishwasher, includes: if a washing operation starts being performed, determining whether a vane assembly that is moved between a first position and a second position and changes a progression path of washing water sprayed by a nozzle assembly, is disposed at the first position; if the vane assembly is not disposed at the first position, moving the vane assembly to the first position; and if the vane assembly is disposed at the first position, moving the vane assembly to the second position.

The first position may be formed at one end of a vane guide that guides movement of the vane assembly, and the second position may be formed at the other end of the vane guide.

The determining of whether the vane assembly is disposed at the first position may include sensing a position identification member disposed at the vane assembly using a position detection sensor disposed at the first position.

The moving of the vane assembly to the second position may include detecting a movement time at which the vane assembly is moved to the second position.

If the movement time is equal to or greater than a predetermined reference time, the moving of the vane assembly to the second position may further include stopping the movement of the vane assembly.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
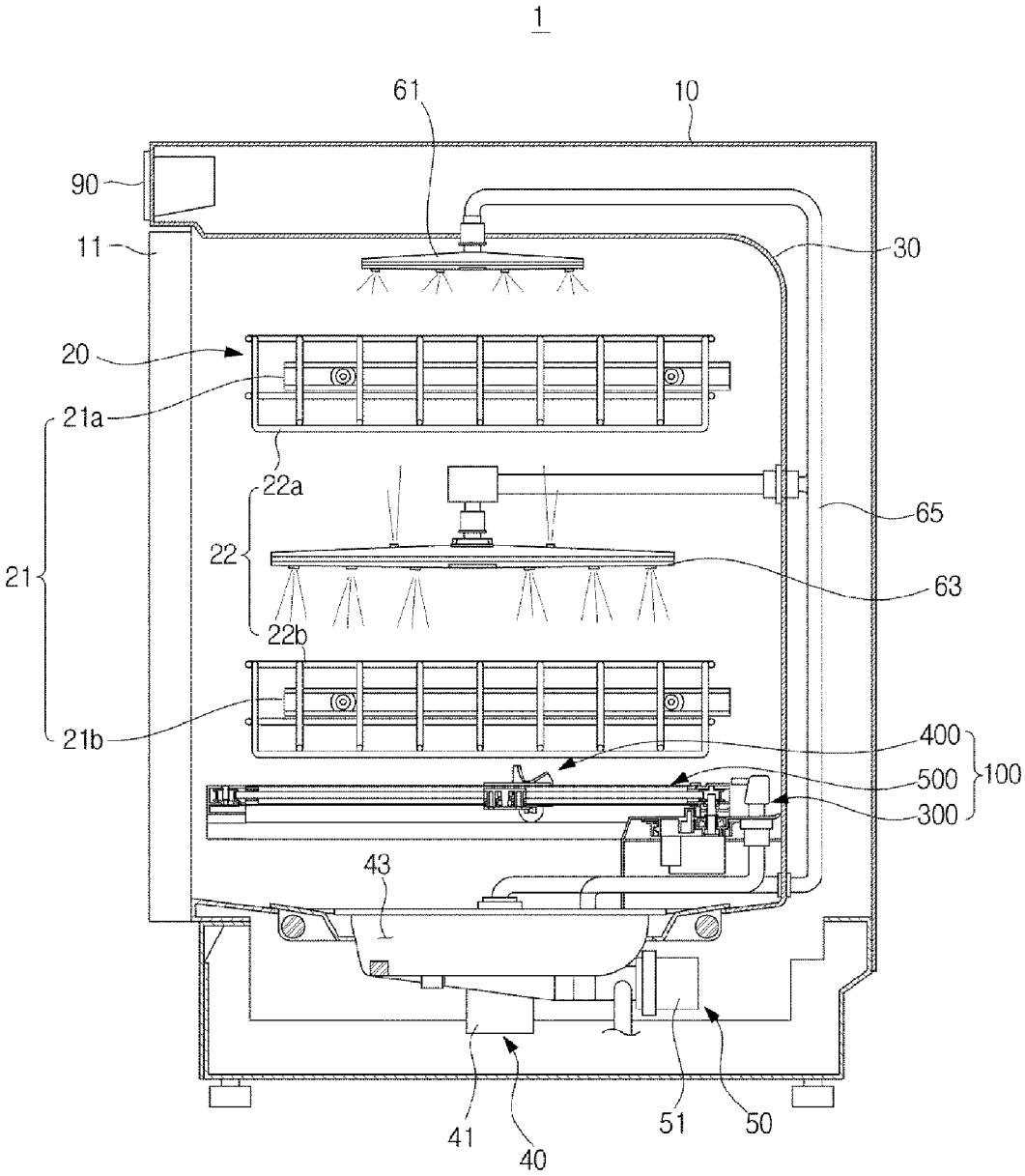
FIG. 1 illustrates a dishwasher according to an embodiment of the present disclosure.

Embodiments described in the specification and configurations shown in the drawings of the specification are merely exemplary embodiments of the present disclosure, and there may be various modified examples that may replace the embodiments and the drawings of the specification at the time of filing an application of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Hereinafter, a dishwasher according to an embodiment of the present disclosure and a method of controlling the dishwasher will be described in detail with reference to the accompanying drawings.

FIG. 1 illustrates a dishwasher according to an embodiment of the present disclosure.

Referring to FIG. 1, a dishwasher 1 includes a body 10 that constitutes an exterior of the dishwasher 1 and a tub 30 which is disposed in the body 10 and in which washing of dishes is performed. Front sides of the body 10 and the tub 30 are opened, and a door 11 is disposed at the opened front sides of the body 10 and the tub 30 to shield an inside of the tub 30 from the outside.

Also, a control panel 90 is disposed at an upper part of the front side of the body 10 to receive manipulation instructions from a user and to display operating information of the dishwasher 1. The control panel 90 will be described in detail below.

A dish accommodation portion 20 that accommodates dishes, rotatable spray nozzles 61 and 63 that wash the dishes by spraying washing water while rotating, a linear washing portion 100 that washes the dishes by spraying washing water while making a reciprocal motion, a washing water supply portion 40 that accommodates the washing water and supplies the accommodated washing water to the rotatable spray nozzles 61 and 63 and the linear washing portion 100, and a drainage portion 50 that drains the washing water accommodated in the washing water supply portion 40, are disposed in the tub 30.

The dish accommodation portion 20 includes a basket 21, of which an upper side is opened and which accommodates the dishes, and a slide rail 22 that movably supports the basket 21.

The basket 21 includes a first basket 21*a* disposed at an upper side of the inside of the tub 30 and a second basket 21*b* disposed at a lower side of the inside of the tub 30, and the slide rail 22 includes a first slide rail 22*a* that movably supports the first basket 21*a* and a second slide rail 22*b* that movably supports the second basket 21*b*.

In detail, the first basket 21*a* is installed at an upper side of the inside of the tub 30 to advance and retreat due to the first slide rail 22*a*, and the second basket 21*b* is installed at a lower side of the inside of the tub 30 to advance and retreat due to the second slide rail 22*b*. In this way, the first basket 21*a* and the second basket 21*b* are installed in the tub 30 to advance and retreat so the user may cause the first basket 21*a* or the second basket 21*b* to protrude from the front side of the body 10 and may insert or remove the dishes in or from the first basket 21*a* or the second basket 21*b*.

Also, the first basket 21*a* and the second basket 21*b* are composed of wires disposed in the form of a lattice in which the dishes accommodated in the first basket 21*a* and the second basket 21*b* are exposed to an outside of the basket 21 and can be washed with the washing water.

The washing water supply portion 40 includes a sump 43 that is disposed on a bottom surface of the tub 30 and accommodates the washing water sprayed by the rotatable spray nozzles 61 and 63 or the linear washing portion 100, and a circulation pump 41 that pumps the washing water accommodated in the sump 43 to the rotatable spray nozzles 61 and 63 or the linear washing portion 100.

The drainage portion 50 includes a drainage pump 51 that discharges the washing water accommodated in the sump 43 to the outside of the dishwasher 1. The drainage pump 51 discharges the washing water accommodated in the sump 43 to the outside of the dishwasher 1 if a washing operation or a rinsing operation is finished.

The washing water accommodated in the sump 43 is supplied with a high pressure to the rotatable spray nozzles 61 and 63 or the linear washing portion 100 due to the circulation pump 41. The washing water supplied with the high pressure is sprayed toward the dishes accommodated in the basket 21 through the rotatable spray nozzles 61 and 63 or the linear washing portion 100. The washing water sprayed to the dishes is accommodated in the sump 43 again. In this way, the dishes are washed with the washing water while the washing water circulates the inside of the tub 30 due to the circulation pump 41. If washing is finished, the washing water is discharged to the outside of the dishwasher 1 due to the drainage pump 51.

The rotatable spray nozzles 61 and 63 include a first rotatable spray nozzle 61 and a second rotatable spray nozzle 63 that spray the washing water toward the dishes while rotating, and a supply pipe 65 that guides the washing water accommodated in the washing water supply portion 40 to the first rotatable spray nozzle 61 and the second rotatable spray nozzle 63. The first rotatable spray nozzle 61 and the second rotatable spray nozzle 63 spray the washing water diagonally and in a vertical direction and rotate due to reaction of the sprayed washing water.

Also, the first rotatable spray nozzle 61 is installed above the first basket 21*a* and sprays the washing water toward the dishes accommodated in the first basket 21*a*, and the second rotatable spray nozzle 63 is installed between the first basket 21*a* and the second basket 21*b* and sprays the washing water toward the dishes accommodated in the first basket 21*a* and the second basket 21*b*.

The linear washing portion 100 washes the dishes accommodated in the basket 21 while making a reciprocal motion. In FIG. 1, the linear washing portion 100 is disposed on the bottom of the tub 30, i.e., at a lower side of the second basket 21*b*. However, embodiments of the present disclosure are not limited thereto. The linear washing portion 100 may be disposed in the center of the inside of the tub 30, i.e., between the first basket 21*a* and the second basket 21*b* or at an upper side of the first basket 21*a*.

The linear washing portion 100 may include a fixed nozzle assembly 300 that sprays the washing water, and a vane assembly 400 that changes a progression path of the washing water sprayed by the fixed nozzle assembly 300 while making a reciprocal motion.

The fixed nozzle assembly 300 may be disposed at one side of the inside of the tub 30. That is, the fixed nozzle assembly 300 may be disposed at the front (hereinafter, for understanding, a direction in which the door 11 is disposed, is referred to as a front), at the rear, on a left or right side of the inside of the tub 30. However, a movement direction of the vane assembly 400 may vary according to the position of the fixed nozzle assembly 300. For example, when the fixed nozzle assembly 300 is disposed at the rear or at the front of the inside of the tub 30, the vane assembly 400 may make a reciprocal motion in a forward/backward direction of the inside of the tub 30, and when the fixed nozzle assembly 300 is disposed on the left side or the right side of the inside of the tub 30, the vane assembly 400 may make a reciprocal motion to the right and left of the inside of the tub 30.

The linear washing portion 100 included in the dishwasher 1 includes the fixed nozzle assembly 300, of which position is fixed, and the vane assembly 400 that makes a reciprocal motion. However, embodiments of the present disclosure are not limited thereto. The linear washing portion 100 may include a spray nozzle that sprays the washing water toward the dishes accommodated in the basket 21 while making a reciprocal motion in the tub 30.

When the spray nozzle makes a reciprocal motion, the spray nozzle may spray the washing water toward the dishes accommodated in the basket 21 and simultaneously may make a reciprocal motion in the tub 30. For example, the spray nozzle may spray the washing water toward the dishes while making a reciprocal motion in the forward/backward direction of the tub 30 or to the right and left of the tub 30.

Hereinafter, the linear washing portion 100 will be described in detail.

Figure 2:
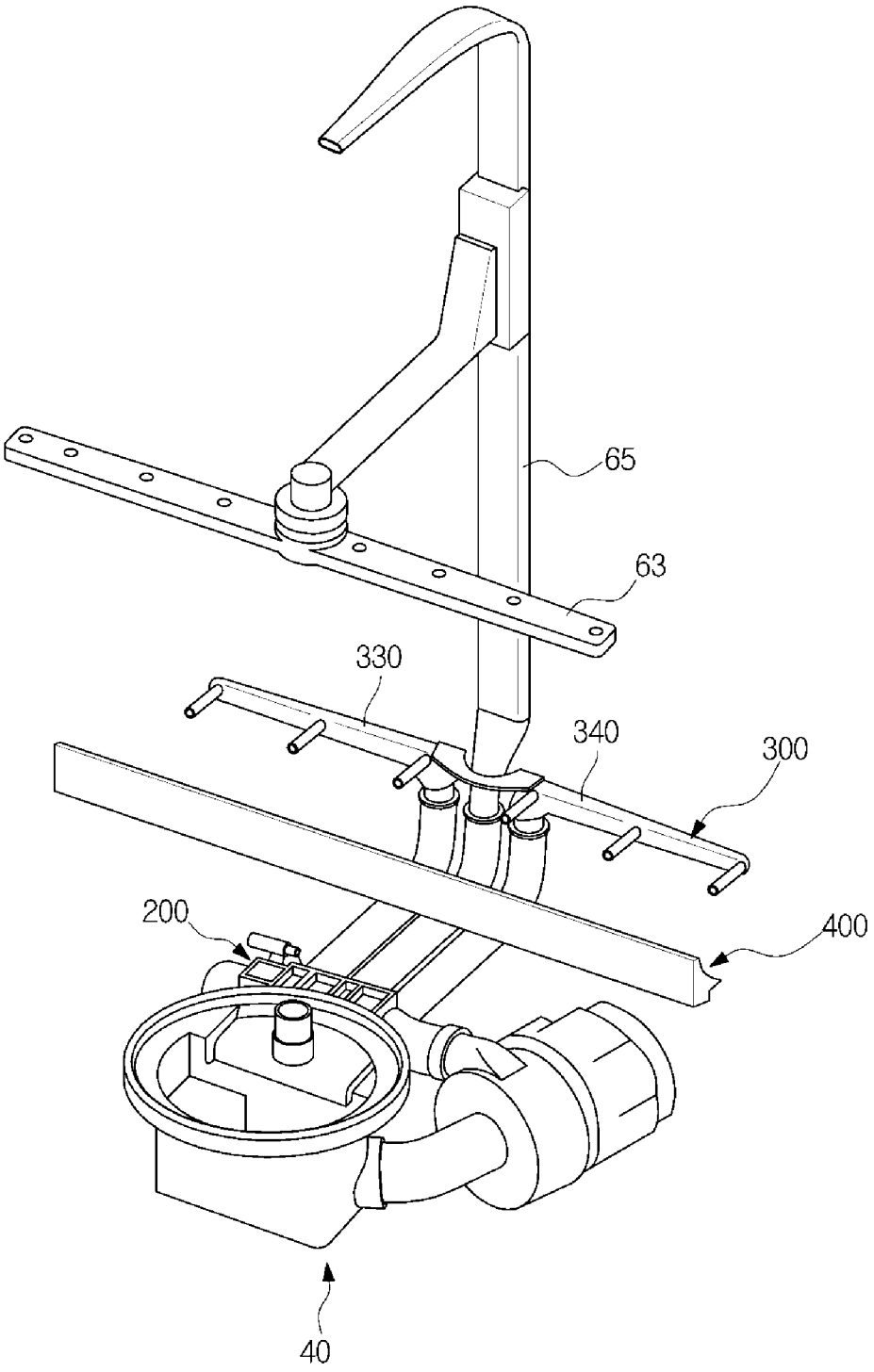
FIG. 2 illustrates a linear washing portion included in the dishwasher illustrated in FIG. 1.
Figure 3:
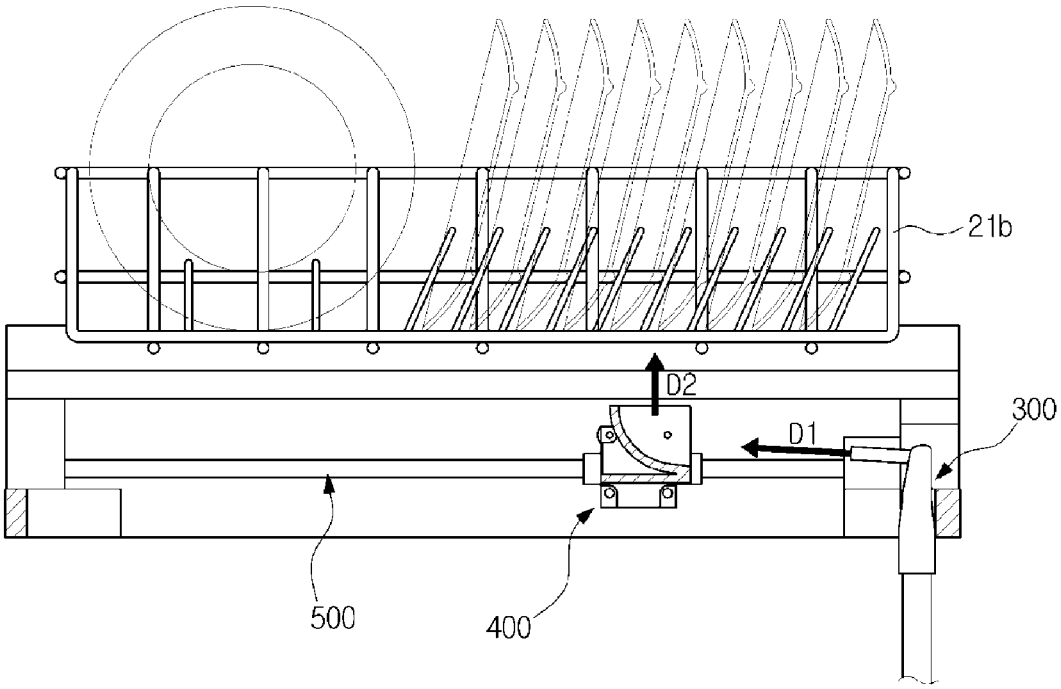
FIG. 3 illustrates an operation of the linear washing portion included in the dishwasher of FIG. 1.

FIG. 2 illustrates the linear washing portion 100 included in the dishwasher 1 illustrated in FIG. 1, and FIG. 3 illustrates an operation of the linear washing portion 100 included in the dishwasher 1 of FIG. 1.

Referring to FIGS. 2 and 3, the linear washing portion 100 may further include the fixed nozzle assembly 300 that sprays the washing water supplied by the washing water supply portion 40, a distribution valve assembly 200 that supplies the washing water to the linear washing portion 100 or the rotatable spray nozzles 61 and 63, the vane assembly 400 that changes the progression path of the washing water sprayed by the fixed nozzle assembly 300 while making a reciprocal motion, and a vane driving assembly 500 that moves the vane assembly 400.

When briefly describing the operation of the linear washing portion 100, as illustrated in FIG. 3, the fixed nozzle assembly 300 sprays the washing water in a first direction D1 toward the vane assembly 400. The progression path of the sprayed washing water is changed by the vane assembly 400 into a second direction D2 toward the basket 21, and the dishes accommodated in the basket 21 are washed with the washing water, of which progression direction is changed into a direction of the basket 21. In this case, the vane assembly 400 may cause the washing water to wash all of the dishes accommodated in the basket 21 while making a reciprocal motion.

Figure 4:
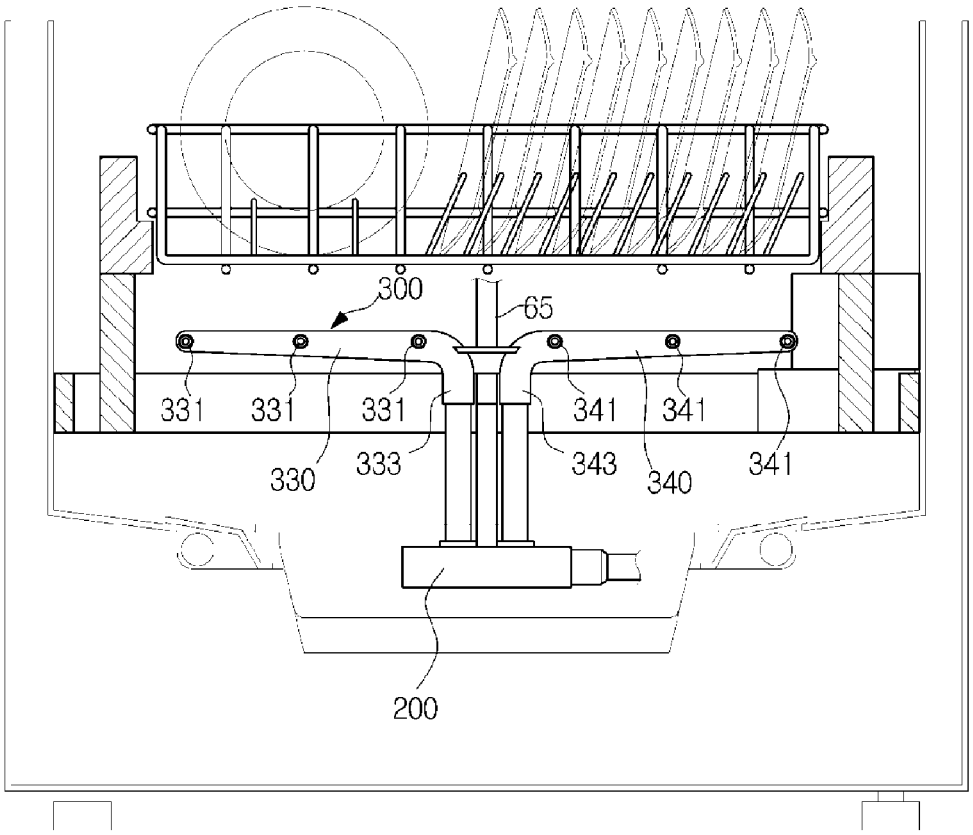
FIG. 4 illustrates a fixed nozzle assembly included in the dishwasher of FIG. 1.

FIG. 4 illustrates the fixed nozzle assembly 300 included in the dishwasher 1 of FIG. 1. In detail, FIG. 4 is a front view of the tub 30 of the dishwasher 1 of FIG. 1.

Referring to FIG. 4, the fixed nozzle assembly 300 includes a left spray nozzle 330 that is disposed at a lower side, the rear, and on the left of the inside of the tub 30 and sprays the washing water, a left flow path 333 on which the washing water supplied with the high pressure from the circulation pump (see 41 of FIG. 1) is guided toward the left spray nozzle 330, a right spray nozzle 340 that is disposed at a lower side, the rear, and on the right of the dishwasher 1 and sprays the washing water, and a right flow path 343 on which the washing water supplied with the high pressure from the circulation pump (see 41 of FIG. 1) is guided toward the right spray nozzle 340. The fixed nozzle assembly 300 according to an embodiment of the present disclosure includes two spray nozzles 330 and 340 that spray the washing water. However, embodiments of the present disclosure are not limited thereto, and the fixed nozzle assembly 300 may include one nozzle or three or more nozzles.

The left spray nozzle 330 includes three spray holes 331 into which the washing water is sprayed. The right spray nozzle 340 includes three spray holes 341 into which the washing water is sprayed. Each of the spray nozzles 330 and 340 disposed in the dishwasher 1 according to an embodiment of the present disclosure includes three spray holes 331 and 341. However, embodiments of the present disclosure are not limited thereto, and each of the spray nozzles 330 and 340 may include one spray hole, two spray holes, or four or more spray holes.

The distribution valve assembly 200 is disposed on the left flow path 333, a central flow path 65, and the right flow path 343 and may employ a disk valve or cylinder valve that opens/closes the left flow path 333, the central flow path 65, and the right flow path 343.

Figure 5:
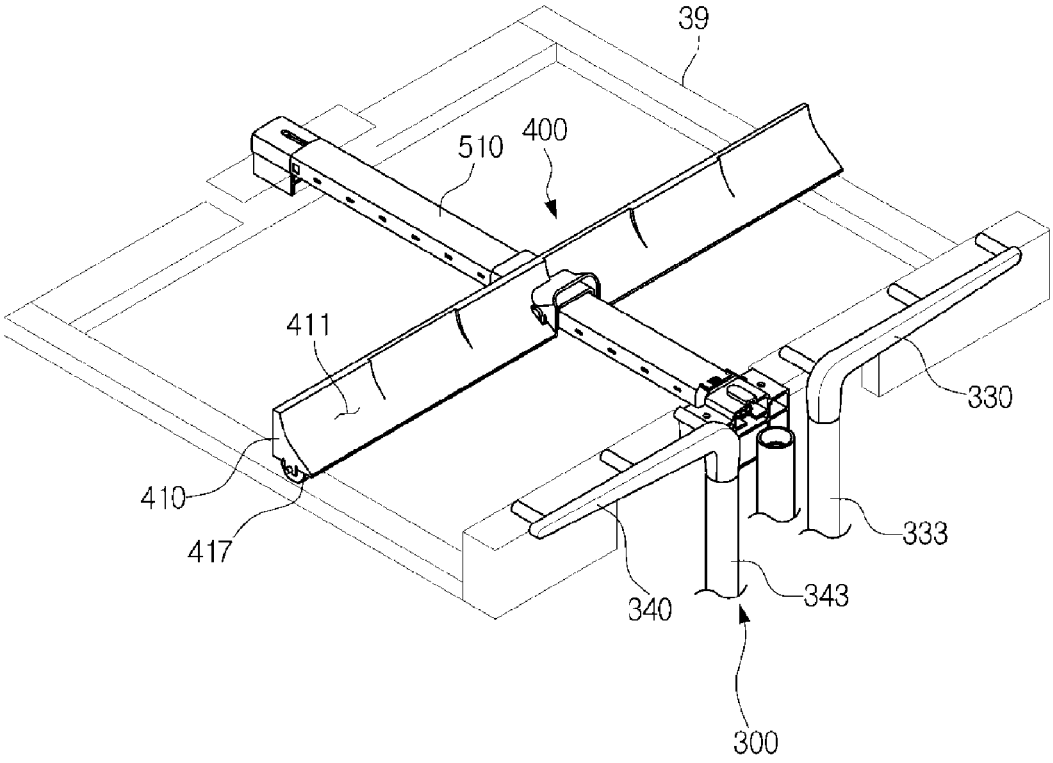
FIG. 5 illustrates a vane assembly included in the dishwasher of FIG. 1.
Figure 6:
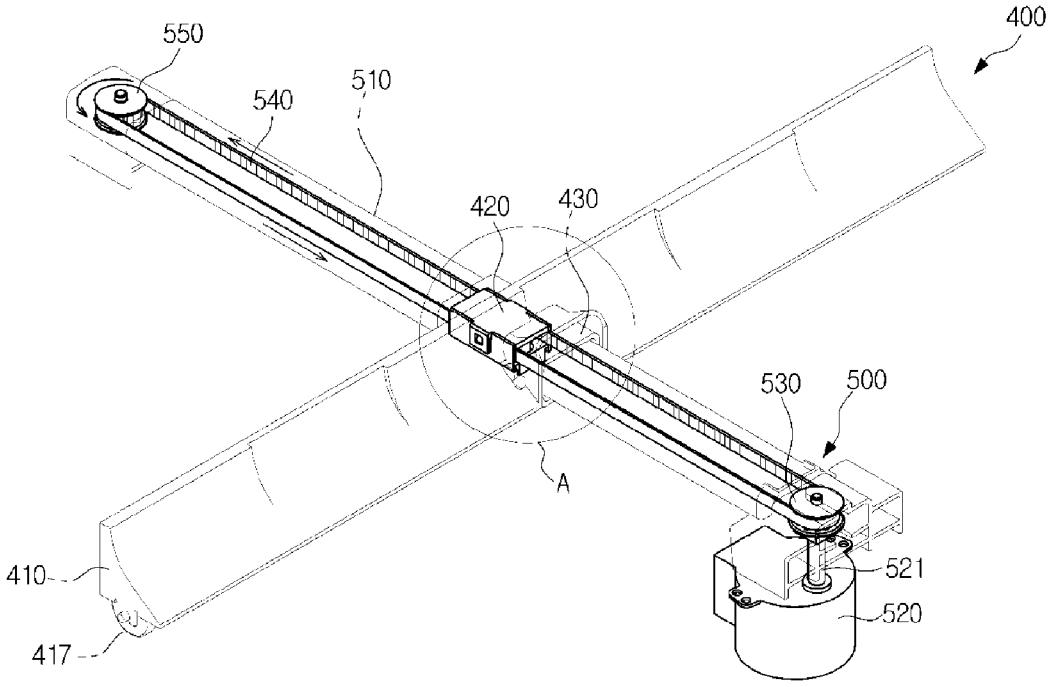
FIG. 6 illustrates a vane driving assembly included in the dishwasher of FIG. 1.
Figure 7:
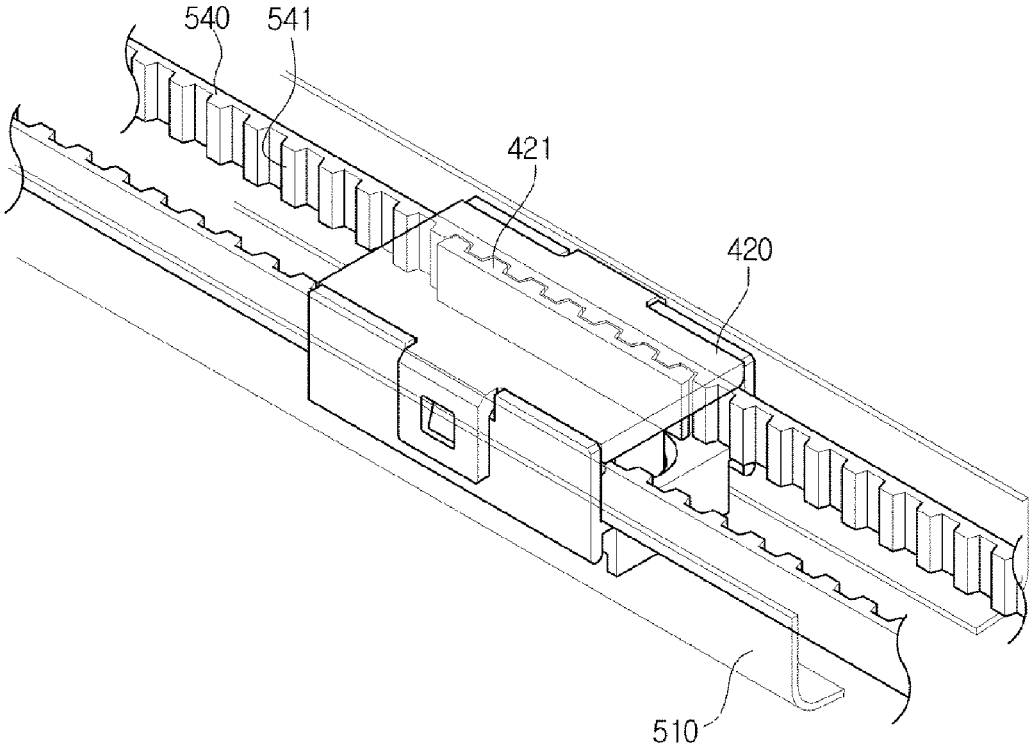
FIG. 7 is an enlarged view of portion A of FIG. 6.

FIG. 5 illustrates a vane assembly included in the dishwasher of FIG. 1, and FIG. 6 illustrates a vane driving assembly included in the dishwasher of FIG. 1, and FIG. 7 is an enlarged view of portion A of FIG. 6.

As illustrated in FIGS. 5 through 7, a vane guide 510 is disposed across the front and the rear of the inside of the tub 30, and the vane assembly 400 makes a reciprocal motion on the vane guide 510 by receiving a movement force from the vane driving assembly 500.

The vane guide 510 is disposed across the inside of the tub 30 from the front (for understanding, a direction in which the door 11 of the dishwasher is disposed, is referred to as the front.) of the tub 30 to the rear (for understanding, an opposite direction to the direction in which the door 11 of the dishwasher 1 is disposed, is referred to as the rear.) of the tub 30 and guides the reciprocal motion of the vane assembly 400.

The vane assembly 400 includes a vane 410 in which a reflection portion 411 that changes a direction of the washing water sprayed by the fixed nozzle assembly 300 is formed, a vane roller 417 that is disposed on both ends of the vane 410 and maintains balance of the vane 410, a vane carrier 420 that receives the movement force from the vane driving assembly 500, and a vane holder 430 that fixes the vane 410 to the vane carrier 420.

The vane 410 extends long along a direction in which the three spray holes 331 of the left spray nozzle 330 and the three spray holes 341 of the right spray nozzle 340 are disposed, to change the direction of the washing water sprayed by the left spray nozzle 330 and the right spray nozzle 340.

Also, the reflection portion 411 is formed in the vane 410 at a position at which the vane 410 faces the fixed nozzle assembly 300, and the reflection portion 411 changes a progression path of the washing water sprayed so that the washing water sprayed by the fixed nozzle assembly 300 can be sprayed toward the dishes of the basket 21. Also, the reflection portion 411 may be disposed to have different inclination angles according to its position so that the washing water sprayed by the fixed nozzle assembly 300 can be sprayed in various directions.

The vane roller 417 is supported by a support rail 39 disposed on an inner wall of the tub 30 and maintains balance of the vane 410 while the vane 410 makes a reciprocal motion along the vane guide 510. The vane roller 417 is not an essential configuration. In other words, when the vane assembly 400 does not include the vane roller 417, both ends of the vane 410 may also be supported by the support rail 39.

The vane holder 430 is disposed at a position at which the vane 410 is mounted on the vane guide 510 and is formed to surround an outer surface of the vane guide 510. The vane holder 430 stably fixes the vane 410 to the vane carrier 420 so that, when the vane carrier 420 is moved by the vane driving assembly 500, the vane 410 can be moved together with the vane carrier 420.

The vane carrier 420 is disposed in the vane guide 510, and a tooth form 421 that receives a movement force from a driving belt 540 that will be described later is formed in the vane carrier 420, and the tooth form 421 is coupled to the vane holder 430 so that the movement force received from the driving belt 540 can be transferred to the vane 410. In other words, the tooth form 421 of the vane carrier 420 and a tooth form 541 of the driving belt 540 engage with each other. Thus, the movement force of the driving belt 540 is transferred to the vane holder 430 and the vane 410 via the vane carrier 420.

Also, the vane driving assembly 500 includes a vane driving motor 520 that generates a driving force for moving the vane assembly 400, a driving pulley 530 that is connected to a driving shaft 521 of the vane driving motor 520 and rotates, the driving belt 540 that transfers a rotational force of the driving pulley 530 to the vane carrier 420, and a driven pulley 550 that rotates together with the driving pulley 530 due to the driving belt 540.

The vane driving motor 520 generates a rotational force for moving the vane assembly 400 connected to the vane holder 430. A direct current (DC) motor, an alternating current (AC) motor, or a stepping motor that may be rotated in both directions, such as a clockwise direction and a counterclockwise direction, may be used as the vane driving motor 520. However, embodiments of the present disclosure are not limited thereto, and any type of motor that may be rotated in both directions may be used as the vane driving motor 520.

Also, the vane driving motor 520 may include an encoder that selectively detects rotation displacement of the vane driving motor 520. When the vane driving motor 520 includes an encoder, the dishwasher 1 may calculate a movement distance of the vane assembly 400 caused by rotation of the vane driving motor 520. For example, a product that is obtained by multiplying rotation displacement detected by the encoder by a radius of the driving pulley 530 becomes the movement distance of the vane assembly 400.

The driving belt 540 is wound around the driving pulley 530 and the driven pulley 550 to form a closed curve and makes a circulation motion according to rotation of the vane driving motor 520.

Also, the tooth form 541 for transferring the movement force of the driving belt 540 to the vane carrier 420 is formed on an inner surface of the driving belt 540. That is, the tooth form 541 of the driving belt 540 and the tooth form 421 of the vane carrier 420 that will be described later are engaged with each other so that the vane carrier 420 can be moved toward the front of the tub 30 or the rear of the tub 30 according to the movement direction of the driving belt 540.

Also, the vane holder 430 and the vane 410 are moved together according to the movement of the vane carrier 420.

Figure 8:
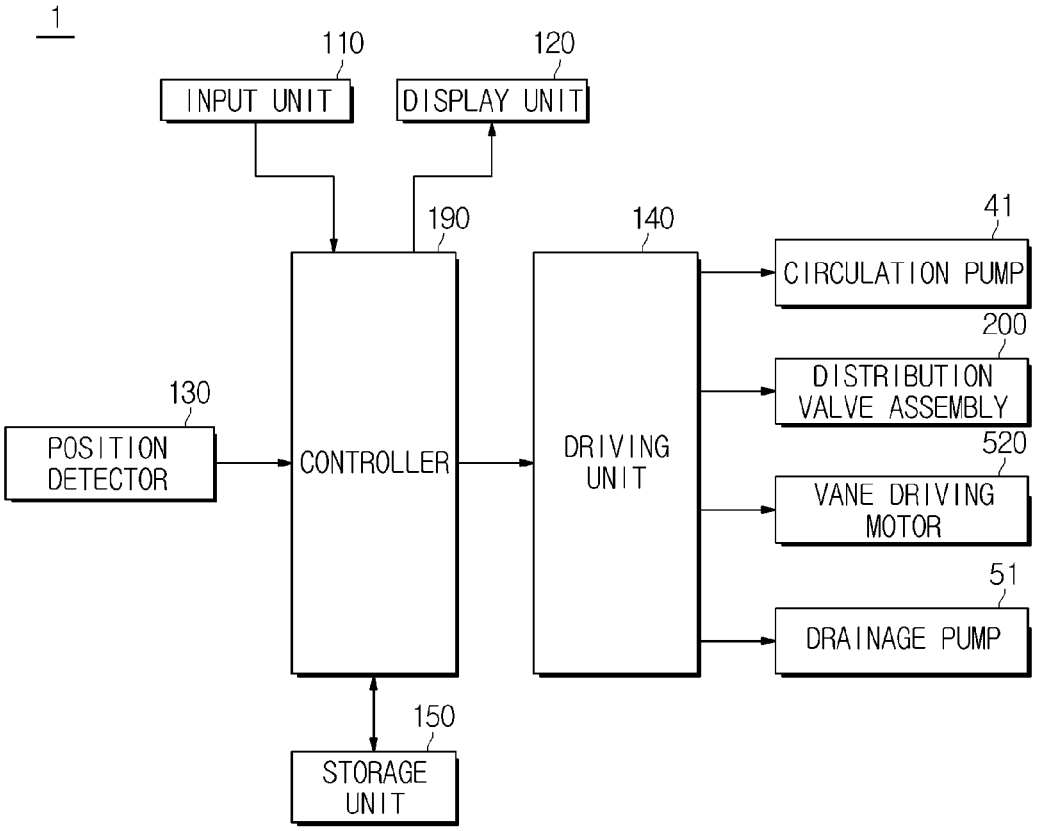
FIG. 8 illustrates a control flow of the dishwasher of FIG. 1.
Figure 9:
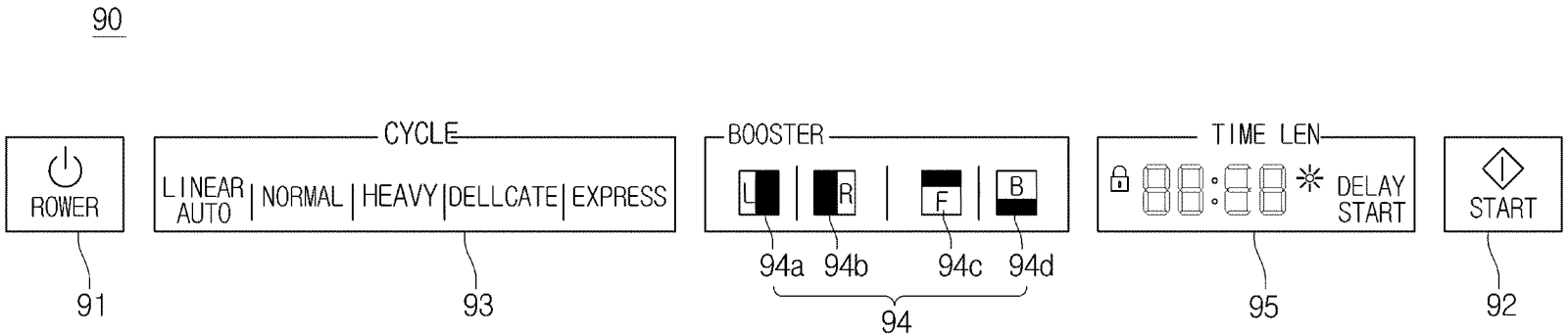
FIG. 9 illustrates a control panel included in the dishwasher of FIG. 1.
Figure 10:
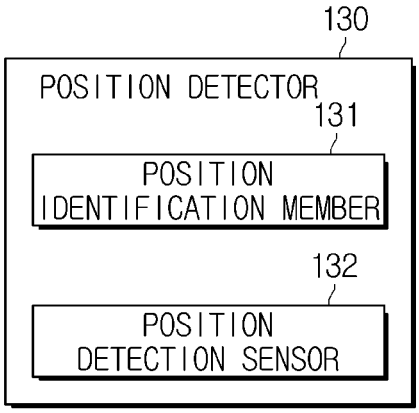
FIG. 10 illustrates a position detector included in the dishwasher of FIG. 1.

FIG. 8 illustrates a control flow of the dishwasher of FIG. 1, and FIG. 9 illustrates a control panel included in the dishwasher of FIG. 1, and FIG. 10 illustrates a position detector included in the dishwasher of FIG. 1.

Referring to FIGS. 8 through 10, the dishwasher 1 may include an input unit 110, a display unit 120, a position detector 130, a driving unit 140, a storage unit 150, and a controller 190 in addition to the above-described configuration.

The input unit 110 includes a plurality of manipulation buttons 91, 92, 93, and 94 which are disposed on the control panel 90 and to which manipulation instructions on the dishwasher 1 are input from the user.

In detail, the input unit 110 includes a power button 91 through which power is input to the dishwasher 1, an operating button 92 through which the dishwasher 1 operates, a course button 93 for selecting a washing course, and a separation washing button 94 through which the inside of the tub 30 is divided into a plurality of washing areas and washing instructions on the plurality of washing areas are input.

A micro switch, a membrane switch, or a touchpad, for example, may be used as a plurality of manipulation buttons 91, 92, 93 and 94.

The separation washing button 94 includes a left washing button 94*a* through which left washing instructions for washing the dishes accommodated on the left of the basket (see 21 of FIG. 1) are input, a right washing button 94*b* through which right washing instructions for washing the dishes accommodated on the right of the basket (see 21 of FIG. 1) are input, a front washing button 94*c* through which front washing instructions for washing the dishes accommodated at the front of the basket (see 21 of FIG. 1) are input, and a rear, or back, washing button 94*d* through which rear washing instructions for washing the dishes accommodated at the rear of the basket (see 21 of FIG. 1) are input. Operations using the buttons 94*a*, 94*b*, 94*c*, and 94*d* included in the separation washing button 94 will now be described in detail.

The display unit 120 includes a display panel 95 that is disposed on the control panel 90 and displays operating information of the dishwasher 1. In detail, the display panel 95 may display a washing area in which a washing operation is performed, from among the plurality of washing areas, a washing course selected by the user, an expected washing time or the remaining washing time. A liquid crystal display (LCD) panel, a light emitting diode (LED) panel, or an organic light emitting diode (OLED) panel, for example, may be used as the display panel 95.

The driving unit 140 drives elements included in the dishwasher 1 according to control signals of the controller 190 that will be described later. In detail, the driving unit 140 includes a driving circuit (not shown) that generates a driving current for driving the circulation pump 41, the drainage pump 51, the distribution valve assembly 200, and the vane driving motor 520.

For example, the driving unit 140 may include an H-bridge circuit (not shown) to drive the vane driving assembly 500 that moves the vane assembly 400 in both directions.

The storage unit 150 may include volatile memory (not shown), such as a D-random access memory (RAM) or S-RAM that temporarily stores temporary data generated during an operation of controlling the operation of the dishwasher 1 in addition to non-volatile memory (not shown), such as a magnetic disc or a solid state disk that permanently stores programs and data for controlling the operation of the dishwasher 1.

The controller 190 controls the operation of each of the elements of the dishwasher 1. In detail, the controller 190 transmits control signals used to control the circulation pump 41, the drainage pump 51, the distribution valve assembly 200, and the vane driving motor 520 based on the user's manipulation instructions input by the input unit 110 to the driving unit 140.

The controller 190 may include one or more microprocessors (not shown) that perform an arithmetic operation based on the programs and the data stored in the storage unit 150.

The dishwasher 1 may optionally include the position detector 130. That is, the position detector 130 is not an essential element.

The position detector 130 includes a position identification member 131 disposed on the vane assembly 400 and a position detection sensor 132 that detects the position identification member 131.

The position identification member 131 may be disposed on the vane assembly 400.

For example, the position identification member 131 may be attached onto one end of the vane 410, a bottom surface or top surface of the vane holder 430, or a bottom surface or top surface of the vane carrier 420. That is, the position identification member 131 may be attached to the vane assembly 400 and may be moved together with the vane assembly 400.

The position detection sensor 132 is installed to correspond to the position of the position identification member 131. However, unlike the position identification member 131, the position detection sensor 132 may be disposed at a position at which the position detection sensor 132 is not moved together with the vane assembly 400.

For example, if the position identification member 131 is attached onto one end of the vane 410, the position detection sensor 132 may be installed on the support rail (see 39 of FIG. 5), and if the position identification member 131 is attached onto the top surface of the vane holder 430 or the top surface of the vane carrier 420, the position detection sensor 132 may be installed at the top surface of the vane guide 510.

Also, if the position identification member 131 is attached onto the bottom surface of the vane holder 430 or the bottom surface of the vane carrier 420, the position detection sensor 132 may be installed at the bottom surface of the vane guide 510 or the bottom surface of the tub 30.

In this way, the position detection sensor 132 may be disposed at any position at which the position detection sensor 132 may sense a magnetic field of a permanent magnet 152 while the vane assembly 400 is moved. In other words, the position detection sensor 132 may be disposed at any position of a movement path of the vane assembly 400.

Also, a position of the vane assembly 400 at which the position detection sensor 132 senses the magnetic field of the permanent magnet 152 while the vane assembly 400 is moved, becomes a reference position.

For example, when the position identification member 131 is disposed at the vane holder 430 or the vane carrier 420 and the position detection sensor 132 is disposed at the rearmost position of the vane guide 510, i.e., in the vicinity of the fixed nozzle assembly 300, the reference position is a position that is the rearmost position of the vane guide 510, i.e., closest to the fixed nozzle assembly 300.

Also, when the position identification member 131 is disposed at the vane holder 430 or the vane carrier 420 and the position detection sensor 132 is disposed at the foremost position of the vane guide 510, i.e., in the vicinity of the door 11, the reference position is the foremost position of the vane guide 510.

Of course, the position detection sensor 132 may also be disposed at an arbitrary position of the movement path of the vane assembly 400. For example, the position detection sensor 132 may also be disposed in the center of the vane guide 510.

It is assumed that the position detection sensor 132 is disposed at one side of the vane guide 510, i.e., the rearmost or the foremost position of the vane guide 510. However, this is for understanding, and embodiments of the present disclosure are not limited thereto.

In addition, two position detection sensors 132 in total may be disposed at the rearmost position and the foremost position of the vane guide 510 respectively. In this case, the reference position may include a first reference position that is the rearmost position of a guide rail 160 and a second reference position that is the foremost position of the guide rail 160.

It is also assumed that the position detector 130 includes the position identification member 131 and the position detection sensor 132. However, embodiments of the present disclosure are not limited thereto.

A permanent magnet that generates a magnetic field may be used as the position identification member 131, and a hall sensor that senses a magnetic field generated by the permanent magnet may be used as the position detection sensor 132.

In addition, each of the position identification member 131 and the position detection sensor 132 may include protrusions and a micro switch, a permanent magnet and a reed switch, an infrared sensor module, a capacitive type proximity sensor, an ultrasonic sensor module, and a current detection sensor, for example. However, the disclosure is not limited to the sensors described above, and may include any type of sensor suitable for detecting a position.

For example, when the position detector 130 includes protrusions and a micro switch, the protrusions may be formed on the bottom surface of the vane holder 430, and the micro switch may be disposed at one side of the vane guide 510. When the vane assembly 400 is disposed at the reference position, the protrusions pressurize the micro switch so that the position detector 130 can sense that the vane assembly 400 is disposed at the reference position.

As an example, when the position detector 130 includes an infrared sensor module, the infrared sensor module may be disposed at one side of the vane guide 510. If the vane assembly 400 is disposed at the reference position, infrared rays emitted from the infrared sensor module may be reflected on the vane assembly 400, and the infrared sensor module may receive reflected light. In this way, if the infrared sensor module receives the reflected light, the position detector 130 may sense that the vane assembly 400 is disposed at the reference position.

In addition, the position detector 130 may include a capacitive type proximity sensor that senses a change of an electrostatic capacity caused by the vane assembly 400 and an ultrasonic sensor module that emits ultrasonic waves and detects reflected waves reflected by the vane assembly 400.

Also, the dishwasher 1 includes the position detector 130 that detects whether the vane assembly 400 is disposed at the reference position. However, the dishwasher 1 may not include the position detector 130.

For example, the vane driving motor 520 actuates so that the vane assembly 400 can be moved toward one side of the vane guide 510, and while the vane driving motor 520 is actuating, a driving current supplied to the vane driving motor 520 may be detected, and if the magnitude of the detected driving current is equal to or greater than a predetermined reference current, it may be determined that the vane assembly 400 is disposed at the rearmost position of the vane guide 510.

The dishwasher 1 includes the position identification member 131 and the position detection sensor 132 and defines the reference position so that the vane assembly 400 can be stably moved, in detail, so that the dishwasher 1 can recognize the position of the vane assembly 400 and can move the vane assembly 400 based on the recognized position of the vane assembly 400.

The reference position is defined using the position identification member 131 and the position detection sensor 132 so that the dishwasher 1 can recognize the position of the vane assembly 400, can move the vane assembly 400 on a predetermined movement path, and can dispose the vane assembly 400 at a predetermined position.

In other words, the reference position may be a reference position of movement of the vane assembly 400. In detail, the dishwasher 1 may move the vane assembly 400 based on the reference position to calculate the position of the vane assembly 400.

For example, when the dishwasher 1 disposes the vane assembly 400 at a particular position, the dishwasher 1 moves the vane assembly 400 based on the reference position to move the vane assembly 400 to a desired position.

For this reason, if a washing operation or rinsing operation of the dishwasher 1 starts being performed or is finished, the dishwasher 1 disposes the vane assembly 400 at the reference position. That is, the reference position may be a position at which the vane assembly 400 starts moving and a position at which the vane assembly 400 finishes movement.

Figure 11:
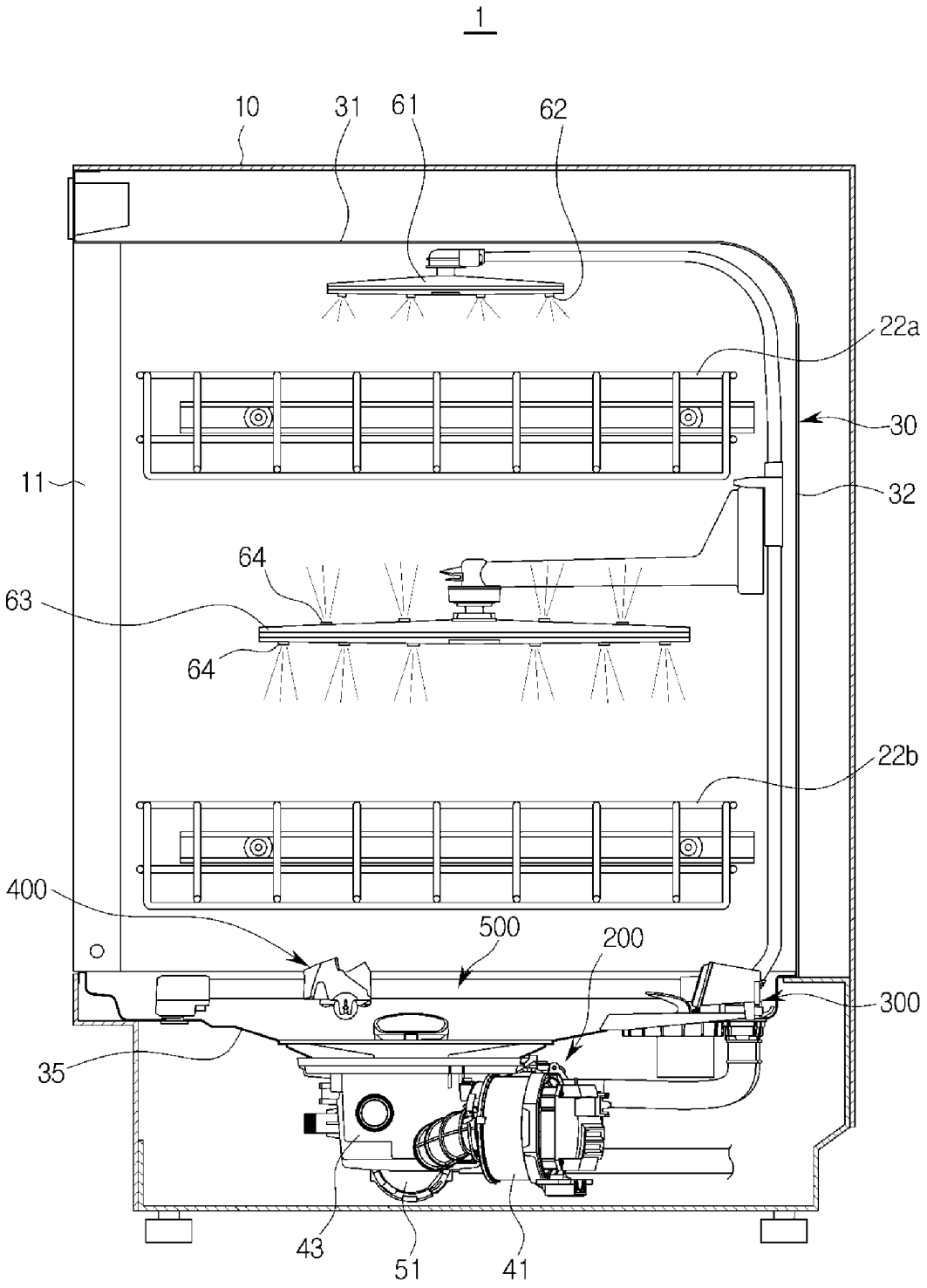
FIG. 11 illustrates a dishwasher according to an embodiment of the present disclosure.
Figure 12:
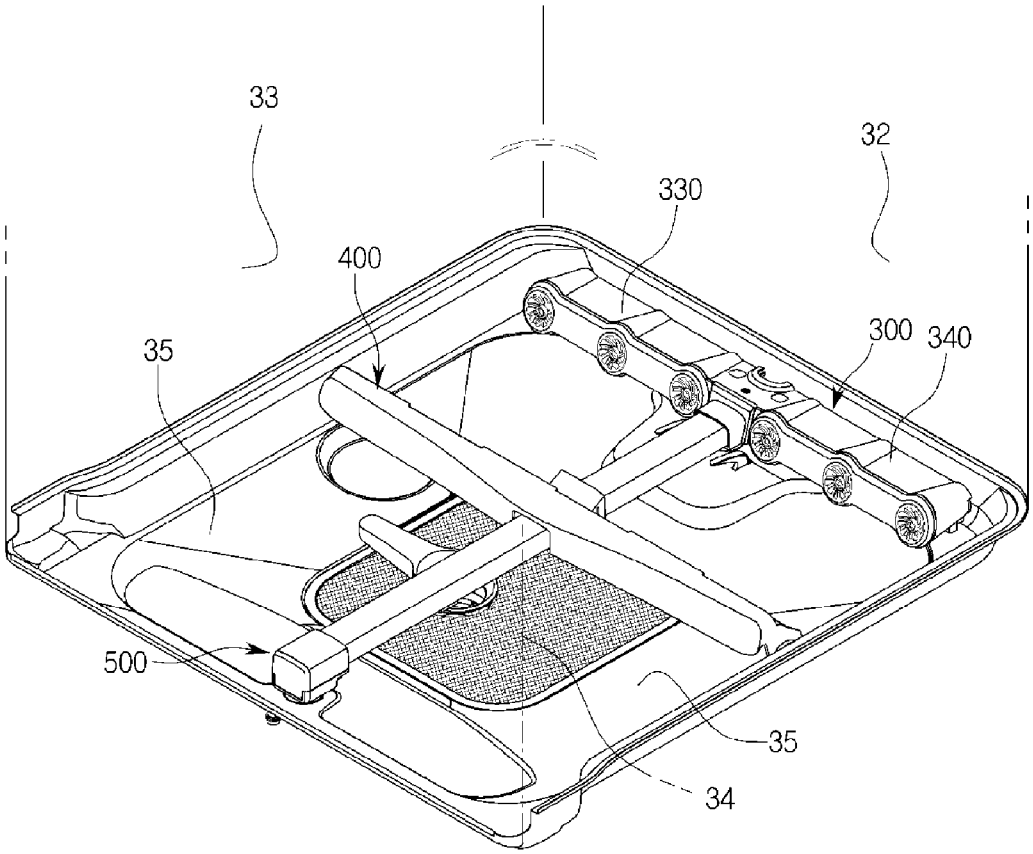
FIG. 12 illustrates a lower portion of the dishwasher illustrated in FIG. 11.

FIG. 11 illustrates a dishwasher according to an embodiment of the present disclosure, and FIG. 12 illustrates a lower portion of the dishwasher illustrated in FIG. 11.

First, a schematic configuration of the dishwasher will be described with reference to FIGS. 11 and 12.

A dishwasher 1 includes a body 10 that constitutes an exterior of the dishwasher 1, a tub 30 disposed in the body 10, baskets 22*a* and 22*b* disposed in the tub 30 to accommodate dishes, rotatable spray nozzles 61 and 63 and a fixed nozzle assembly 300 that spray washing water, a sump 43 in which the washing water is stored, a circulation pump 41 that supplies the washing water of the sump 43 to the rotatable spray nozzles 61 and 63 and the fixed nozzle assembly 300, a distribution valve assembly 200 that distributes the washing water to the rotatable spray nozzles 61 and 63 and the fixed nozzle assembly 300, a drainage pump 51 that discharges the washing water of the sump 43 to the outside of the body 10 together with filth, a vane assembly 400 that moves in the tub 30 and reflects the washing water toward the dishes, and a vane driving assembly 500 that drives the vane assembly 400.

The tub 30 may have a shape of a box, of which the front is opened, so that the dishes can be put in or taken out from the opened front of the tub 30. The opened front of the tub 30 may be opened/closed by a door 11. The tub 30 may have an upper wall 31, a rear wall 32, a left wall 33, a right wall 34, and a bottom plate 35.

The baskets 22*a* and 22*b* may be wire racks configured of wires so that the washing water can pass through the wires without being gathered. The baskets 22*a* and 22*b* may be detachably disposed in the tub 30. The baskets 22*a* and 22*b* may include an upper basket 22*a* disposed at an upper portion of the tub 30 and a lower basket 22*b* disposed at a lower portion of the tub 30.

The rotatable spray nozzles 61 and 63 may spray the washing water with a high pressure so that the dishes can be washed. The rotatable spray nozzles 61 and 63 include an upper rotation nozzle 61 disposed at an upper portion of the tub 30 and an intermediate rotation nozzle 63 disposed in the center of the tub 30.

The rotatable spray nozzles 61 and 63 spray the washing water through spray holes 62 and 64 formed in the upper rotation nozzle 61 and the intermediate rotation nozzle 63 and rotate due to reaction caused by spraying the washing water.

The fixed nozzle assembly 300 is disposed at a lower portion of the tub 30, is provided not to be moved, unlike the rotatable spray nozzles 61 and 63, and is fixed to one side of the tub 30. The fixed nozzle assembly 300 may be disposed adjacent to the rear wall 32 of the tub 30 and may spray the washing water toward the front of the tub 30. Thus, the washing water sprayed by the fixed nozzle assembly 300 may not be sprayed directly toward the dishes.

The fixed nozzle assembly 300 may include a left fixed nozzle 330 disposed on the left of the tub 30 and a right fixed nozzle 340 disposed on the right of the tub 30.

The washing water sprayed by the fixed nozzle assembly 300 may be reflected toward the dishes by the vane assembly 400. The fixed nozzle assembly 300 may be disposed below the lower basket 22*b*, and the vane assembly 400 may reflect the washing water sprayed by the fixed nozzle assembly 300 upward.

The vane assembly 400 may include a vane 410 that extends long in a right/left direction of the tub 30 to reflect all quantities of the washing water sprayed by the fixed nozzle assembly 300. The vane 410 may make a linear reciprocal motion along the spray direction of the washing water sprayed by the fixed nozzle assembly 300. That is, the vane 410 may make a linear reciprocal motion along a forward/backward direction of the tub 30.

Thus, a linear spray structure including the fixed nozzle assembly 300 and the vane assembly 400 may wash all areas of the tub 30 without forming a blind spot. The distribution valve assembly 200 distributes the washing water so that the rotatable spray nozzles 61 and 63 and the fixed nozzle assembly 300 can spray the washing water independently. Furthermore, the distribution valve assembly 200 distributes the washing water so that the left fixed nozzle 330 and the right fixed nozzle 340 of the fixed nozzle assembly 300 can spray the washing water independently.

Thus, the dishwasher 1 may divide the tub 30 into right and left sides independently to wash the dishes. Of course, the dishwasher 1 may subdivide the tub 30 as needed in addition to division of the tub 30 into right and left sides.

Hereinafter, a main configuration of the dishwasher 1 according to an embodiment of the present disclosure will be sequentially described.

Figure 13:
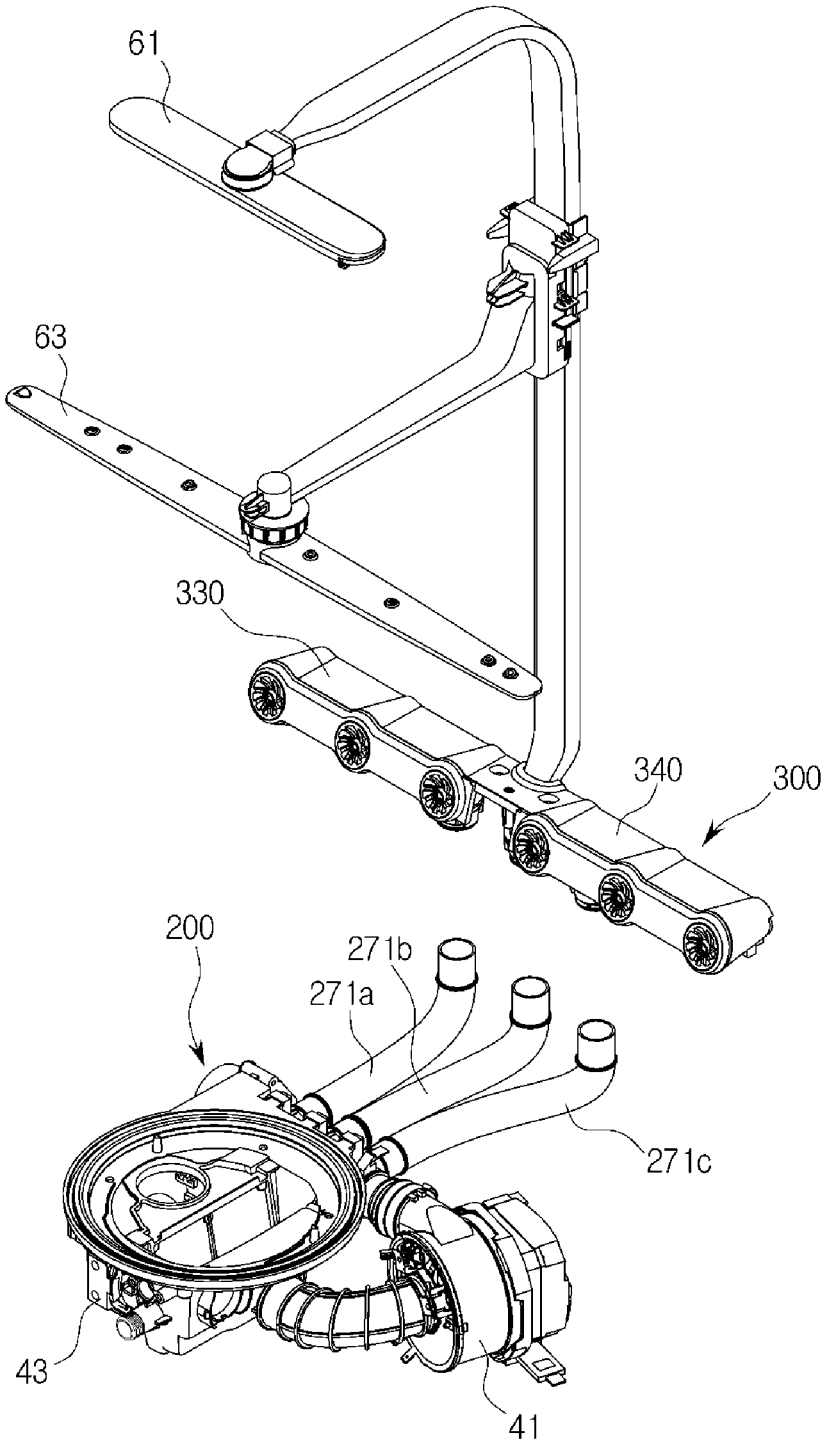
FIG. 13 illustrates a structure of a flow path of the dishwasher of FIG. 11.

FIG. 13 illustrates a structure of a flow path of the dishwasher 1 of FIG. 11.

Referring to FIG. 13, the sump 43, the circulation pump 41, the distribution valve assembly 200, the fixed nozzle assembly 300, and the rotatable spray nozzles 61 and 63 are involved in circulation and spraying of the washing water.

The washing water sprayed by the fixed nozzle assembly 300 or the rotatable spray nozzles 61 and 63 is accommodated in the sump 43, and the washing water accommodated in the sump 43 is pumped by the circulation pump 41 to the distribution valve assembly 200.

The distribution valve assembly 200 distributes the washing water pumped by the circulation pump 41 to the rotatable spray nozzles 61 and 63, the left fixed nozzle 330, and the right fixed nozzle 340.

Also, the distribution valve assembly 200 may operate in a plurality of distribution modes in which the washing water is distributed. For example, the distribution valve assembly 200 operates in first, second, third, and fourth distribution modes.

In the first distribution mode, the distribution valve assembly 200 may distribute the washing water only to the rotatable spray nozzles 61 and 63 via a second hose 271*b*, and in the second distribution mode, the distribution valve assembly 200 may distribute the washing water only to the right fixed nozzle 340 via a third hose 271*c*. Also, in the third distribution mode, the distribution valve assembly 200 may supply the washing water only to the left fixed nozzle 330 and the right fixed nozzle 340 via a first hose 271*a* and the third hose 271*c*, and in the fourth distribution mode, the distribution valve assembly 200 may supply the washing water only to the left fixed nozzle 330 via the first hose 271*a*.

The washing water distributed to the rotatable spray nozzles 61 and 63 is sprayed by the rotatable spray nozzles 61 and 63 toward the dishes so that the dishes can be washed with the washing water. Also, the washing water distributed to the left fixed nozzle 330 and the right fixed nozzle 340 is sprayed toward the vane assembly 400 via the left fixed nozzle 330 and the right fixed nozzle 340 and is reflected by the vane assembly 400 so that the dishes can be washed with the washing water.

The washing water used to wash the dishes is accommodated in the sump 43 again.

In this way, the washing water circulates the sump 43, the circulation pump 41, the distribution valve assembly 200, the rotatable spray nozzles 61 and 63, and the fixed nozzle assembly 300.

Figure 14:
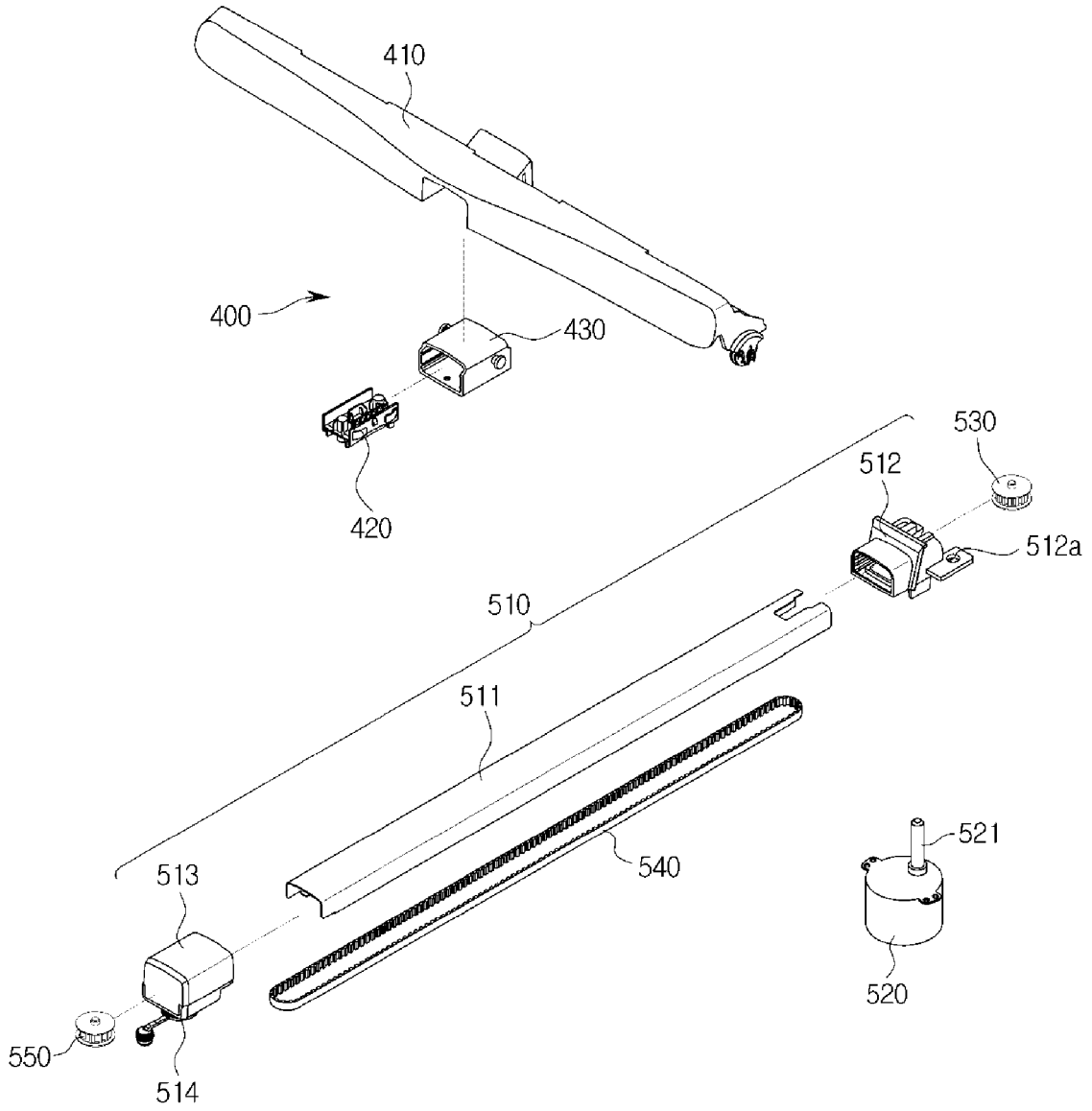
FIG. 14 illustrates a configuration of a vane assembly and a configuration of a vane driving assembly included in the dishwasher of FIG. 11.
Figure 15:
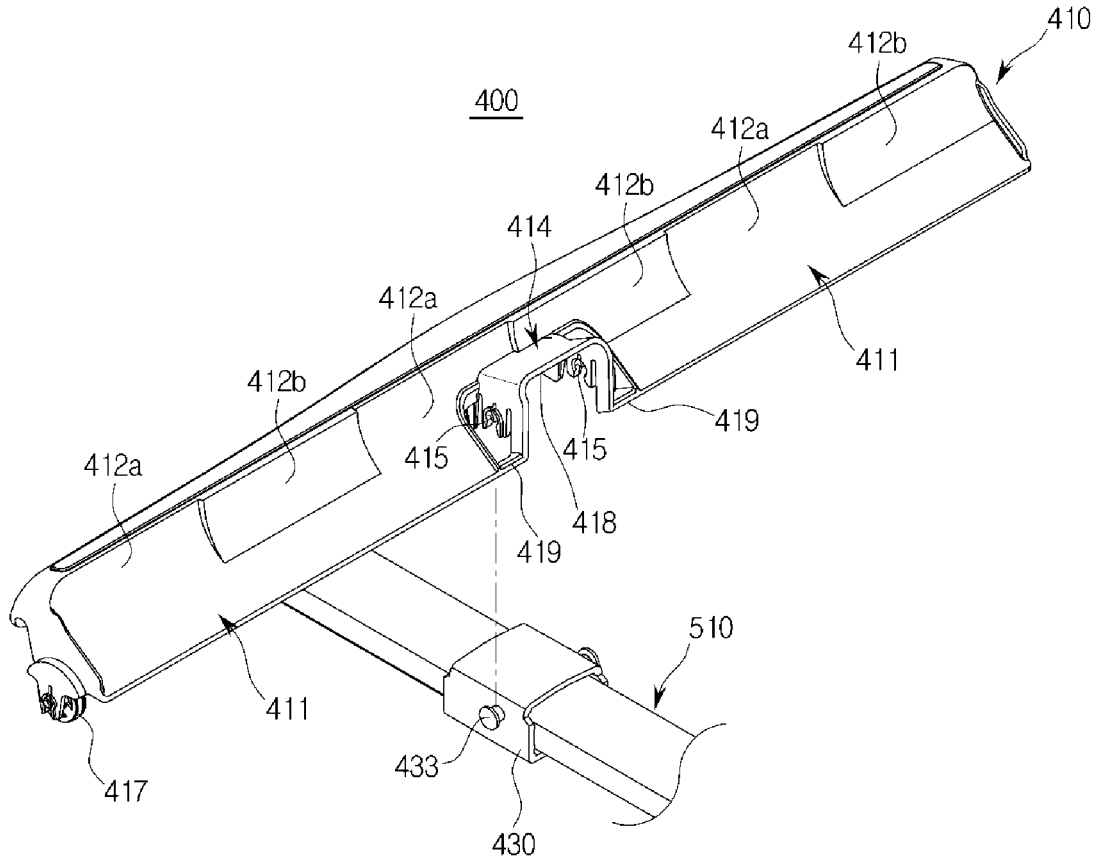
FIG. 15 illustrates a configuration of the vane assembly included in the dishwasher of FIG. 11.

FIG. 14 illustrates a configuration of a vane assembly and a configuration of a vane driving assembly included in the dishwasher of FIG. 11, and FIG. 15 illustrates a configuration of the vane assembly included in the dishwasher of FIG. 11. Also, FIG. 16 illustrates a configuration of a belt and a configuration of a vane carrier included in the dishwasher of FIG. 11.

Figure 16:
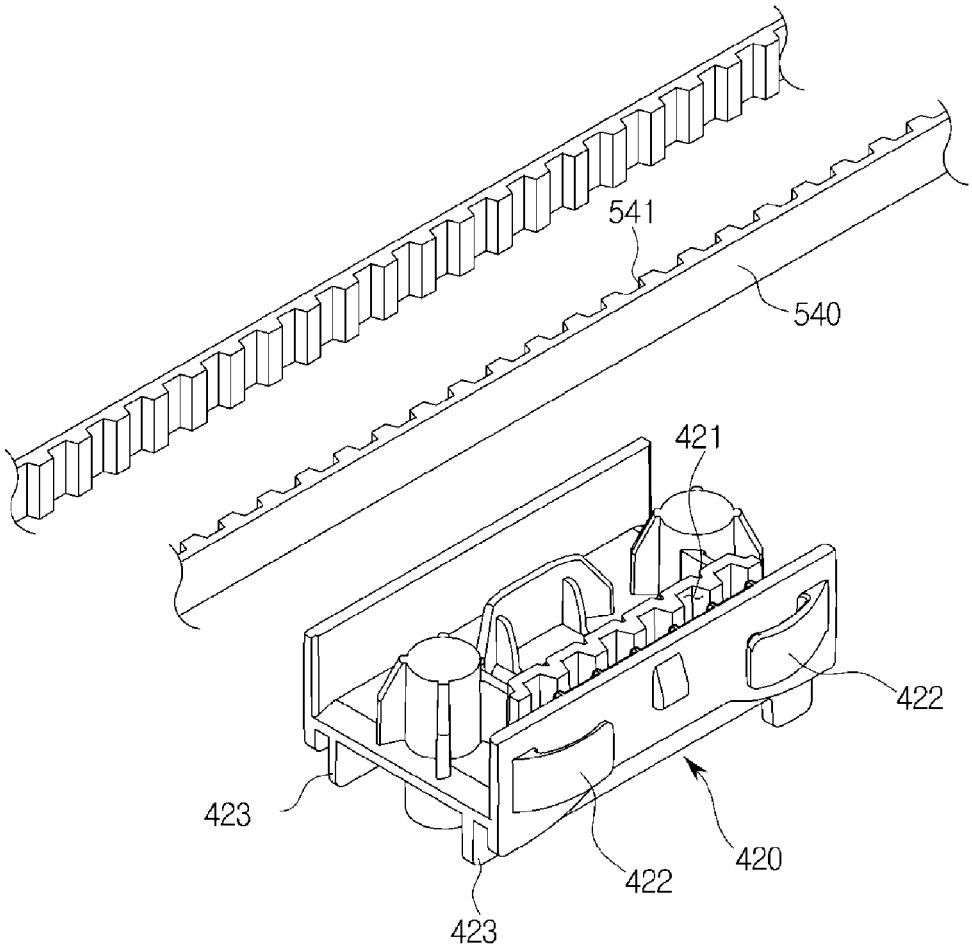
FIG. 16 illustrates a configuration of a belt and a configuration of a vane carrier included in the dishwasher of FIG. 11.

Referring to FIGS. 14 through 16, the dishwasher 1 includes the vane assembly 400 that reflects the washing water sprayed by the fixed nozzle assembly 300 and the vane driving assembly 500 that causes the vane assembly 400 to make a linear reciprocal motion.

The vane driving assembly 500 includes a vane guide 510 that guides movement of the vane assembly 400, a vane driving motor 520 that generates a rotational force for moving the vane assembly 400, a driving pulley 530 that is coupled to a driving shaft 521 of the vane driving motor 520 and rotates, a driving belt 540 that is connected to the driving pulley 530, rotates and is disposed in an internal space of the vane guide 510, and a driven pulley 550 that is connected to the driving belt 540 to rotatably support the driving belt 540.

The vane guide 510 may be disposed to extend long in a forward/backward direction in the middle of the left wall (see 33 of FIG. 12) and the right wall (see 34 of FIG. 12) of the tub (see 30 of FIG. 12).

The vane guide 510 includes a guide rail 511 having a shape of a pipe, of which an internal space and a lower opening are formed, a rear holder 512 that rotatably supports the driving pulley 530 and is coupled to a rear end of the guide rail 511, and a front holder 513 that rotatably supports the driven pulley 550 and is coupled to a front end of the guide rail 511.

The guide rail 511 is disposed to extend in the forward/backward direction in the middle of the left wall (see 33 of FIG. 12) and the right wall (see 34 of FIG. 12) of the tub (see 30 of FIG. 12), and the internal space and the lower opening of the guide rail 511 may extend from one end to the other end of the guide rail 511 in a lengthwise direction of the guide rail 511.

A coupling hole 512*a* may be formed in the rear holder 512 to fix the vane guide 510 to a bottom plate cover (see 600 of FIG. 17) that will be described later, and a coupling protrusion 514 may be formed on the front holder 513 to fix the vane guide 510 to the bottom plate (see 35 of FIG. 2).

The vane driving motor 520 generates a rotational force for moving the vane assembly 400. A DC motor, an AC motor, or a stepping motor that may be rotated in both directions, such as a clockwise direction and a counterclockwise direction, may be used as the vane driving motor 520. However, embodiments of the present disclosure are not limited thereto. Any type of motor that may be rotated in both directions or in a single direction may be used as the vane driving motor 520.

Also, the vane driving motor 520 may include an encoder that selectively detects rotation displacement of the vane driving motor 520. When the vane driving motor 520 includes an encoder, the dishwasher 1 may calculate a movement distance of the vane assembly 400 due to rotation of the vane driving motor 520. For example, a product that is obtained by multiplying rotation displacement detected by the encoder by a radius of the driving pulley 530 becomes the movement distance of the vane assembly 400.

The driving belt 540 is disposed in the internal space formed in the guide rail 511, is wound around the driving pulley 530 and the driven pulley 550, and forms a looped curve. Also, the driving belt 540 may make a rotational motion according to a rotation direction of the vane driving motor 520 when the vane driving motor 520 is driven.

The driving belt 540 may be formed of a resin material including aramid fiber in consideration of tensile strength and costs.

A tooth form 541 may be formed on an inner side surface of the driving belt 540. The tooth form 541 of the driving belt 540 may transfer a driving force of the driving belt 540 to the vane assembly 400.

The vane assembly 400 includes the vane 410 that reflects the washing water sprayed by the fixed nozzle assembly 300, a vane carrier 420 to which the driving force is transmitted from the driving belt 540, and a vane holder 430 that is coupled to the vane carrier 420 and the vane 410.

The vane 410 may be disposed to extend in a direction perpendicular to the vane guide 510.

The vane 410 may include a reflection, or redirection, portion 411 that reflects, or redirects, the washing water sprayed by the fixed nozzle assembly 300, a cap portion 414 that is disposed in the center of the reflection portion 411 in a lengthwise direction of the reflection portion 411, a vane roller 417 that causes a smooth movement of the vane 410, and a rotation hanging portion 419 that is disposed to be interfered by a rotation guide (see 610 of FIG. 17) of the bottom plate cover 600 that will be described later.

The reflection portion 411 includes reflection surfaces 412*a* and 412*b* that are disposed to be inclined to reflect the washing water. The reflection surfaces 412*a* and 412*b* may include a first reflection surface 412*a* and a second reflection surface 412*b* that are alternately arranged with different inclinations in their lengthwise directions so that reflection angles of the washing water can be different from each other.

The cap portion 414 may include a coupling groove 415 that is coupled to the vane holder 430, and a rotation stopper 418 that limits a rotation range of the vane 410 when the vane 410 that will be described later is rotated by the rotation guide (see 610 of FIG. 17) of the bottom plate cover (see 600 of FIG. 17).

Coupling protrusion 433 of the vane holder 430 may be coupled to the coupling groove 415 of the cap portion 414. In detail, the coupling protrusion 433 may be inserted into the coupling groove 415 of the vane 410. The coupling protrusion 433 may support the vane 410 rotatably.

The vane carrier 420 may be disposed in the internal space of the guide rail 511, like in the driving belt 540 and may be coupled to the tooth form 541 of the driving belt 540 and may make a motion together with the driving belt 540. To this end, the vane carrier 420 may have a tooth form 421 that is to be coupled to the tooth form 541 of the driving belt 540.

Also, the vane carrier 420 may include legs 422 and 423 that are supported on the guide rail 511. The legs 422 and 423 may include a side leg 422 that protrudes laterally and is supported at sidewalls of the guide rail 511 and a lower leg 423 that protrudes downward and is supported at a lower wall of the guide rail 511.

The vane holder 430 is coupled to the vane carrier 420, makes a motion together with the vane carrier 420, and transfers the driving force of the vane carrier 420 to the vane 410. The vane holder 430 is disposed to surround an outer surface of the guide rail 511.

The vane holder 430 is coupled to the vane carrier 420 through the lower opening of the guide rail 511, and the coupling protrusion 433 to which the vane 410 is separably coupled, may be formed on the vane holder 430.

Figure 17:
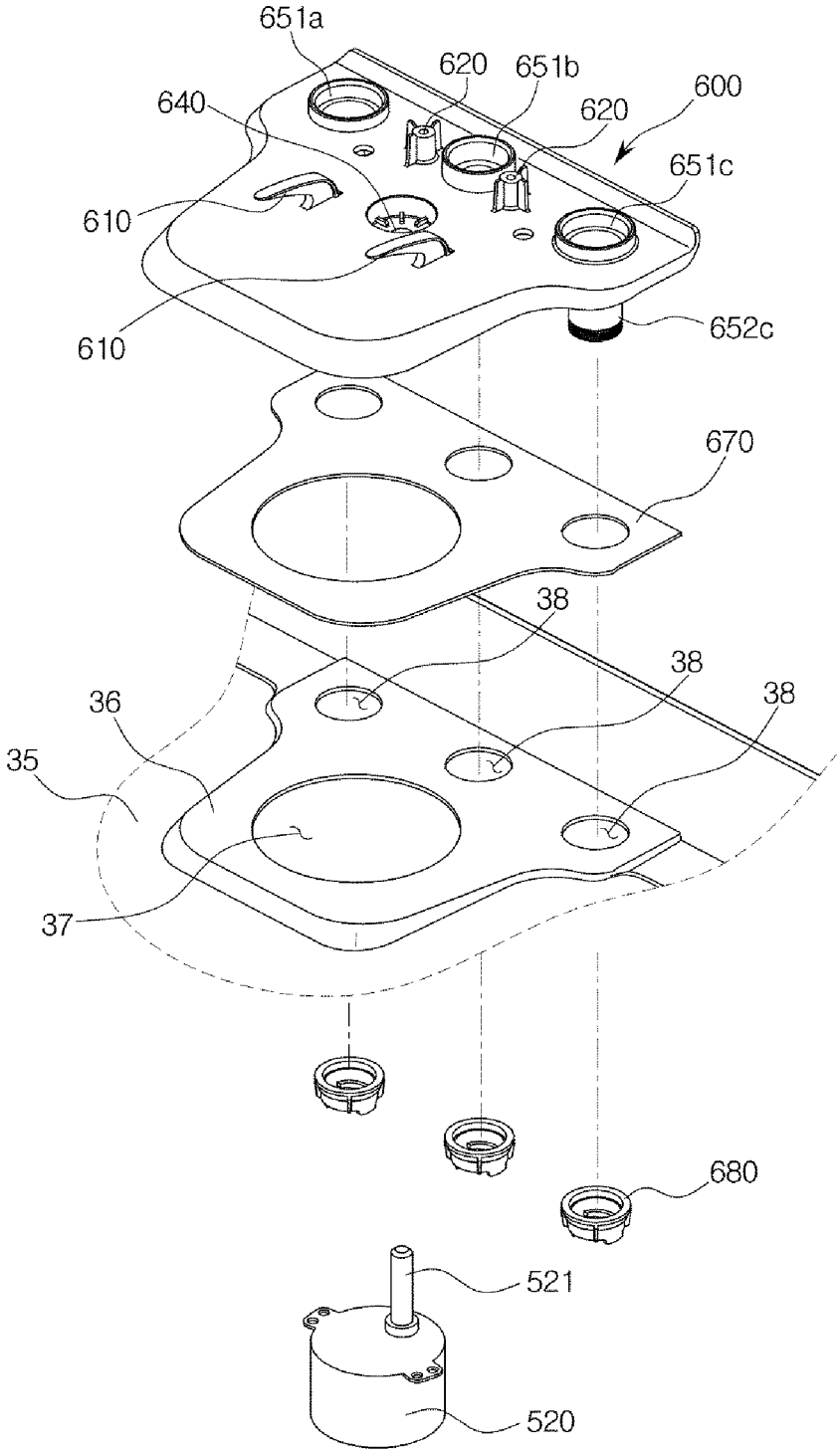
FIGS. 17 and 18 illustrate a configuration of a bottom plate cover included in the dishwasher of FIG. 11.
Figure 18:
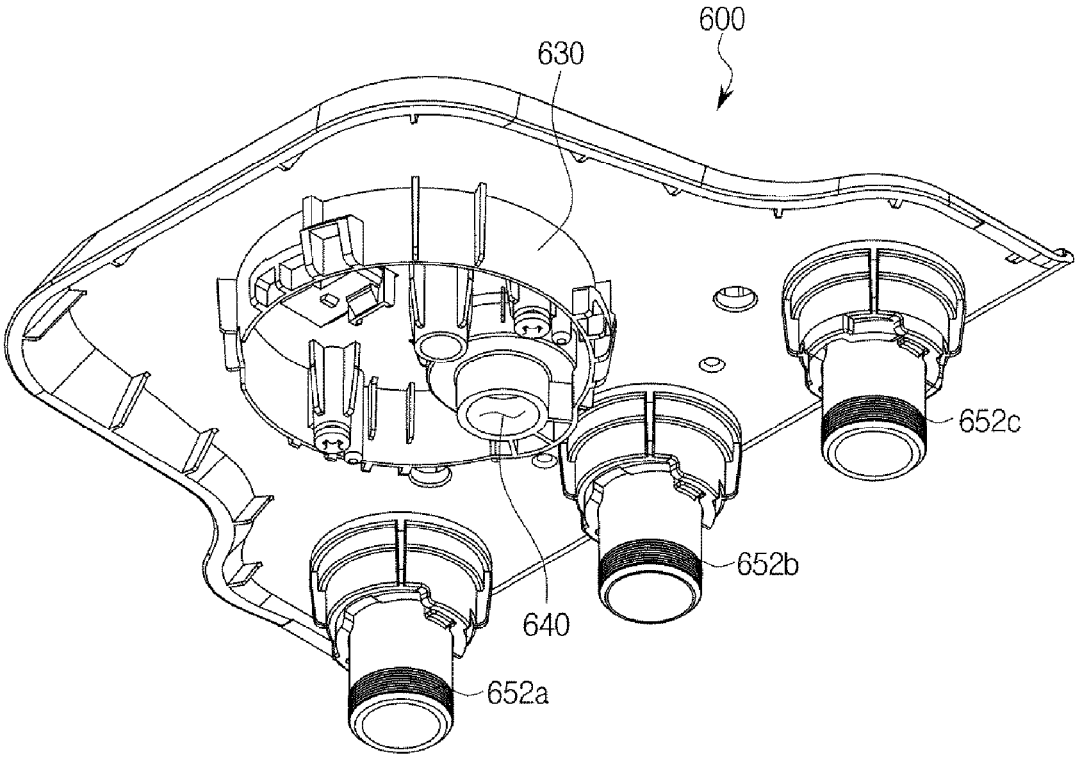
Figure 19:
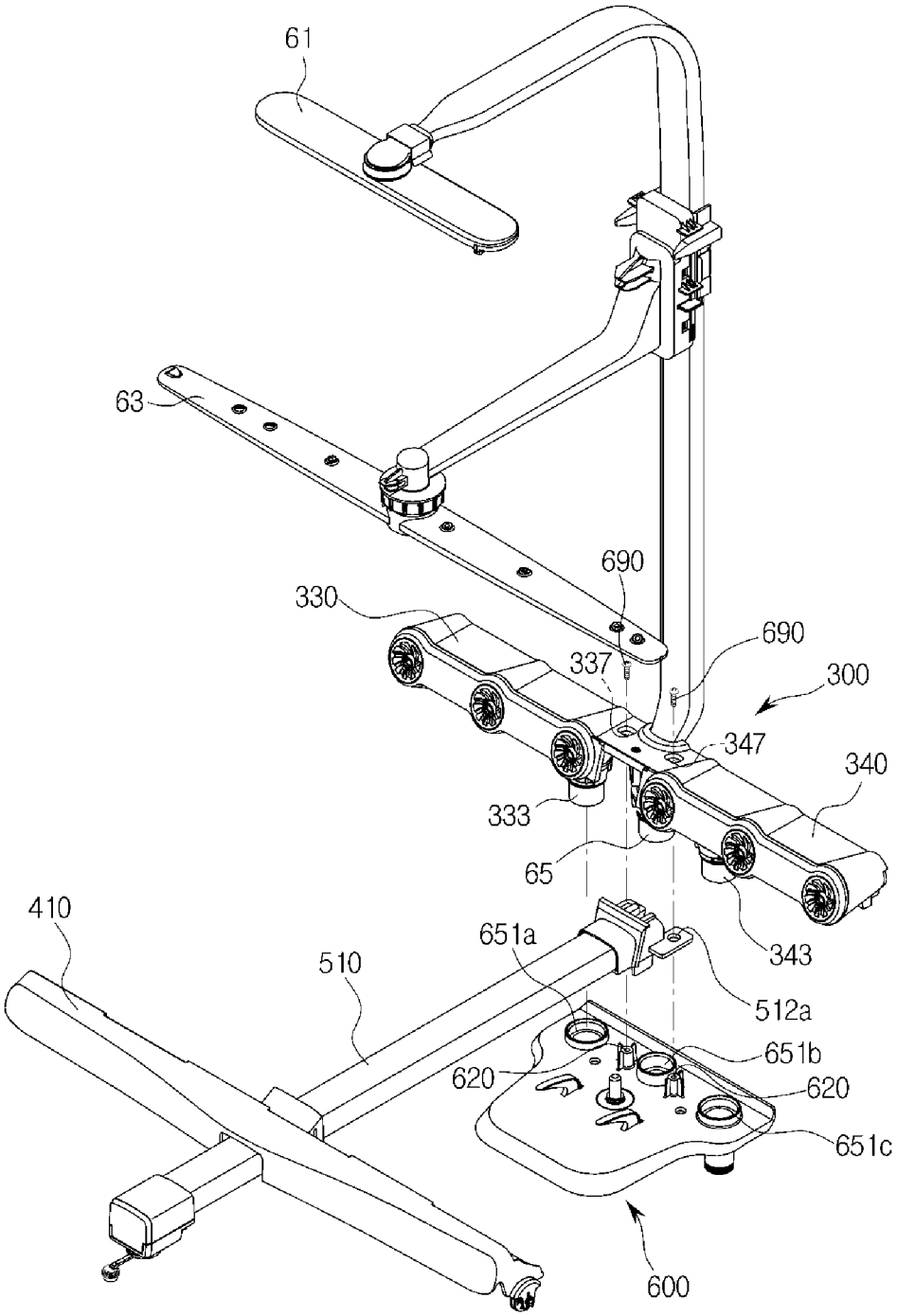
FIG. 19 illustrates a state in which a vane guide and a fixed nozzle assembly included in the dishwasher of FIG. 11 are fixed to the bottom plate cover.

FIGS. 17 and 18 illustrate a configuration of a bottom plate cover included in the dishwasher of FIG. 11, and FIG. 19 illustrates a state in which a vane guide and a fixed nozzle assembly included in the dishwasher of FIG. 11 are fixed to the bottom plate cover.

The bottom plate cover 600 that is to be coupled to one side of the rear of the bottom plate 35 is disposed on the bottom plate 35 of the tub 30. The bottom plate cover 600 performs a function of sealing a driving motor passage hole 37 and a flow path passage hole 38 that are formed in the bottom plate 35 and fixing the vane guide 510 and the fixed nozzle assembly 300 of the dishwasher 1.

A bottom plate protrusion 36 may be formed at the rear of the bottom plate 35 and may protrude so that the bottom plate cover 600 may be coupled to the bottom plate protrusion 36.

The driving motor passage hole 37 through which the vane driving motor 520 for driving the vane assembly 400 passes, and the flow path passage hole 38 through which a flow path that connects the fixed nozzle assembly 300 and the distribution valve assembly 200 passes, may be formed in the bottom plate protrusion 36.

The bottom plate cover 600 closely contacts and is coupled to a top surface of the bottom plate protrusion 36.

The bottom plate cover 600 includes a shaft passage hole 640 through which the driving shaft 521 of the vane driving motor 520 passes, hose connection portions 652*a*, 652*b*, and 652*c* that are inserted into the flow path passage hole 38 of the bottom plate protrusion 36, flow path connection portions 651*a*, 651*b*, and 651*c* that protrude upward so that a flow path 65 of the rotatable spray nozzles 61 and 63 and flow paths 333 and 343 of the fixed nozzle assembly 300 can be coupled to the flow path connection portions 651*a*, 651*b*, and 651*c*, a coupling hole 620 for fixing the fixed nozzle assembly 300 and the vane guide 510, and the rotation guide 610 that protrudes to guide rotation of the vane 410.

A fixed cap 680 may be coupled to the flow path connection portions 651*a*, 651*b*, and 651*c* of the bottom plate cover 600 so that the bottom plate cover 600 can be fixed to the bottom plate protrusion 36.

The shaft passage hole 640 of the bottom plate cover 600 causes the driving shaft 521 of the vane driving motor 520 to protrude toward an inside of the tub 30.

A sealing member 670 through which the washing water inside the tub 30 cannot leak through the driving motor passage hole 37 and the flow path passage hole 38 of the bottom plate protrusion 36, may be disposed between the bottom plate cover 600 and the bottom plate protrusion 36.

A tub penetration portion 630 is formed on a bottom surface of the bottom plate cover 600 and penetrates the driving motor passage hole 37.

The bottom plate cover 600 is disposed in the tub 30. However, an inner side of the tub penetration portion 630 that penetrates the driving motor passage hole 37 is exposed to an outside of the tub 30. Also, the washing water does not permeate the inner side of the tub penetration portion 630 due to the sealing member 670 that prevents outflow of the washing water through the driving motor passage hole 37.

In this way, the vane driving motor 520 is installed at the inner side of the tub penetration portion 630 exposed to the outside of the tub 30.

As illustrated in FIG. 19, the vane guide 510 and the fixed nozzle assembly 300 may be coupled to the bottom plate cover 600. The bottom plate cover 600, the vane guide 510, and the fixed nozzle assembly 300 may be solidly fixed to each other by a fastening member 690. To this end, coupling holes 620, 512*a*, 337, and 347 may be formed in corresponding positions of the bottom plate cover 600, the fixed nozzle assembly 300, and the vane guide 510.

Figure 20:
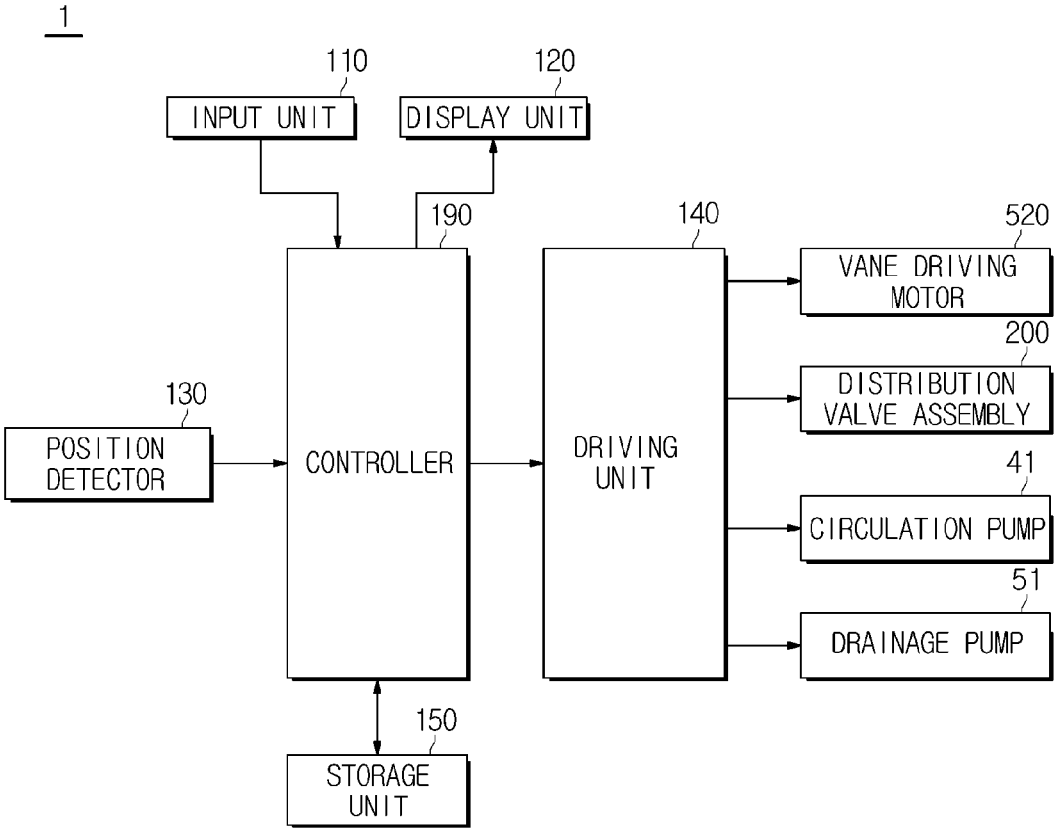
FIG. 20 illustrates a control flow of the dishwasher of FIG. 11.
Figure 21:
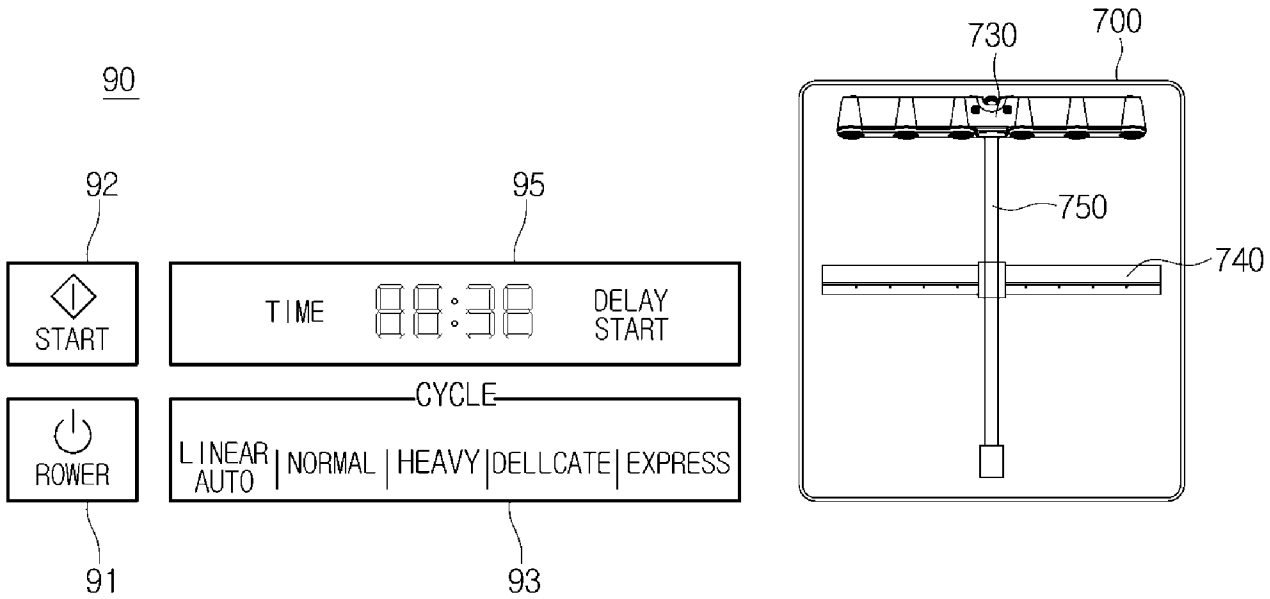
FIG. 21 illustrates a control panel included in the dishwasher of FIG. 11.

FIG. 20 illustrates a control flow of the dishwasher of FIG. 11, and FIG. 21 illustrates a control panel included in the dishwasher of FIG. 11;

Referring to FIGS. 20 and 21, the dishwasher 1 may include an input unit 110, a display unit 120, a driving unit 140, the vane driving motor 520, the circulation pump 41, the drainage pump 51, a storage unit 150, and a controller 190. Also, the dishwasher 1 may further include a position detector 130.

The input unit 110 may include a plurality of input buttons 91, 92, and 93 to which a user's control instructions on the dishwasher 1 are input, and a division washing screen 700.

In detail, the input unit 110 may include a power button 91 through which power is input to the dishwasher 1, an operating button 92 for operating the dishwasher 1, a course button 93 for selecting a washing course, and the division washing screen 700 on which a cleaning area in which washing is performed, is set.

For example, when the user accommodates the dishes in the vicinity of the door 11, the user may input an area in which the dishes are present, by touching or dragging the division washing screen 700.

The display unit 120 may include a display panel 95 on which the washing course selected by the user of the dishwasher 1, an expected washing time or the remaining washing time. An LCD panel, an LED panel, or an OLED panel may be used as the display panel 95.

A washing area in which washing is performed, may be displayed on the division washing screen 700. Also, a nozzle assembly image 730 corresponding to the fixed nozzle assembly 300, a vane assembly image 740 corresponding to the vane assembly 400, and a vane guide image 750 corresponding to the vane guide 510 are displayed on the division washing screen 700 so that the user can easily input the washing area.

In addition, an image inside the tub 30 in which the fixed nozzle assembly 300, the vane assembly 400, and the vane guide 510 are displayed so that the user can easily input the washing area, may also be displayed on the division washing screen 700.

As described above, before a washing operation is performed, an area in which washing is to be performed, is input to the division washing screen 700, and after the washing operation is performed, an area in which washing is being performed, is displayed on the division washing screen 700.

A touch screen panel (TSP) to which control instructions are input from the user and on which operating information is displayed, may be used as the division washing screen 700.

The driving unit 140 drives each of the elements of the dishwasher 1 according to control signals of the controller 190. In detail, the driving unit 140 may include a pump driving circuit (not shown) that drives the vane driving motor 520, the distribution valve assembly 200, the circulation pump 41, and the drainage pump 51.

The storage unit 150 may include volatile memory (not shown), such as a D-RAM or S-RAM that temporarily stores temporary data generated during an operation of controlling the operation of the dishwasher 1 in addition to non-volatile memory (not shown), such as a magnetic disc or a solid state disk that permanently stores programs and data for controlling the operation of the dishwasher 1.

The controller 190 controls operations of the elements included in the dishwasher 1. In detail, the controller 190 outputs control signals for controlling the vane driving motor 520, the circulation pump 41, and the drainage pump 51 based on the control instructions input through the input unit 110.

The controller 190 may include one or more micro processors (not shown) that perform an arithmetic operation based on the programs and data stored in the storage unit 150.

Also, the dishwasher 1 may selectively include the position detector 130 that detects a position of the vane assembly (see 400 of FIG. 11).

Figure 22:
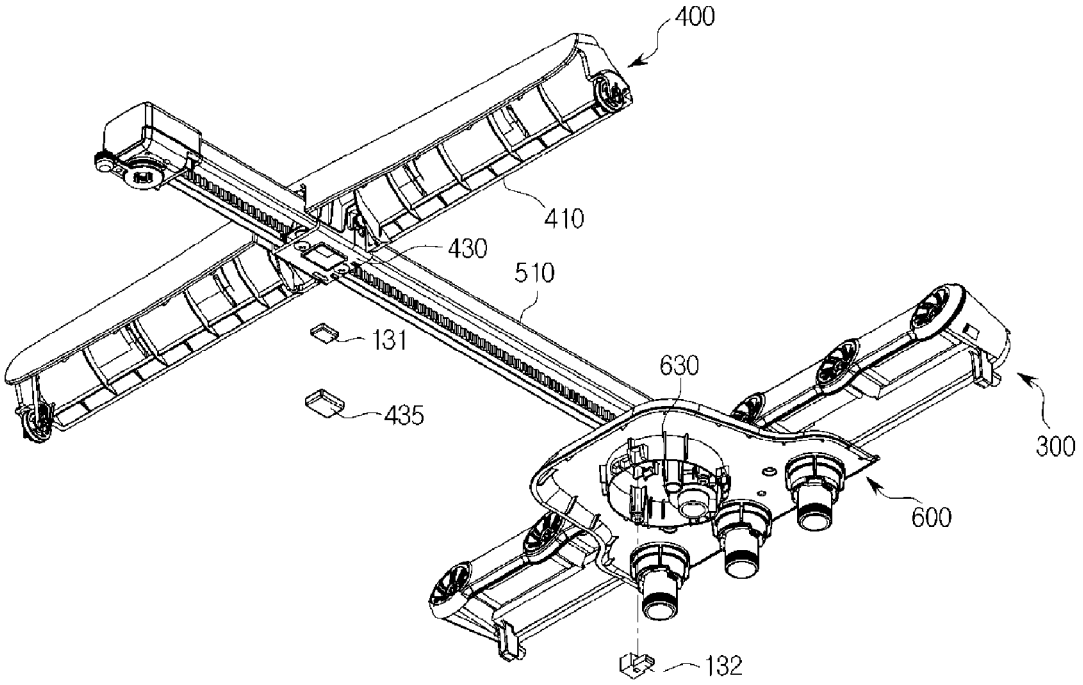
FIGS. 22 and 23 illustrate an example of a position detector included in the dishwasher of FIG. 11.
Figure 23:
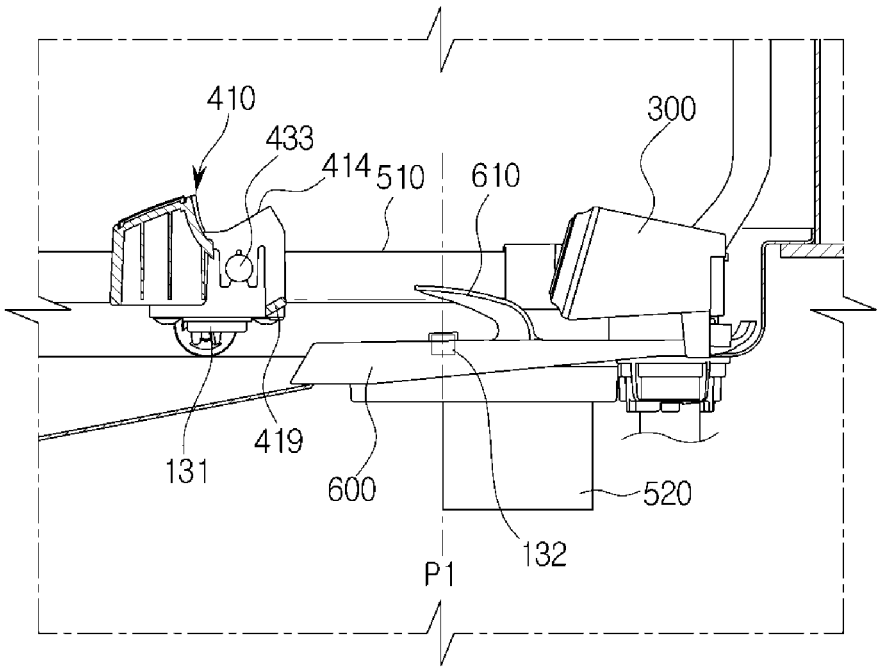
Figure 24:
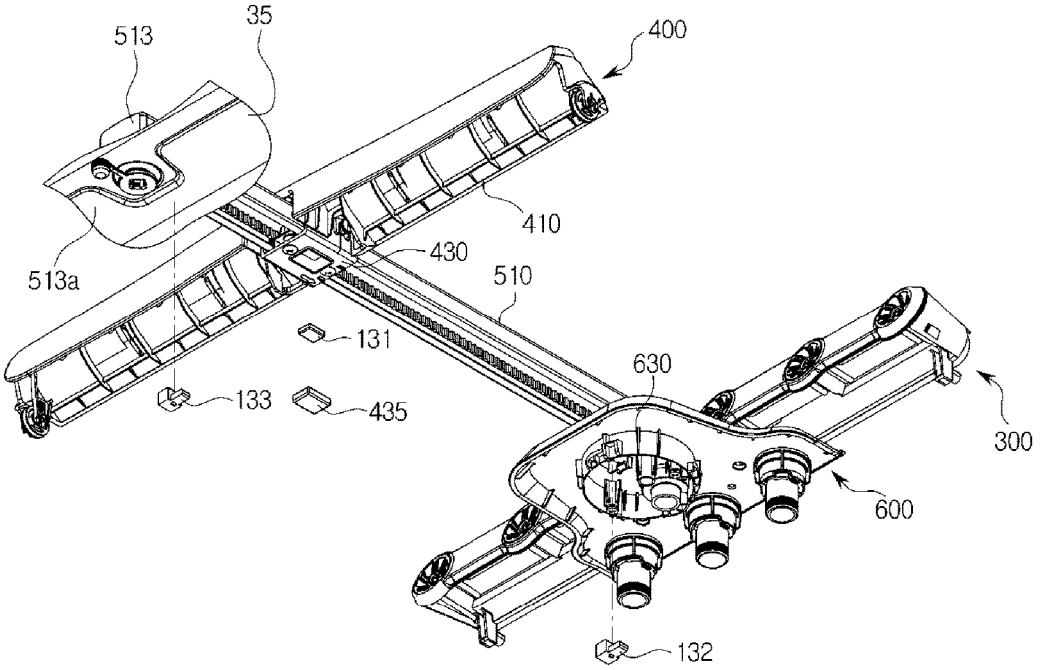
FIGS. 24 and 25 illustrate an example of the position detector included in the dishwasher of FIG. 11.
Figure 25:
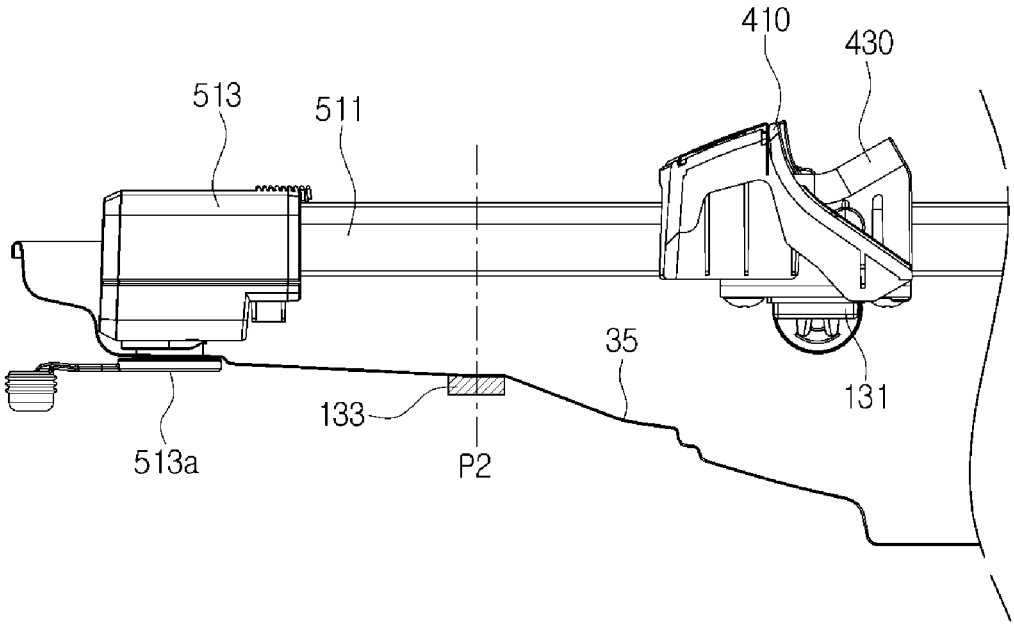

FIGS. 22 and 23 illustrate an example of a position detector included in the dishwasher of FIG. 11, and FIGS. 24 and 25 illustrate an example of the position detector included in the dishwasher of FIG. 11

The position detector 130 may include a position identification member 131 attached to the vane assembly 400 and a position detection sensor 132 that detects the position identification member 131.

If the position detection sensor 132 detects the position identification member 131, the position detector 130 may determine that the vane assembly 400 is disposed at the same position at which the position detection sensor 132 is disposed.

For example, the position identification member 131 may be attached onto a bottom surface of the vane holder 430. An identification member cover 435 may be disposed to protect the position identification member 131. The identification member cover 435 prevents the position identification member 131 from contacting the washing water.

The position detection sensor 132 may be disposed in the vicinity of the fixed nozzle assembly 300, as illustrated in FIG. 23.

In detail, the position detection sensor 132 may be disposed at an inner side of the tub penetration portion 630 of the bottom plate cover 600. That is, the position detection sensor 132 may be disposed at the inner side of the tub penetration portion 630 exposed to the outside of the tub 30, together with the vane driving motor 520.

The position detector 130 may further include an auxiliary position detection sensor 133.

The auxiliary position detection sensor 133 may be disposed at one of various positions other than a first position P1. For example, the auxiliary position detection sensor 133 may be disposed on the bottom plate 35 of the tub 30, as illustrated in FIGS. 24 and 25.

When the position detection sensor 132 is disposed in the vicinity of the fixed nozzle assembly 300, the auxiliary position detection sensor 133 may be disposed at an opposite side to the fixed nozzle assembly 300. In other words, when the vane assembly 400 is disposed at the farthest position from the fixed nozzle assembly 300, the auxiliary position detection sensor 133 may be disposed at a position corresponding to the position identification member 131.

In addition, the position identification member 131 and the position detection sensors 132 and 133 may be disposed at various positions.

The position identification member 131 may be disposed at one of various positions, such as at the vane carrier 420, in the center of the vane 410, and on both ends of the vane 410, in addition to at the vane holder 430.

Also, the position detection sensor 132 and the auxiliary position detection sensor 133 may be disposed at various positions based on the position of the position identification member 131. For example, the position detection sensor 132 may be disposed at the guide rail (see 511 of FIG. 14), on the bottom plate 35 of the tub 30, at the rear holder (see 512 of FIG. 14), or at the front holder (see 513 of FIG. 14).

Also, the position detection sensor 132 may be disposed to be far away from the fixed nozzle assembly 300 in addition to being in the vicinity of the fixed nozzle assembly 300. The auxiliary position detection sensor 133 may also be disposed in the vicinity of the fixed nozzle assembly 300 in addition to being far away from the fixed nozzle assembly 300.

However, for understanding, it is assumed that the position detection sensor 132 is disposed at the first position P1 and the auxiliary position detection sensor 133 is disposed at a second position P2. Here, the first position P1 is a position of the vane assembly 400 when the vane assembly 400 is closest to the fixed nozzle assembly 300. Also, the second position P2 is a position of the vane assembly 400 when the vane assembly 400 is farthest from the fixed nozzle assembly 300.

In this case, if the position detection sensor 132 detects the position identification member 131, the dishwasher 1 may determine that the vane assembly 400 is disposed at the first position P1, and if the auxiliary position detection sensor 133 detects the position identification member 131, the dishwasher 1 may determine that the vane assembly 400 is disposed at the second position P2.

Also, the position detector 130 is not limited to including the position detection sensor 132 disposed at the first position P1 and the auxiliary position detection sensor 133 disposed at the second position P2. The position detector 130 may further include a position detection sensor that is disposed at other position than the first position P1 and the second position P2.

For example, the position detector 130 may further include a position detection sensor that is installed in the vicinity of the center of the first position P1 and the second position P2. In addition, the position detector 130 may further include a plurality of position detection sensors that are disposed between the first position P1 and the second position P2 at regular intervals.

The position identification member 131 and the position detection sensor 132 may employ a permanent magnet and a hall sensor, respectively. That is, the hall sensor that detects a magnetic field may detect the position of the vane assembly 400 by detecting a magnetic field generated by the permanent magnet.

In addition, the position identification member 131 and the position detection sensor 132 may include protrusions that protrude from the vane assembly 400, a micro switch that is pressured by the protrusions, an infrared light source that emits infrared rays, and an infrared sensor that senses the infrared rays, for example.

In detail, if the protrusions formed on the vane assembly 400 pressurize the micro switch installed at the first position P1, the dishwasher 1 may determine that the vane assembly 400 is disposed at the first position P1.

Also, if the infrared sensor installed at the first position P1 senses the infrared rays emitted from the infrared light source attached to the vane assembly 400, the dishwasher 1 may determine that the vane assembly 400 is disposed at the first position P1.

Also, the position detector 130 may include only the position detection sensor 132.

For example, the position detection sensor 132 may include a capacitive type proximity sensor that senses a change of an electrostatic capacity caused by the vane assembly 400, an ultrasonic sensor module that emits ultrasonic waves and receives reflected waves reflected by the vane assembly 400, and an infrared sensor module that emits infrared rays and receives the infrared rays reflected by the vane assembly 400.

When the position detector 130 includes a capacitive type proximity sensor installed at the first position P1, if the capacitive type proximity sensor senses a change of the electrostatic capacity caused by the vane assembly 400, the dishwasher 1 may determine that the vane assembly 400 is disposed at the first position P1.

In detail, if the ultrasonic sensor module of the position detector 130 installed at the first position P1 senses the ultrasonic waves reflected by the vane assembly 400, the dishwasher 1 may determine that the vane assembly 400 is disposed at the first position P1.

Also, if the infrared sensor module of the position detector 130 installed at the first position P1 detects the infrared rays reflected by the vane assembly 400, the dishwasher 1 may determine that the vane assembly 400 is disposed at the first position P1.

The position detector 130 may include a position detection sensor that moves together with the vane assembly 400.

For example, a pressure sensor that detects pressure of the washing water sprayed by the fixed nozzle assembly 300 may be disposed at the vane assembly 400, and the dishwasher 1 may determine the position of the vane assembly 400 according to the detected pressure of the washing water.

Also, an infrared distance sensor module including an infrared emission portion that emits infrared rays and an infrared receiving portion that receives the infrared rays may be installed at the vane assembly 400, and the position of the vane assembly 400 may be calculated based on a time of flight (TOF) at which the emitted infrared rays are back to the vane assembly 400 after being reflected from the fixed nozzle assembly 300 or the door 11.

Also, an ultrasonic distance sensor module including an ultrasonic emission portion that emits ultrasonic waves and an ultrasonic receiving portion that receives the ultrasonic waves may be installed at the vane assembly 400, and the position of the vane assembly 400 may be calculated based on a TOF at which the emitted ultrasonic waves are back to the vane assembly 400 after being reflected from the fixed nozzle assembly 300 or the door 11.

However, hereinafter, for understanding, it is assumed that the position identification member 131 is disposed at the vane assembly 400 and the position detection sensors 132 and 133 are installed at the first position P1 or the second position P2.

Hereinafter, an operation of the dishwasher, in particular, an operation of the linear washing portion will be described. First, an overall operation of the dishwasher will be described below.

The dishwasher 1 may perform a water supply operation, a washing operation, a drainage operation, and a drying operation.

In the water supply operation, the washing water may be supplied into the tub 30 through a water supply pipe (not shown). The washing water supplied into the tub 30 may flow toward the sump 43 disposed below the tub 30 due to a gradient of the bottom of the tub 30 and may be stored in the sump 43.

In the washing operation, the circulation pump 41 may be actuated to pump the washing water in the sump 43. The washing water pumped by the circulation pump 41 may be distributed to the rotatable spray nozzles 61 and 63, the left fixed nozzle 330, and the right fixed nozzle 340 through the distribution valve assembly 200.

The washing water that is sprayed from the rotatable spray nozzles 61 and 63 and the fixed nozzle assembly 300 may be used to hit the dishes and to remove filth from the dishes and may drop together with filth and may be stored in the sump 43 again. The circulation pump 41 pumps the washing water stored in the sump 43 again to circulate the washing water. In the washing operation, the circulation pump 41 may be actuated or stopped repeatedly several times. In this procedure, filth that drops into the sump 43 together with the washing water remains in the sump 43 because it is gathered by a filter (not shown) mounted on the sump 43 and not circulated.

Next, a movement operation of the vane assembly 400 will be described.

For understanding, one end that is adjacent to the fixed nozzle assembly 300 among both ends of the vane guide 510 is referred to a first position, and an opposite side to the fixed nozzle assembly 300 is referred to a second position. It is assumed that the position detection sensor 132 is disposed at the first position. That is, the first position is a reference position.

Also, a direction in which the vane assembly 400 is moved from an arbitrary position of the vane guide 510 to the first position, is referred to as a first movement direction, and a direction in which the vane assembly 400 is moved from the arbitrary position of the vane guide 510 to the second position, is referred to as a second movement direction.

Figure 26:
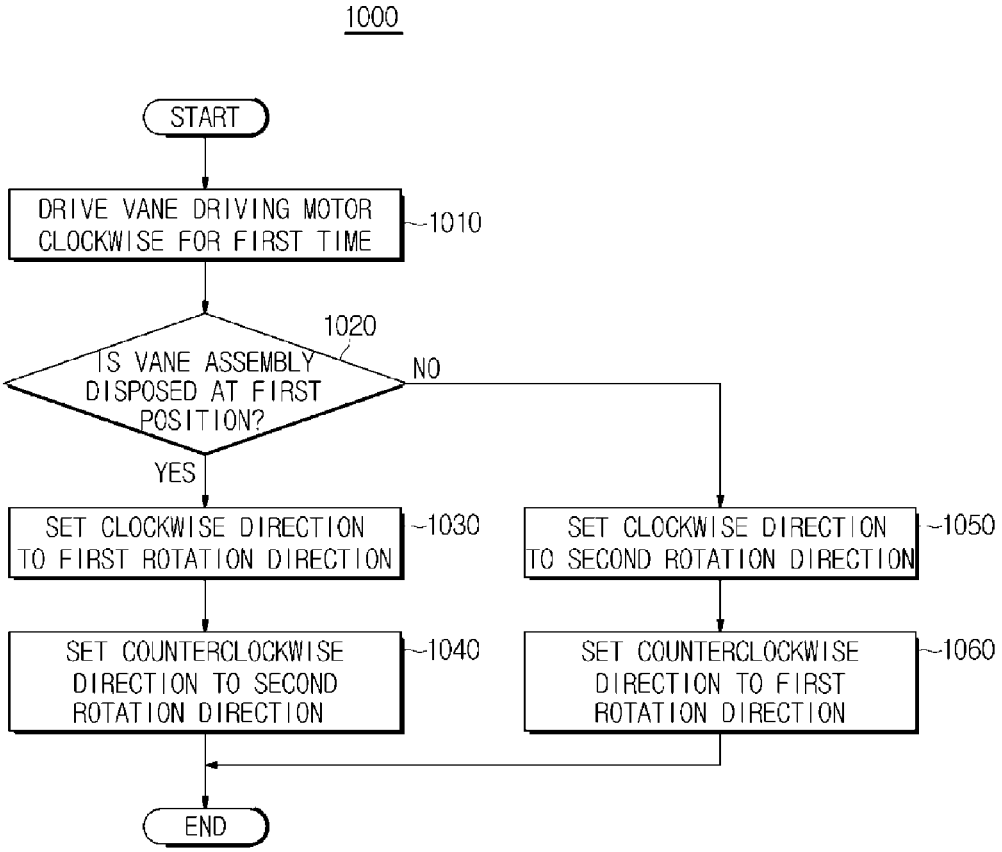
FIG. 26 is a flowchart for describing a vane movement control method based on a vane movement direction matching operation according to an embodiment of the present disclosure.

FIG. 26 is a flowchart for describing a vane movement control method based on a vane movement direction matching operation according to an embodiment of the present disclosure.

The dishwasher 1 moves the vane assembly 400 due to rotation of the vane driving motor 520. In this case, the dishwasher 1 performs a vane movement direction matching operation 1000 between a rotation direction of the vane driving motor 520 and a movement direction of the vane assembly 400.

For example, when the vane driving motor 520 is rotated clockwise, the dishwasher 1 determines whether the vane assembly 400 is moved in the first direction or the second direction, and when the vane driving motor 520 is rotated counterclockwise, the dishwasher 1 determines whether the vane assembly 400 is moved in the first direction or the second direction.

The vane movement direction matching operation 1000 will be described with reference to FIG. 26.

First, the dishwasher 1 drives the vane driving motor 520 clockwise for a first time (Operation 1010).

Here, the first time is time that is equal to or greater than a time (hereinafter, referred to as a "first reference time") at which the vane assembly 400 is moved by the vane driving motor 520 between the first position and the second position. In other words, if the vane driving motor 520 is driven for the first time, the vane assembly 400 that is disposed at an arbitrary position of the vane guide 510 is moved to the first position or the second position.

Subsequently, the dishwasher 1 determines whether the vane assembly 400 is disposed at the first position (Operation 1020). In detail, the dishwasher 1 determines whether the position detection sensor 132 disposed at the first position detects the position identification member 131 attached to the vane assembly 400.

For example, if the position detection sensor 132 detects the position identification member 131, the dishwasher 1 determines that the vane assembly 400 is disposed at the first position, and if the position detection sensor 132 does not detect the position identification member 131, the dishwasher 1 determines that the vane assembly 400 is not disposed at the first position.

If the vane assembly 1 is disposed at the first position (YES of Operation 1020), the dishwasher 1 sets a clockwise direction to a first rotation direction (Operation 1030).

The first rotation direction is a rotation direction of the vane driving motor 520 in which the vane assembly 400 is moved in the first movement direction. In other words, if the vane driving motor 520 is driven in the first rotation direction, the vane assembly 400 is moved toward the first position.

Also, the dishwasher 1 sets a counterclockwise direction to a second rotation direction (Operation 1040). The second rotation direction is a rotation direction of the vane driving motor 520 in which the vane assembly 400 is moved in the second movement direction. In other words, if the vane driving motor 520 is driven in the second rotation direction, the vane assembly 400 is moved toward the second position.

If the vane assembly 1 is not disposed at the first position (NO of Operation 1020), the dishwasher 1 sets the clockwise direction to the second rotation direction (Operation 1050).

Also, the dishwasher 1 sets the counterclockwise direction to the first rotation direction (Operation 1060).

By performing the vane movement direction matching operation 1000, the dishwasher 1 may match the rotation direction of the vane driving motor 520 with the movement direction of the vane assembly 400.

Figure 27:
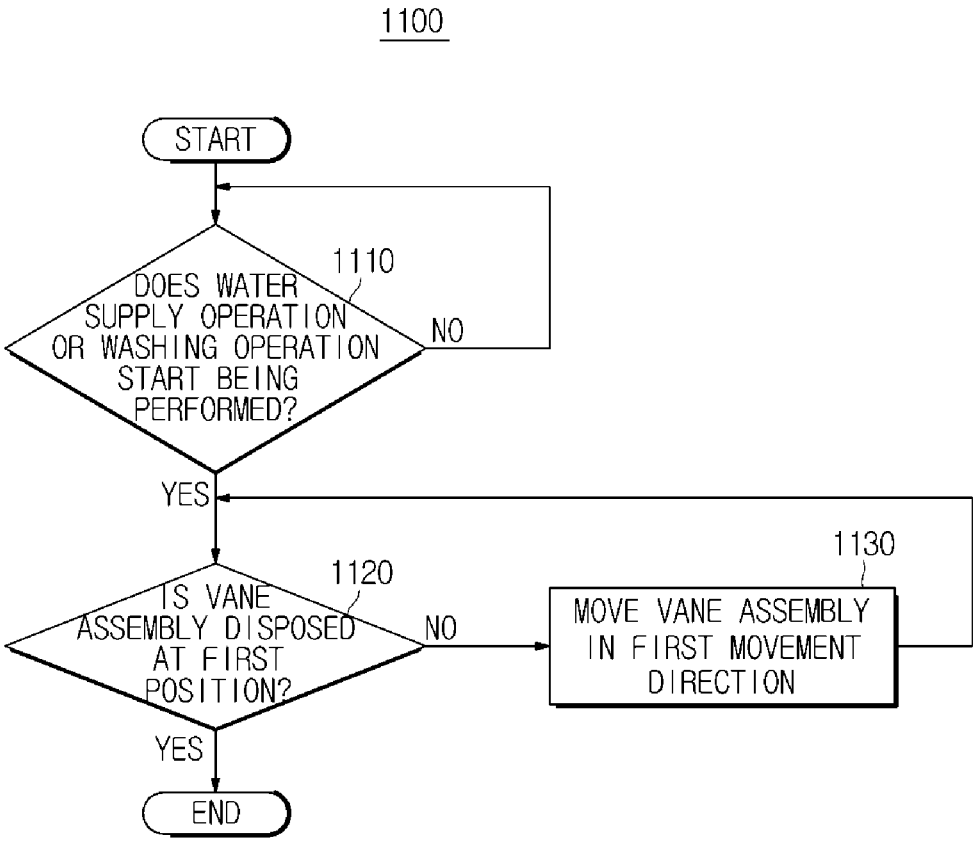
FIGS. 27 and 28 are a flowchart and a cross-sectional view for describing a vane movement control method based on a vane initialization operation according to an embodiment of the present disclosure.
Figure 28:
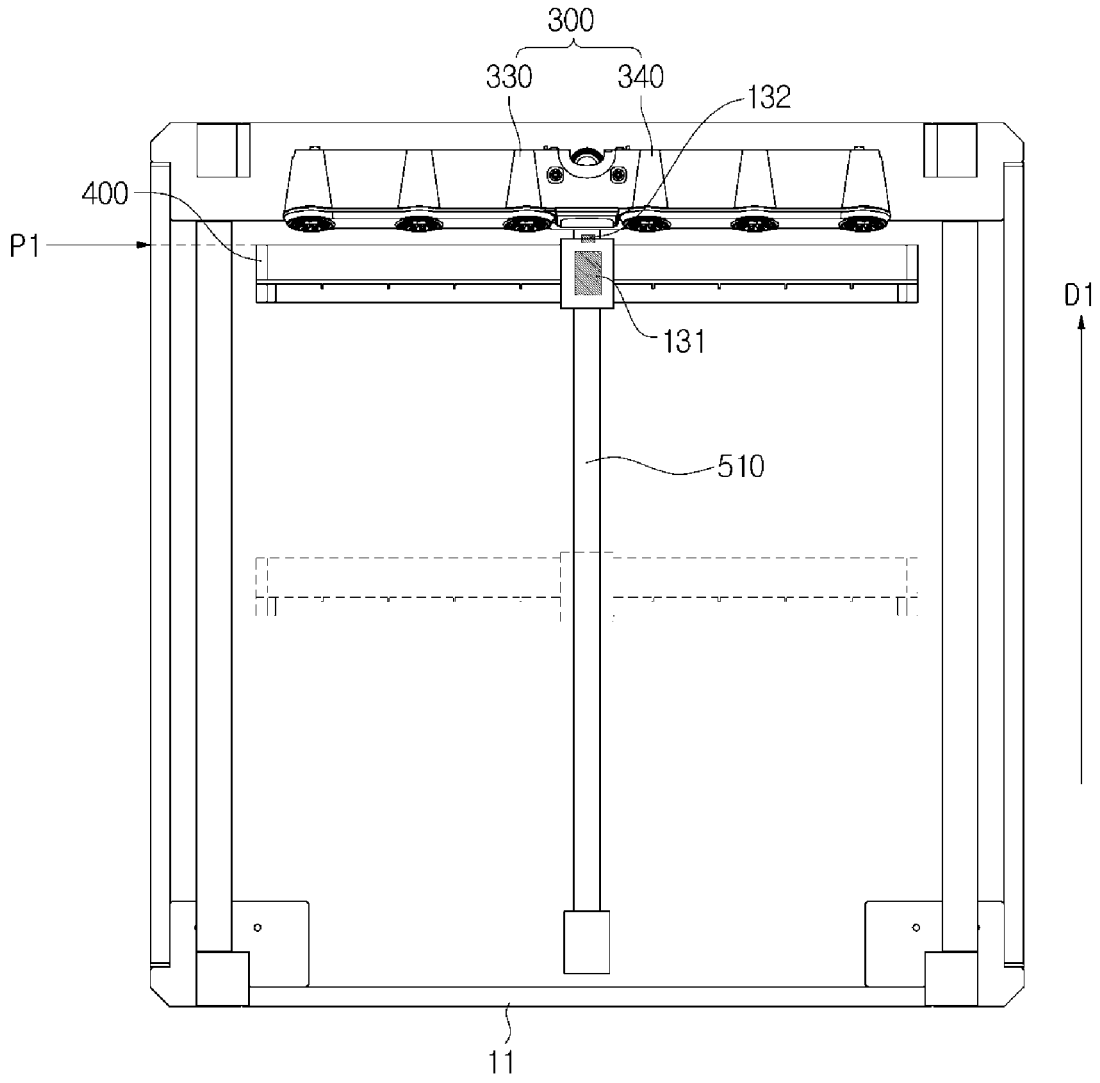

FIGS. 27 and 28 are a flowchart and a cross-sectional view for describing a vane movement control method based on a vane initialization operation according to an embodiment of the present disclosure.

A vane initialization operation 1100 in which the vane assembly 400 is moved to the first position (reference position), is performed when the water supply operation or the washing operation starts being performed.

By performing the vane initialization operation 1100, the dishwasher 1 may calculate the position of the vane assembly 400 while the vane assembly 400 is being moved.

Also, the vane assembly 400 is moved to be close to the fixed nozzle assembly 300 so that, when the fixed nozzle assembly 300 starts spraying the washing water, the washing water can be prevented from dropping toward the bottom plate 35 of the tub 30.

The vane initialization operation 1100 will be described with reference to FIGS. 27 and 28.

First, the dishwasher 1 determines whether the water supply operation or the washing operation starts being performed (Operation 1110).

If the water supply operation or the washing operation starts being performed, the dishwasher 1 determines whether the vane assembly 400 is disposed at a first position P1 (Operation 1120). In detail, the dishwasher 1 determines whether the position detection sensor 132 disposed at the first position P1 detects the position identification member 131 attached to the vane assembly 400.

As described above, the first position P1 becomes a criterion for movement of the vane assembly 400. In other words, the dishwasher 1 may check the position of the vane assembly 400 based on a distance at which the vane assembly 400 is moved from the first position P1. For this reason, the dishwasher 1 determines whether the vane assembly 400 is disposed at the first position P1, to dispose the vane assembly 400 at the first position P1.

If the vane assembly 400 is disposed at the first position P1 (YES of Operation 1120), the dishwasher 1 terminates the vane initialization operation 1100.

If the vane assembly 400 is not disposed at the first position P1 (NO of Operation 1120), the dishwasher 1 moves the vane assembly 400 in the first movement direction (Operation 1130). In detail, the dishwasher 1 drives the vane driving motor 520 in the first rotation direction.

While the vane assembly 400 is moved in the first movement direction, the dishwasher 1 determines whether the vane assembly 400 is disposed at the first position P1 using the position detector 130.

If the vane assembly 400 is disposed at the first position P1, as illustrated in FIG. 28, the dishwasher 1 stops movement of the vane assembly 400.

By performing the vane initialization operation 1100, the dishwasher 1 may dispose the vane assembly 400 at the first position P1.

In FIGS. 27 and 28, the vane initialization operation 1100 when the dishwasher 1 includes the position detector 130, has been described.

Even when the dishwasher 1 does not include the position detector 130, the dishwasher 1 may move the vane assembly 400 to the first position P1.

For example, the dishwasher 1 may dispose the vane assembly 400 at the first position P1 by driving the vane driving motor 520 in the first rotation direction for the first time.

As described above, the first time may be time that is equal to or greater than the first reference time at which the vane assembly 400 is moved between the first position P1 and a second position P2. In other words, if the vane driving motor 520 is driven in the first rotation direction for the first time, the vane assembly 400 disposed at the arbitrary position of the vane guide 510 is moved to the first position.

As an example, when the vane driving motor 520 includes an encoder, the dishwasher 1 may move the vane driving motor 520 in the first rotation direction so that the vane assembly 400 can be moved at a distance (hereinafter, referred to as a "first reference distance") between the first position P1 and the second position P2.

Figure 29:
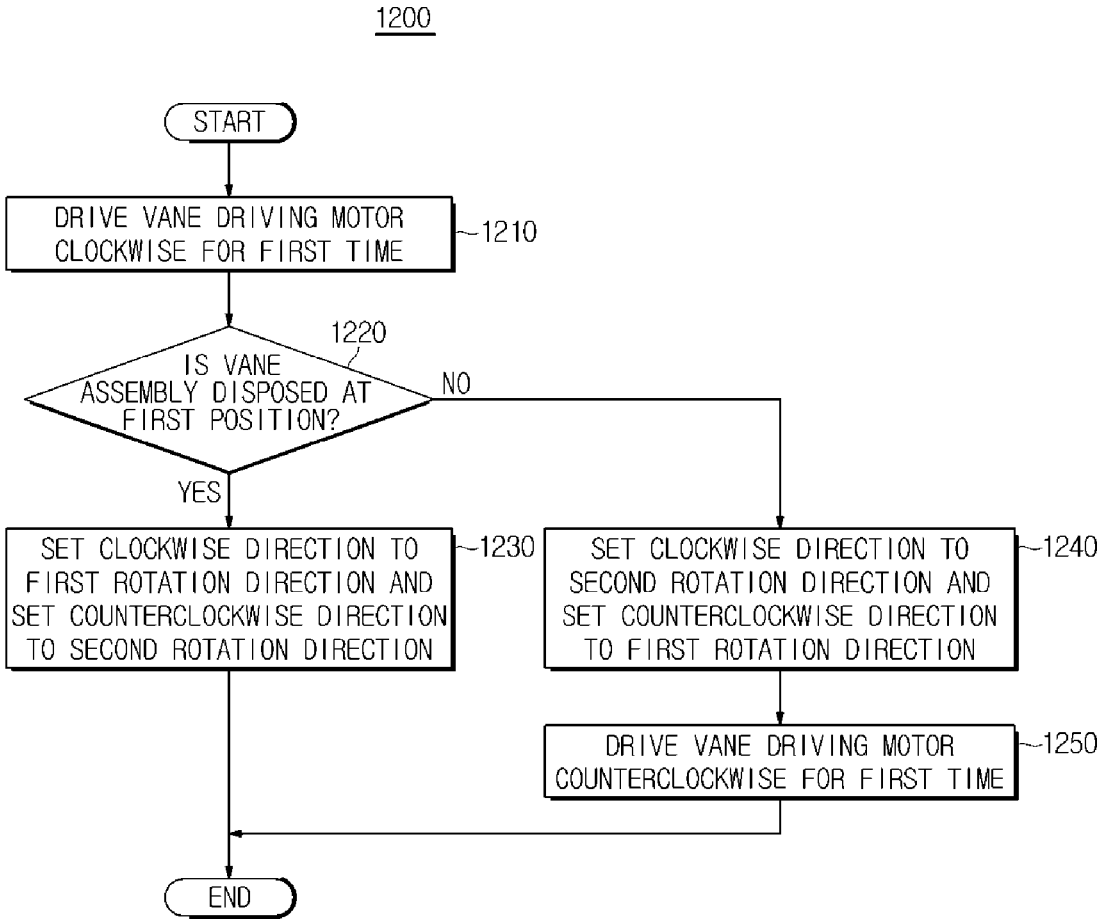
FIG. 29 is a flowchart for describing a vane movement control method based on a vane initialization operation according to an embodiment of the present disclosure.

FIG. 29 is a flowchart for describing a vane movement control method based on a vane initialization operation according to an embodiment of the present disclosure.

In FIG. 26, the vane movement direction matching operation 1000 has been described, and in FIGS. 27 and 28, the vane initialization operation 1100 has been described. In FIG. 29, a description in which the vane movement direction matching operation 1000 and the vane initialization operation 1100 are simultaneously performed, will be provided.

A vane initialization operation 1200 will be described with reference to FIG. 29.

First, the dishwasher 1 drives the vane driving motor 520 in the clockwise direction for a first time (Operation 1210). Here, the first time is a time (hereinafter, referred to as a "first reference time") that is equal to greater than time at which the vane assembly 400 is moved by the vane driving motor 520 between the first position P1 and the second position P2.

Next, the dishwasher 1 determines whether the vane assembly 400 is disposed at the first position P1 (Operation 1220). In detail, the dishwasher 1 determines whether the position detection sensor 132 disposed at the first position P1 detects the position identification member 131 attached to the vane assembly 400.

If the vane assembly 1 is disposed at the first position P1 (YES of Operation 1220), the dishwasher 1 sets the clockwise direction to a first rotation direction and sets the counterclockwise direction to a second rotation direction (Operation 1230).

If the vane assembly 1 is not disposed at the first position P1 (NO of Operation 1220), the dishwasher 1 sets the clockwise direction to the second rotation direction and sets the counterclockwise direction to the first rotation direction (Operation 1240).

Subsequently, the dishwasher 1 drives the vane driving motor 520 in the counterclockwise direction for the first time (Operation 1250).

If the vane driving motor 520 is driven in the clockwise direction for the first time, the vane assembly 400 is disposed at the first position P1 or the second position P2. In this case, if the vane assembly 400 is not disposed at the first position, the vane assembly 400 will be disposed at the second position P2 so that the dishwasher 1 drives the vane driving motor 520 in the counterclockwise direction for the first time to dispose the vane assembly 400 at the first position P1.

Figure 30:
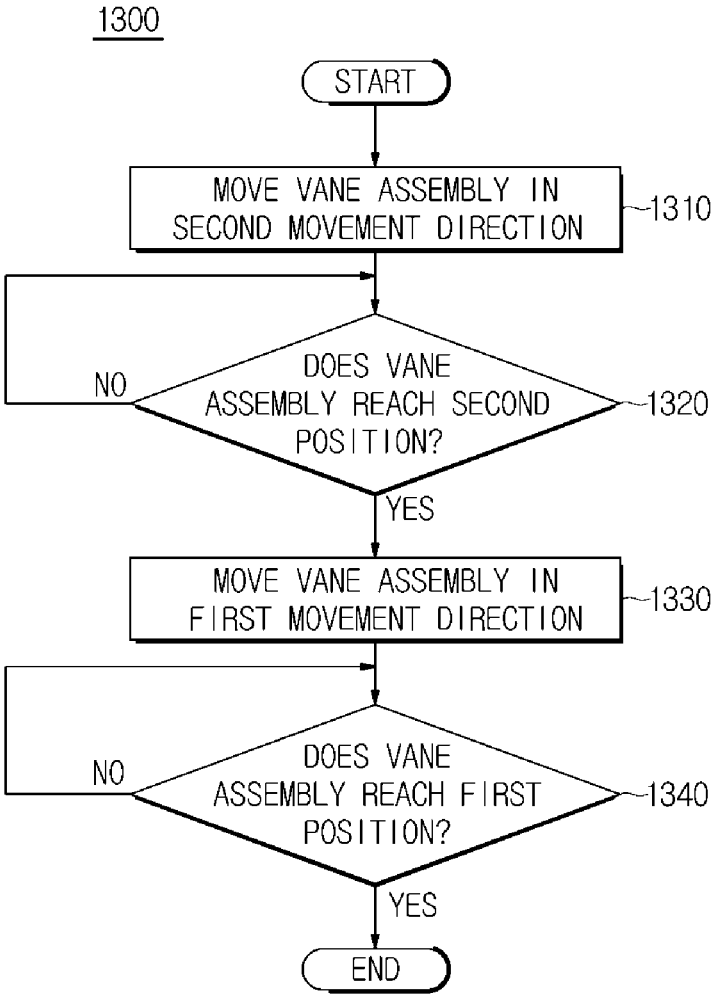
FIGS. 30 and 31 are a flowchart and a cross-sectional view for describing a vane movement control method based on a whole washing operation according to an embodiment of the present disclosure.
Figure 31:
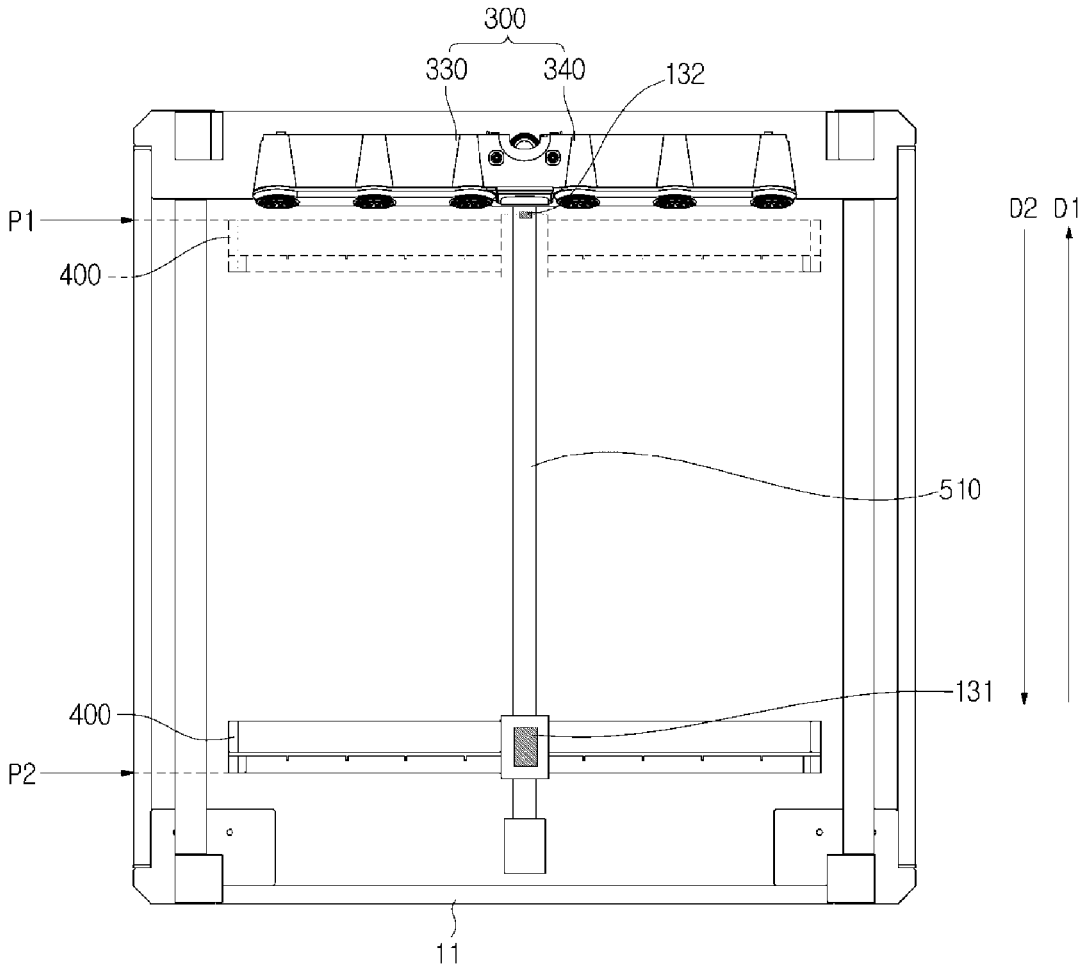

FIGS. 30 and 31 are a flowchart and a cross-sectional view for describing a vane movement control method based on a whole washing operation according to an embodiment of the present disclosure. A washing operation 1300 will be described with reference to FIGS. 30 and 31.

First, the dishwasher 1 moves the vane assembly 400 in a second movement direction D2 (Operation 1310). The second movement direction D2 is a direction in which the vane assembly 400 is directed toward the second position P2 from an arbitrary position of the vane guide 510. In detail, the dishwasher 1 may drive the vane driving motor 520 in the second rotation direction to move the vane assembly 400 in the second movement direction D2.

Subsequently, the dishwasher 1 determines whether the vane assembly 400 reaches the second position P2 (Operation 1320).

The second position P2 is one end of the vane guide 510 to which the vane assembly 400 is moved. For example, the second position P2 may be an opposite end to the fixed nozzle assembly 300 among both ends of the vane guide 510.

The dishwasher 1 may determine whether the vane assembly 400 reaches the second position P2 using various methods.

For example, the dishwasher 1 may determine whether the vane assembly 400 reaches the second position P2 based on an operating time of the vane driving motor 520.

A distance (hereinafter, referred to as a "first reference distance") between the first position P1 and the second position P2 may be divided by movement speed of the vane assembly 400 so that time (hereinafter, referred to as a "first reference time") at which the vane assembly 400 is moved at the first reference distance, can be calculated. Here, the movement speed of the vane assembly 400 is calculated based on rotation speed of the vane driving motor (see 520 of FIG. 4).

The dishwasher 1 may determine whether the vane assembly 400 reaches the second position P2, depending on whether time at which the vane driving motor 520 is driven in the second rotation direction, is equal to or greater than the first reference time.

In detail, if the time at which the vane driving motor 520 is driven in the second rotation direction, is equal to or greater than the first reference time, the dishwasher 1 determines that vane assembly 400 reaches the second position P2, and if the time at which the vane driving motor 520 is driven in the second rotation direction, is less than the first reference time, the dishwasher 1 determines that the vane assembly 400 does not reach the second position P2.

As an example, the dishwasher 1 may determine whether the vane assembly 400 reaches the second position P2 based on rotation displacement of the vane driving motor 520.

When the vane driving motor (see 520 of FIG. 4) includes an encoder that detects rotation displacement, the dishwasher 1 may calculate a movement distance of the vane assembly 400 caused by an operation of the vane driving motor 520. In detail, the movement distance of the vane assembly 400 may be calculated based on a product that is obtained by multiplying the rotation displacement of the vane driving motor 520 detected by the encoder by a radius of the driving pulley 530.

The dishwasher 1 may determine whether the vane assembly 400 reaches the second position P2, depending on whether the product that is obtained by multiplying the rotation displacement of the vane driving motor 520 rotating in the second rotation direction by the radius of the driving pulley 530 is equal to or greater than the first reference distance.

In detail, if the product that is obtained by multiplying the rotation displacement of the vane driving motor 520 rotating in the second rotation direction by the radius of the driving pulley 530 is equal to or greater than the first reference distance, the dishwasher 1 determines that the vane assembly 400 reaches the second position P2. Also, if the product that is obtained by multiplying the rotation displacement of the vane driving motor 520 rotating in the second rotation direction by the radius of the driving pulley 530 is less than the first reference distance, the dishwasher 1 determines that the vane assembly 400 does not reach the second position P2.

As an example, when the position detector 130 includes an auxiliary position detection sensor that is disposed at the second position P2, the dishwasher 1 may determine whether the vane assembly 400 reaches the second position P2, depending on whether the auxiliary position detection sensor detects the position identification member 131 disposed at the vane assembly 400.

In detail, if the auxiliary position detection sensor disposed at the second position P2 detects the position identification member 131 attached to the vane assembly 400, the dishwasher 1 may determine that the vane assembly 400 reaches the second position P2.

If the vane assembly 400 reaches the second position P2 (YES of Operation 1320), the dishwasher 1 moves the vane assembly 400 in a first movement direction D1 (Operation 1330). In detail, the dishwasher 1 may drive the vane driving motor 520 in a first rotation direction (rotation direction in which the vane assembly 400 is moved in the first movement direction D1) to move the vane assembly 400 in the first movement direction D1.

Subsequently, the dishwasher 1 determines whether the vane assembly 400 reaches the first position P1 (Operation 1340).

The dishwasher 1 may determine whether the vane assembly 400 reaches the first position P1 using various methods.

For example, the dishwasher 1 may determine whether the vane assembly 400 reaches the first position P1, depending on whether time at which the vane driving motor 520 is rotated in the first rotation direction, is equal to or greater than the first reference time.

As an example, when the vane driving motor 520 includes an encoder, the dishwasher 1 may determine whether the vane assembly 400 reaches the first position P1, depending on whether a product that is obtained by multiplying rotation displacement in which the vane driving motor 520 is rotated in the first rotation direction, by a radius of the driving pulley 530 is equal to or greater than the first reference distance.

As an example, when the dishwasher 1 includes the position detector 130, the dishwasher 1 may determine whether the vane assembly 400 reaches the first position P1, depending on whether the position detection sensor 132 disposed at the first position P1 detects the position identification member 131 attached to the vane assembly 400.

If the vane assembly 400 reaches the first position P1 (YES of Operation 1340), the dishwasher 1 terminates a reciprocal motion of the vane assembly 400.

The dishwasher 1 may cause the vane assembly 400 to make a reciprocal motion between the first position P1 and the second position P2 by repeatedly performing the vane movement operation 1300.

In this way, the dishwasher 1 may wash the dishes in the tub 30 by causing the vane assembly 400 to make a reciprocal motion between the foremost position and the rearmost position of the vane guide 510, as illustrated in FIG. 31.

Figure 32:
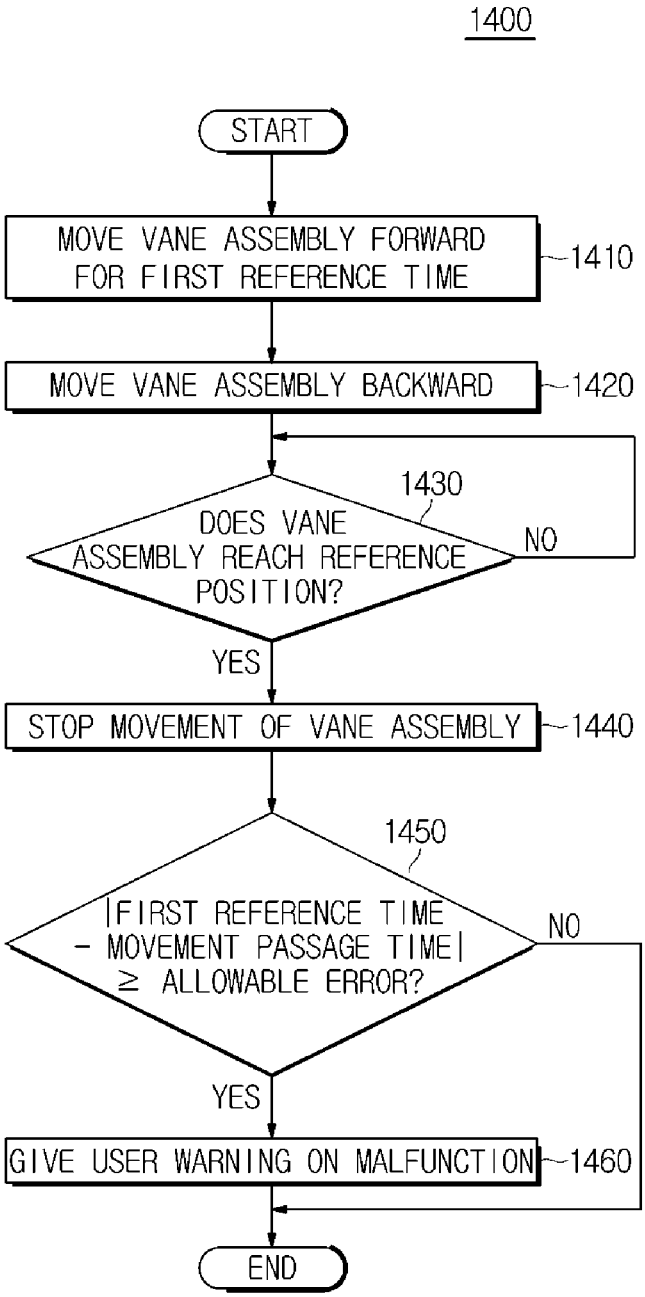
FIG. 32 is a flowchart for describing a vane movement control method based on a whole washing operation according to an embodiment of the present disclosure.

FIG. 32 is a flowchart for describing a vane movement control method based on a whole washing operation according to an embodiment of the present disclosure.

A washing operation 1400 will be described with reference to FIG. 32.

First, the dishwasher 1 moves the vane assembly 400 to the front for a predetermined first reference time (Operation 1410).

For example, when a first position is the rearmost position of the vane guide 510, the dishwasher 1 moves the vane assembly 400 to the front for the first reference time so that the vane assembly 400 reaches the foremost position of the vane guide 510.

In detail, the dishwasher 1 may move the vane assembly 400 to a second position by actuating the vane driving motor 520 in a second rotation direction in which the vane assembly 400 is moved to the second position P2, for the first reference time.

Here, the first reference time may be defined as time at which the vane assembly 400 is moved from one end to the other end of the vane guide 510. That is, by dividing the length of the vane guide 510 by movement speed of the vane assembly 400, the first reference time may be calculated, and the calculated first reference time may be stored in the above-described storage unit 150 and may be defined.

The dishwasher 1 drives the vane driving motor 520 in the second rotation direction for the first reference time, to move the vane assembly 400 to the second position P2. However, the dishwasher 1 is not limited thereto.

For example, an encoder that senses rotation displacement may be disposed at the vane driving motor 520, and the vane driving motor 520 may be driven using the encoder so that the vane assembly 400 can be moved at a distance between the first position P1 and the second position P2.

If the first reference time elapses, the dishwasher 1 moves the vane assembly 400 backward (Operation 1420).

For example, when the first position P1 is at the rearmost position of the vane guide 510, the dishwasher 1 moves the vane assembly 400 backward so that the vane assembly 400 can be restored to the first position P1.

In detail, the dishwasher 1 may move the vane assembly 400 to the first position P1 by actuating the vane driving motor 520 in a first rotation direction in which the vane assembly 400 is moved to the first position P1, i.e., in an opposite direction to that of Operation 1410.

Subsequently, the dishwasher 1 determines whether the vane assembly 400 reaches the first position P1 (Operation 1430). For example, when the first position is the rearmost position of the vane guide 510, the dishwasher 1 determines whether the vane assembly 400 reaches the rearmost position of the vane guide 510.

In detail, the dishwasher 1 may determine whether the position detection sensor 132 detects a magnetic field of the position identification member 131.

If the vane assembly 400 does not reach the first position P1 (NO of Operation 1430), the vane assembly 400 is continuously moved until the vane assembly 400 reaches the first position P1.

If the vane assembly 400 reaches the first position (YES of Operation 1430), the dishwasher 1 stops movement of the vane assembly 400 (Operation 1440). In detail, the dishwasher 1 may stop actuation of the vane driving motor 520.

Subsequently, the dishwasher 1 determines whether a difference between the first reference time and a movement passage time is equal to or greater than an allowable error (Operation 1450). Here, the movement passage time is time at which the vane assembly 400 is moved from the second position P2 to the first position P1.

If the difference between the first reference time and the movement passage time is equal to or greater than the allowable error (YES of Operation 1450), the dishwasher 1 gives a user a warning on malfunction of the dishwasher 1 (Operation 1460).

The difference between the first reference time and the movement passage time that is equal to or greater than the allowable error, means that a longer or shorter time than the first reference time is required when the vane assembly 400 is moved to the first position.

Also, this means that movement of the vane assembly 400 is disturbed while the vane assembly 400 is moved along the vane guide 510. Thus, the dishwasher 1 informs the user that there is a problem in the operation of the linear washing portion 100 using the control panel 90.

While the vane assembly 400 makes a reciprocal motion in a forward/backward direction, the dishwasher 1 determines whether there is a problem in the operation of the vane assembly 400, by moving the vane assembly 400 to the first position P1.

Next, separation washing using the dishwasher 1 will be described. Separation washing is a washing operation in which only the dishes accommodated by the user in a particular portion of the inside of the tub 30 are washed.

For example, the tub 30 may be divided into right and left portions, and only the dishes accommodated in the left portion of the inside of the tub 30 may be washed, or only the dishes accommodated in the right portion of the inside of the tub 30 may be washed. In addition, the tub 30 may be divided into front and rear portions, and only the dishes accommodated in the front portion of the inside of the tub 30 may be washed, or only the dishes accommodated in the rear portion of the inside of the tub 30 may be washed.

In detail, when the user inputs left washing instructions through the left washing button 94*a*, the dishwasher 1 may control the distribution valve assembly 200 to spray the washing water only toward the left spray nozzle 330 of the fixed nozzle assembly 300.

Also, when the user inputs right washing instructions through the right washing button 94*b*, the dishwasher 1 controls the distribution valve assembly 200 to spray the washing water only toward the right spray nozzle 340 of the fixed nozzle assembly 300.

Also, when the user inputs front washing instructions through the front washing button 94*c*, the dishwasher 1 controls the vane driving assembly 500 so that the vane assembly 400 makes a reciprocal motion at the front portion of the inside of the tub 30.

For example, when the first position is the rearmost position of the vane guide 510, the dishwasher 1 moves the vane assembly 400 toward the foremost position of the vane guide 510 for the above-described first reference time (time at which the vane assembly 400 is moved from one end to the other end of the vane guide 510).

As a result, the vane assembly 400 is disposed at the foremost position of the vane guide 510. Subsequently, the dishwasher 1 causes the vane assembly 400 to make a reciprocal motion at the front portion of the inside of the tub 30 by repeatedly moving the vane assembly 400 backward for a second reference time that is shorter than the first reference time and moving the vane assembly 400 forward for the second reference time again.

Also, when the user inputs rear washing instructions through the rear washing button 94*d*, the dishwasher 1 controls the vane driving assembly 500 so that the vane assembly 400 makes a reciprocal motion at the rear portion of the inside of the tub 30.

For example, when the first position is the rearmost position of the vane guide 510, the dishwasher 1 causes the vane assembly 400 to make a reciprocal motion at the rear portion of the inside of the tub 30 by repeatedly moving the vane assembly 400 forward for the second reference time that is shorter than the first reference time and moving the vane assembly 400 backward for the second reference time again.

Left separation washing, right separation washing, front separation washing, and rear separation washing will now be described in greater detail.

For understanding, it is assumed that the position detection sensor 132 is disposed at the rearmost position of the vane guide 510. That is, the first position P1 is the rearmost position of the vane guide 510.

However, embodiments of the present disclosure are not limited thereto. For example, when the first position is an arbitrary position of the vane guide 510, the following operation may be performed after the vane assembly 400 is moved to the rearmost position of the vane guide 510, and when the first position is the foremost position of the vane guide 510, the following operation may be performed by changing only front and rear portions.

Figure 33:
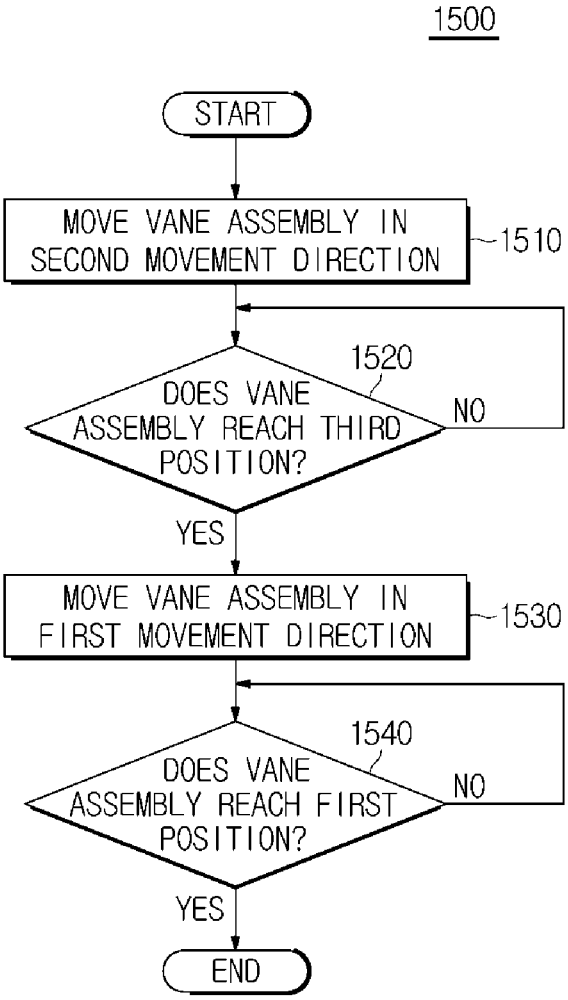
FIGS. 33 and 34 are a flowchart and a cross-sectional view for describing a vane movement control method based on a rear washing operation according to an embodiment of the present disclosure.
Figure 34:
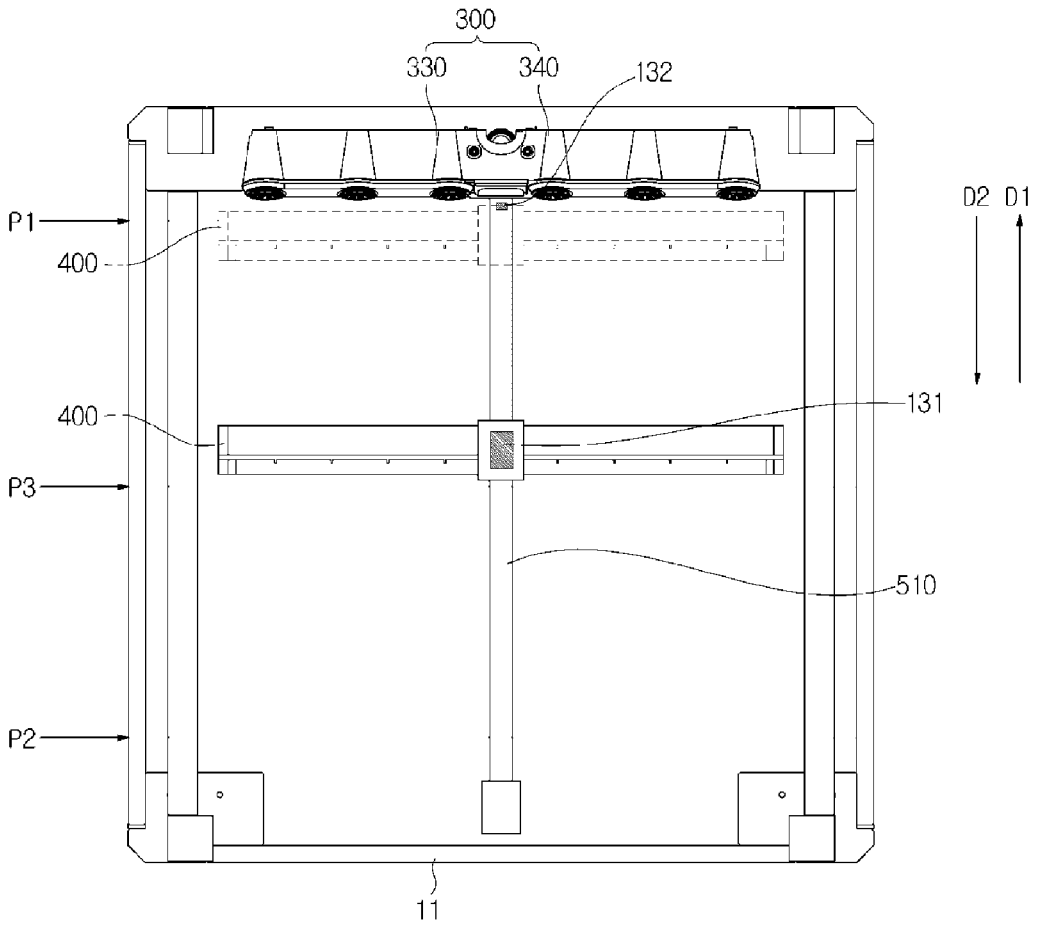

FIGS. 33 and 34 are a flowchart and a cross-sectional view for describing a vane movement control method based on a rear washing operation according to an embodiment of the present disclosure.

If the user inputs rear washing instructions by pressing the rear washing button 94*d* disposed on the control panel 90, the dishwasher 1 may perform the rear washing operation 1500.

Referring to FIGS. 33 and 34, the dishwasher 1 moves the vane assembly 400 in the second movement direction D2 (Operation 1510). In detail, the dishwasher 1 may drive the vane driving motor 520 in the second rotation direction.

Subsequently, the dishwasher 1 determines whether the vane assembly 400 reaches a third position P3 (Operation 1520). Here, the third position P3 may be an arbitrary position of the vane guide 510.

The dishwasher 1 may determine whether the vane assembly 400 reaches the third position P3, using various methods.

For example, the dishwasher 1 may determine whether the vane assembly 400 reaches the third position P3, depending on whether time at which the vane driving motor 520 is driven in the second rotation direction, is the second reference time.

Here, the second reference time may be half of the first reference time. However, the second reference time is not limited thereto and may be larger or smaller than half of the first reference time.

As an example, the dishwasher 1 may determine whether the vane assembly 400 reaches the third position P3 depending on whether a product that is obtained by multiplying rotation displacement in which the vane driving motor 520 is rotated in the second rotation direction, by a radius of the driving pulley 530 is equal to or greater than a second reference distance.

As an example, when the position detector 130 includes an auxiliary position detection sensor that is disposed at the third position P3, the dishwasher 1 may determine whether the vane assembly 400 reaches the third position P3, depending on whether the auxiliary position detection sensor detects the position identification member 131 disposed at the vane assembly 400.

Here, the second reference distance may be half of the first reference distance. However, the second reference distance is not limited thereto and may be larger or smaller than half of the first reference distance.

If the vane assembly 400 reaches the third position P3 (YES of Operation 1520), the dishwasher 1 moves the vane assembly 400 in the first movement direction D1 (Operation 1530). In detail, the dishwasher 1 may drive the vane driving motor 520 in the first rotation direction.

Subsequently, the dishwasher 1 determines whether the vane assembly 400 reaches the first position P1 (Operation 1540).

The dishwasher 1 may determine whether the vane assembly 400 reaches the first position P1, using various methods.

For example, the dishwasher 1 may determine whether the vane assembly 400 reaches the first position P1, depending on whether time at which the vane driving motor 520 is rotated in the first rotation direction, is equal to or greater than the second reference time.

As an example, when the vane driving motor 520 includes an encoder, the dishwasher 1 may determine whether the vane assembly 400 reaches the first position P1, depending on whether a product that is obtained by multiplying rotation displacement in which the vane driving motor 520 is rotated in the first rotation direction, by a radius of the driving pulley 530 is equal to or greater than the second reference distance.

As an example, when the dishwasher 1 includes the position detector 130, the dishwasher 1 may determine whether the vane assembly 400 reaches the first position P1, depending on whether the position detection sensor 132 disposed at the first position P1 detects the position identification member 131 attached to the vane assembly 400.

In this way, the dishwasher 1 may wash the dishes accommodated in the rear portion of the tub 30 by causing the vane assembly 400 to make a reciprocal motion at the rear portion of the vane guide 510, as illustrated in FIG. 34.

Figure 35:
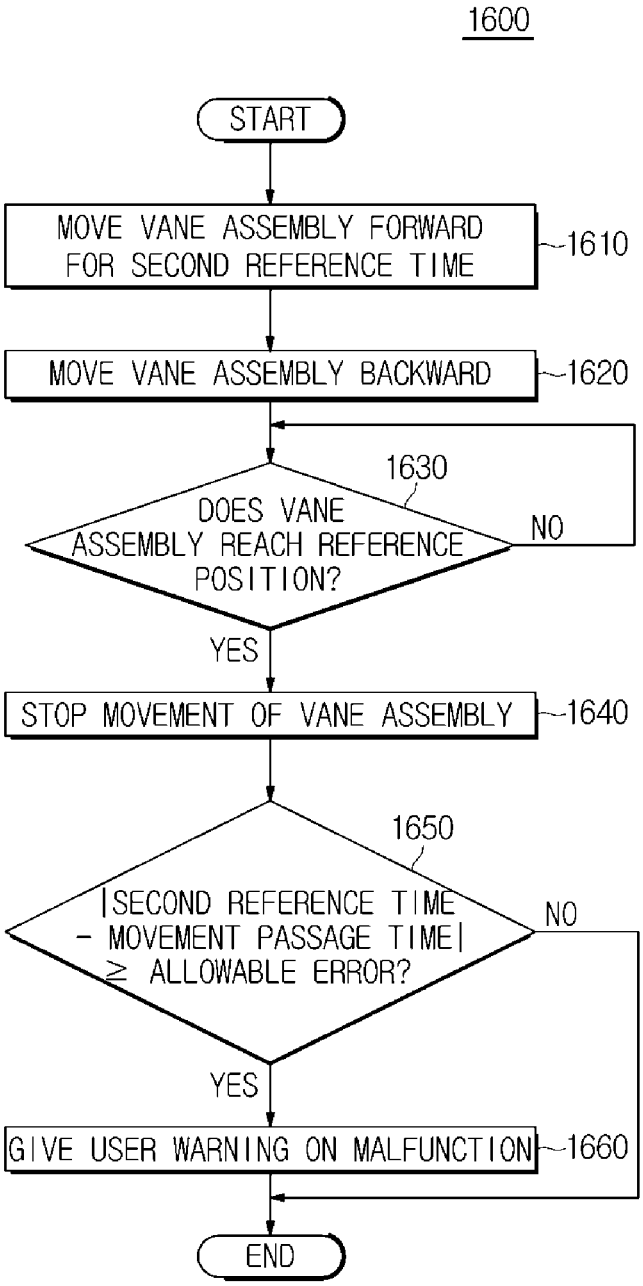
FIG. 35 is a flowchart for describing a vane movement control method based on a rear washing operation according to an embodiment of the present disclosure.

FIG. 35 is a flowchart for describing a vane movement control method based on a rear washing operation according to an embodiment of the present disclosure.

A rear washing operation 1600 will be described with reference to FIG. 35.

First, the dishwasher 1 moves the vane assembly 400 forward for a predetermined second reference time (Operation 1610). In detail, the dishwasher 1 may actuate the vane driving motor 520 in the first rotation direction in which the vane assembly 400 is moved forward, for the second reference time.

Here, the second reference time may be shorter than the above-described first reference time. For example, the second reference time may be half of the first reference time. In this case, if the vane assembly 400 is moved forward for the second reference time, the vane assembly 400 may be disposed in the center of the vane guide 510.

However, the second reference time is not limited to half of the first reference time and may also be larger or smaller than half of the first reference time.

Subsequently, the dishwasher 1 moves the vane assembly 400 backward so that the vane assembly 400 reaches the rearmost position of the vane guide 510, i.e., the first position P1 (Operation 1620). In detail, the dishwasher 1 may actuate the vane driving motor 520 in the second rotation direction in which the vane assembly 400 is moved backward, i.e., in an opposite direction to that of Operation 1610.

Subsequently, the dishwasher 1 determines whether the vane assembly 400 reaches the first position P1 (Operation 1630). In detail, the dishwasher 1 determines whether the position detection sensor 132 detects a magnetic field of the position identification member 131.

If the vane assembly 400 does not reach the first position P1 (NO of Operation 1630), the vane assembly 400 is continuously moved until the vane assembly 400 reaches the first position P1.

If the vane assembly 400 reaches the first position P1 (YES of Operation 1630), the dishwasher 1 stops movement of the vane assembly 400 (Operation 1640). In detail, the dishwasher 1 may stop actuation of the vane driving motor 520.

Subsequently, the dishwasher 1 determines whether a difference between the second reference time and the movement passage time is equal to or greater than an allowable error (Operation 1650). Here, the movement passage time is time at which the vane assembly 400 is moved to the first position.

If the difference between the second reference time and the movement passage time is equal to or greater than the allowable error (YES of Operation 1650), the dishwasher 1 gives the user a warning on malfunction of the dishwasher 1 (Operation 1660).

The difference between the second reference time and the movement passage time that is equal to or greater than the allowable error, means that time that is longer than or shorter than the second reference time is required when the vane assembly 400 is moved to the first position.

Also, this means that movement of the vane assembly 400 is disturbed while the vane assembly 400 is moved along the vane guide 510. Thus, the dishwasher 1 informs the user that there is a problem in the operation of the linear washing portion 100 using the control panel 90.

The dishwasher 1 determines whether there is a problem in the operation of the vane assembly 400 by moving the vane assembly 400 to the first position P1 while the vane assembly 400 makes a reciprocal motion at the rear portion of the tub 30.

Figure 36:
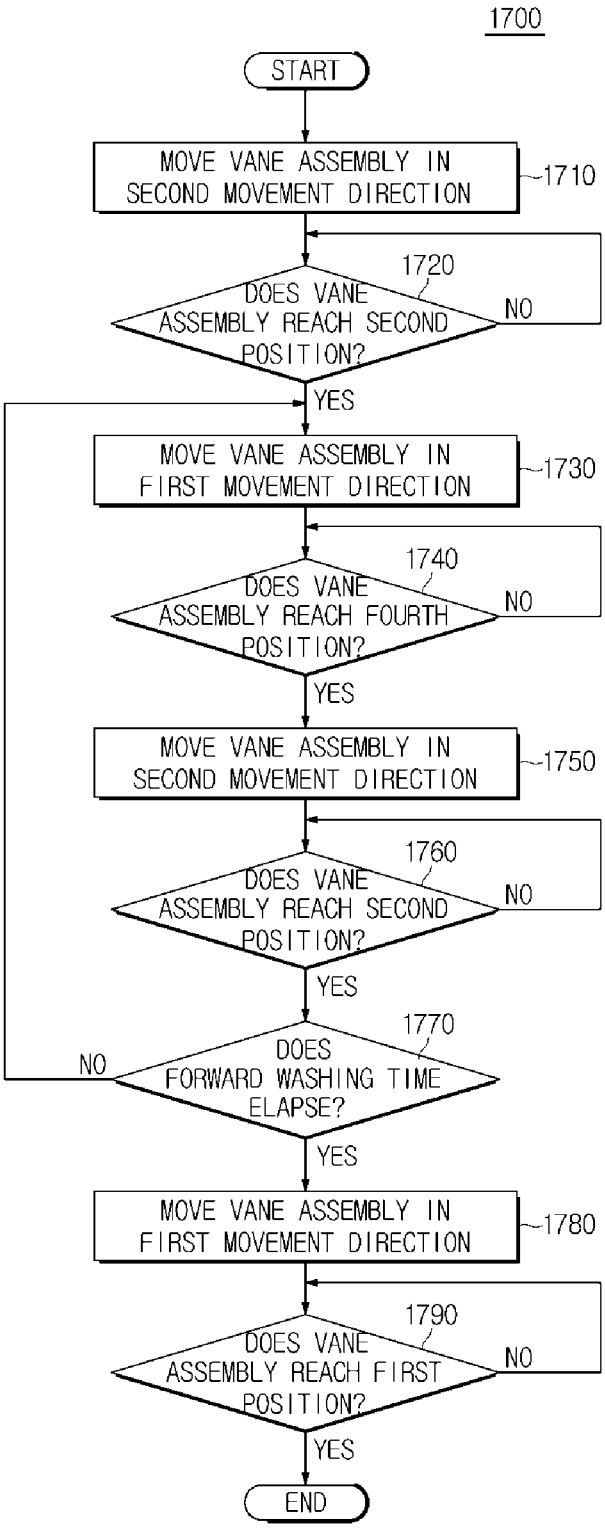
FIGS. 36 and 37 are a flowchart and a cross-sectional view for describing a vane movement control method based on a front washing operation according to an embodiment of the present disclosure.
Figure 37:
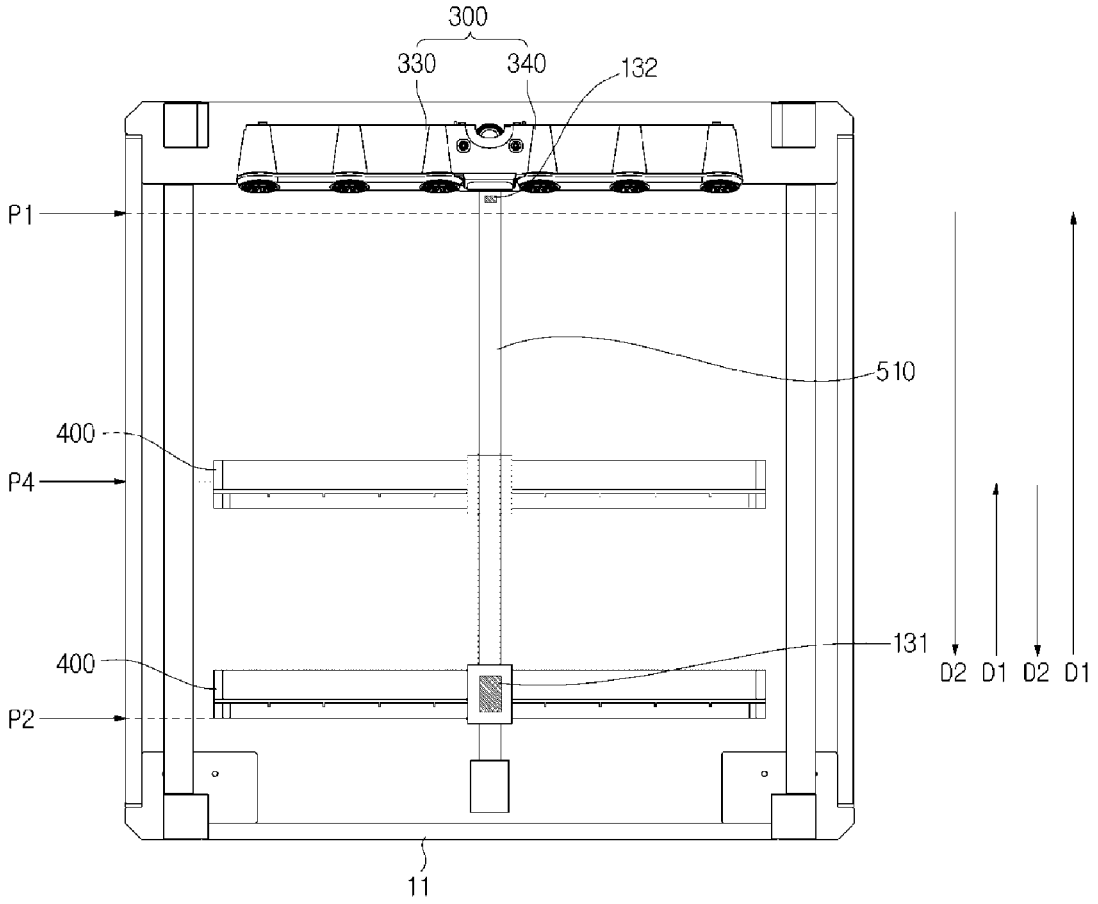

FIGS. 36 and 37 are a flowchart and a cross-sectional view for describing a vane movement control method based on a front washing operation according to an embodiment of the present disclosure.

If the user inputs front washing instructions by pressing the front washing button 94*c* disposed on the control panel 90, the dishwasher 1 may perform a front washing operation 1700.

Referring to FIGS. 36 and 37, the dishwasher 1 moves the vane assembly 400 in the second movement direction D2 (Operation 1710). In detail, the dishwasher 1 may drive the vane driving motor 520 in the second rotation direction.

Subsequently, the dishwasher 1 determines whether the vane assembly 400 reaches the second position P2 (Operation 1720).

The dishwasher 1 may determine whether the vane assembly 400 reaches the second position P2 using various methods.

For example, the dishwasher 1 may determine whether the vane assembly 400 reaches the second position P2, depending on whether a time at which the vane driving motor 520 is driven in the second rotation direction, is the first reference time.

As an example, the dishwasher 1 may determine whether the vane assembly 400 reaches the second position P2, depending on whether a product that is obtained by multiplying rotation displacement in which the vane driving motor 520 is rotated in the second rotation direction, by a radius of the driving pulley 530 is equal to or greater than the first reference distance.

As an example, when the position detector 130 includes an auxiliary position detection sensor disposed at the second position P2, the dishwasher 1 may determine whether the vane assembly 400 reaches the second position P2, depending on whether the auxiliary position detection sensor detects the position identification member 131 disposed at the vane assembly 400.

If the vane assembly 400 reaches the second position P2 (YES of Operation 1720), the dishwasher 1 moves the vane assembly 400 in the first movement direction D1 (Operation 1730). In detail, the dishwasher 1 may drive the vane driving motor 520 in the first rotation direction.

Subsequently, the dishwasher 1 determines whether the vane assembly 400 reaches a fourth position P4 (Operation 1740).

The dishwasher 1 may determine whether the vane assembly 400 reaches the fourth position P4, using various methods.

For example, the dishwasher 1 may determine whether the vane assembly 400 reaches the fourth position P4, depending on whether time at which the vane driving motor 520 is rotated in the first rotation direction, is equal to or greater than a third reference time.

Here, the third reference time may be half of the first reference time. However, the third reference time is not limited thereto and may be longer or shorter than half of the first reference time.

As an example, when the vane driving motor 520 includes an encoder, the dishwasher 1 may determine whether the vane assembly 400 reaches the fourth position P4, depending on whether a product that is obtained by multiplying rotation displacement in which the vane driving motor 520 is rotated in the first rotation direction, by a radius of the driving pulley 530 is equal to or greater than a third reference distance.

Here, the third reference distance may be half of the first reference distance. However, the third reference distance is not limited thereto and may be longer or shorter than half of the first reference distance.

As an example, when the position detector 130 includes an auxiliary position detection sensor disposed at the fourth position P4, the dishwasher 1 may determine whether the vane assembly 400 reaches the fourth position P4, depending on whether the auxiliary position detection sensor detects the position identification member 131 disposed at the vane assembly 400.

If the vane assembly 400 reaches the fourth position P4 (YES of Operation 1740), the dishwasher 1 moves the vane assembly 400 in the second movement direction D2 (Operation 1750). In detail, the dishwasher 1 may drive the vane driving motor 520 in the second rotation direction.

Subsequently, the dishwasher 1 determines whether the vane assembly 400 reaches the second position P2 (Operation 1760).

The dishwasher 1 may determine whether the vane assembly 400 reaches the second position P2, using various methods.

For example, the dishwasher 1 may determine whether the vane assembly 400 reaches the second position P2, depending on whether time at which the vane driving motor 520 is driven in the second rotation direction, is the third reference time.

As an example, the dishwasher 1 may determine whether the vane assembly 400 reaches the second position P2, depending on whether a product that is obtained by multiplying rotation displacement in which the vane driving motor 520 is rotated in the second rotation direction, by a radius of the driving pulley 530 is equal to or greater than the third reference distance.

As an example, when the position detector 130 includes an auxiliary position detection sensor disposed at the second position P2, the dishwasher 1 may determine whether the vane assembly 400 reaches the second position P2, depending on whether the auxiliary position detection sensor detects the position identification member 131 disposed at the vane assembly 400.

If the vane assembly 400 reaches the second position P2 (YES of Operation 1760), the dishwasher 1 determines whether a front washing time elapses (Operation 1770). Here, the front washing time may be time that is set by the user or that is previously stored, so that the dishes accommodated in the front of the tub 30 can be washed.

If the front washing time does not elapse (NO of Operation 1770), the dishwasher 1 causes the vane assembly 400 to make a reciprocal motion between the second position P2 and the fourth position P4.

If the front washing time elapses (YES of Operation 1770), the dishwasher 1 moves the vane assembly 400 in the first movement direction D1 (Operation 1780). In detail, the dishwasher 1 may drive the vane driving motor 520 in the first rotation direction.

Subsequently, the dishwasher 1 determines whether the vane assembly 400 reaches the first position P1 (Operation 1790).

The dishwasher 1 may determine whether the vane assembly 400 reaches the first position P1, using various methods.

For example, the dishwasher 1 may determine whether the vane assembly 400 reaches the first position P1, depending on whether time at which the vane driving motor 520 is rotated in the first rotation direction, is equal to or greater than the first reference time.

As an example, when the vane driving motor 520 includes an encoder, the dishwasher 1 may determine whether the vane assembly 400 reaches the first position P1, depending on whether a product that is obtained by multiplying rotation displacement in which the vane driving motor 520 is rotated in the first rotation direction, by a radius of the driving pulley 530 is equal to or greater than the first reference distance.

As an example, when the dishwasher 1 includes the position detector 130, the dishwasher 1 may determine whether the vane assembly 400 reaches the first position P1, depending on whether the position detection sensor 132 disposed at the first position P1 detects the position identification member 131 attached to the vane assembly 400.

In this way, the dishwasher 1 may wash the dishes accommodated in the front of the tub 30 after moving the vane assembly 400 to the foremost position of the vane guide 510 and then causing the vane assembly 400 to make a reciprocal motion in the forward direction, as illustrated in FIG. 37.

Figure 38:
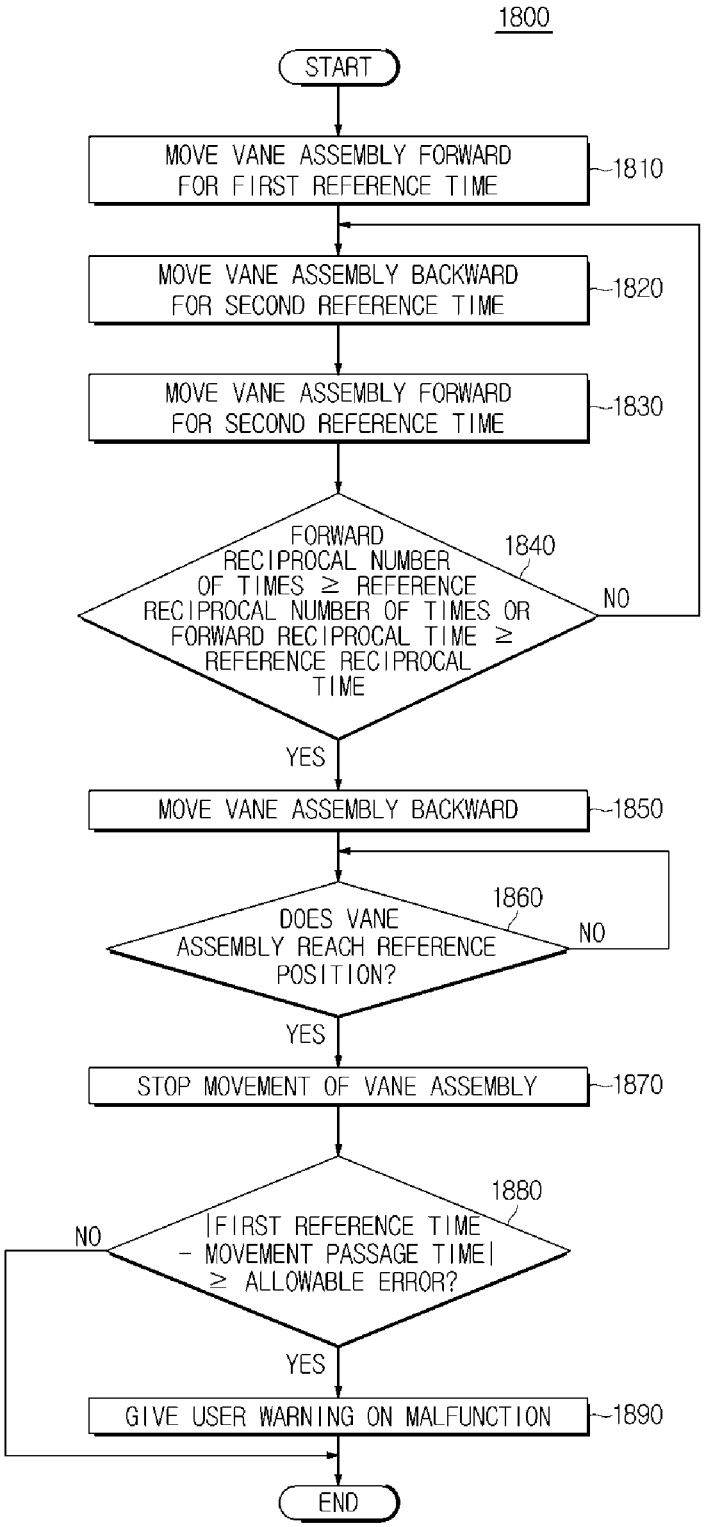
FIG. 38 is a flowchart for describing a vane movement control method based on a front washing operation according to an embodiment of the present disclosure.

FIG. 38 is a flowchart for describing a vane movement control method based on a front washing operation according to an embodiment of the present disclosure.

A front washing operation 1800 will be described with reference to FIG. 38.

First, the dishwasher 1 moves the vane assembly 400 forward for a predetermined first reference time so that the vane assembly 400 reaches the foremost position of the vane guide 510 (Operation 1810). Here, the first reference time may be defined as time at which the vane assembly 400 is moved from the rearmost position to the foremost position of the vane guide 510.

Subsequently, the dishwasher 1 moves the vane assembly 400 backward for a predetermined second reference time so that the vane assembly 400 reaches the center of the vane guide 510 (Operation 1820).

Here, the second reference time may be shorter than the above-described reference time. For example, the second reference time may be time that corresponds to half of the first reference time. Of course, the second reference time is not limited to half of the first reference time and may be longer or shorter than half of the first reference time.

Subsequently, the dishwasher 1 moves the vane assembly 400 forward for the second reference time so that the vane assembly 400 reaches the foremost position of the vane guide 510 (Operation 1830).

Subsequently, the dishwasher 1 determines whether time at which the vane assembly 400 makes a reciprocal motion in the forward direction, is equal to or greater than a predetermined reference reciprocal time (Operation 1840). Of course, embodiments of the present disclosure are not limited thereto. That is, the dishwasher 1 may determine whether the number of times in which the vane assembly 400 makes a reciprocal motion in the forward direction, is equal to or greater than a predetermined reference reciprocal number of times.

If the time at which the vane assembly 400 makes a reciprocal motion in the forward direction, is not equal to or greater than the predetermined reference reciprocal number of times (NO of Operation 1840), the dishwasher 1 performs a reciprocal motion of the vane assembly 400 continuously.

Of course, if the number of times in which the vane assembly 400 makes a reciprocal motion in the forward direction, is not equal to or greater than the reference reciprocal number of times, the dishwasher 1 may also perform a reciprocal motion of the vane assembly 400 continuously.

If the time at which the vane assembly 400 makes a reciprocal motion in the forward direction, is equal to or greater than the predetermined reference reciprocal number of times (YES of Operation 1840), the dishwasher 1 stops the forward reciprocal motion of the vane assembly 400 and moves the vane assembly 400 backward so that the vane assembly 400 reaches the first position (Operation 1850).

Of course, if the number of times in which the vane assembly 400 makes a reciprocal motion in the forward direction, is equal to or greater than the reference reciprocal number of times, the dishwasher 1 may stop the forward reciprocal motion of the vane assembly 400 and may move the vane assembly 400 backward so that the vane assembly 400 reaches the first position P1.

The following Operations 1860 through 1890 are the same as Operations 1630 through 1660 illustrated in FIG. 35 and thus a description thereof will be omitted.

While the vane assembly 400 makes a reciprocal motion in the front of the tub 30, the dishwasher 1 determines whether there is a problem in the operation of the linear washing portion 100, by moving the vane assembly 400 to the first position P1 every predetermined reference reciprocal number of times or every reference reciprocal time.

Figure 39:
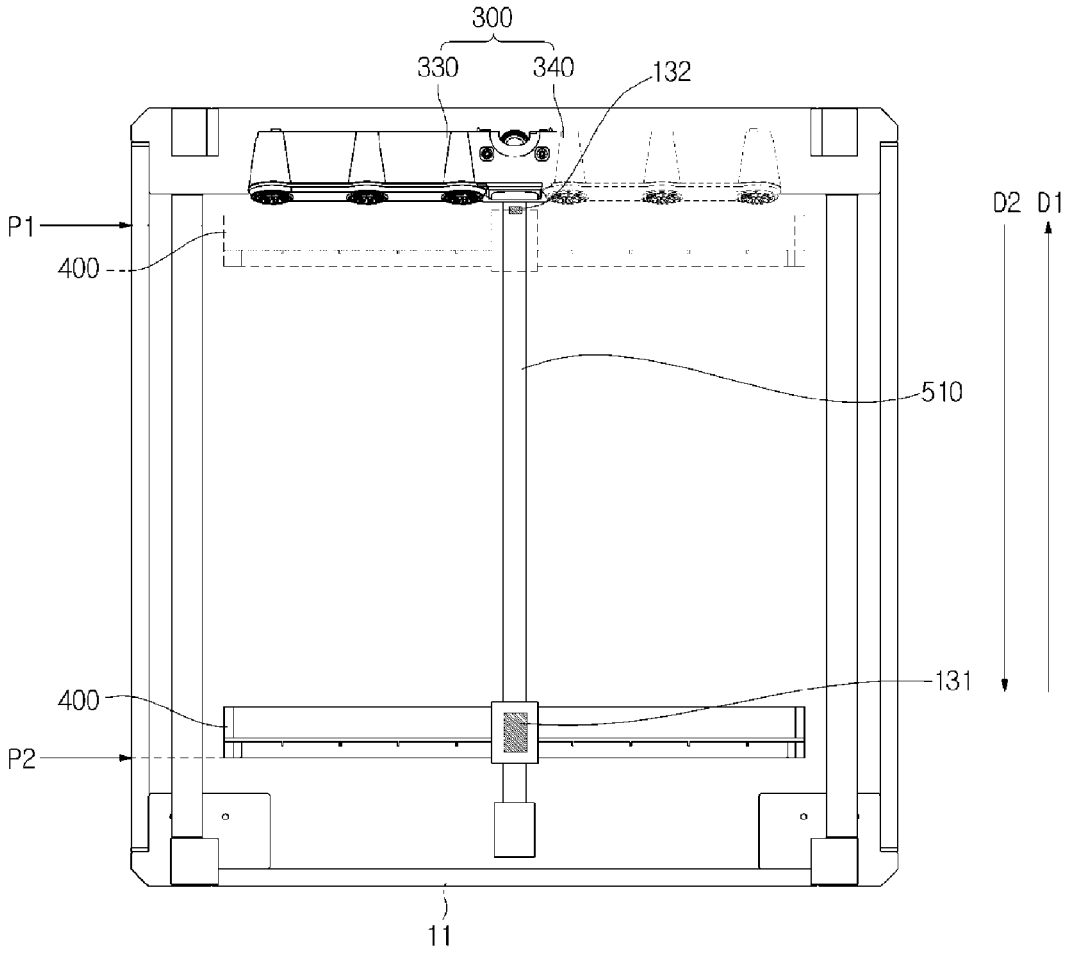
FIG. 39 illustrates a vane movement control method based on a left washing operation according to an embodiment of the present disclosure.
Figure 40:
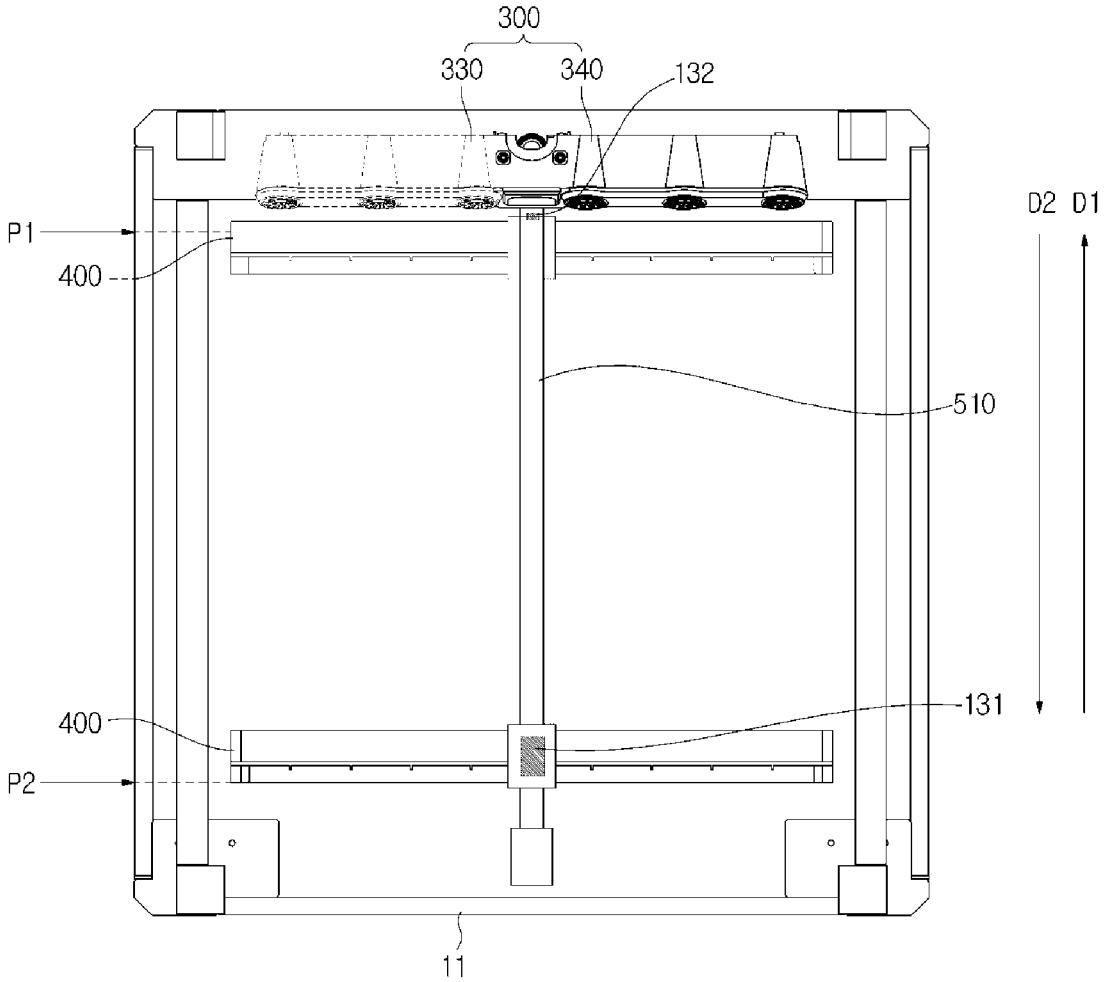
FIG. 40 illustrates a vane movement control method based on a right washing operation according to an embodiment of the present disclosure.

FIG. 39 illustrates a vane movement control method based on a left washing operation according to an embodiment of the present disclosure, and FIG. 40 illustrates a vane movement control method based on a right washing operation according to an embodiment of the present disclosure.

If the user inputs left washing instructions by pressing the left washing button 94*a* disposed on the control panel 90, the dishwasher 1 may wash the dishes accommodated in the left side of the basket 21 when the left spray nozzle 330 sprays the washing water.

In order to wash the dishes accommodated in the left side of the tub 30, the dishwasher 1 controls the distribution valve assembly 200 so that only the left spray nozzle 330 of the fixed nozzle assembly 300 sprays the washing water, as illustrated in FIG. 39.

Subsequently, the dishwasher 1 repeatedly performs an operation of moving the vane assembly 400 in a second direction for a first reference time and moving the vane assembly 400 in a first direction for the first reference time again.

Thus, the dishwasher 1 may wash the dishes accommodated in the left side of the tub 30. In other words, a washing range of the linear washing portion 100 is the left half side of the tub 30, as illustrated in FIG. 39.

Also, if the user inputs right washing instructions by pressing the right washing button 94*b* disposed on the control panel 90, the dishwasher 1 may wash the dishes accommodated in the right side of the basket 21 by causing the right spray nozzle 340 to spray the washing water.

In order to wash the dishes accommodated in the right side of the tub 30, the dishwasher 1 controls the distribution valve assembly 200 so that only the right spray nozzle 340 of the fixed nozzle assembly 300 may spray the washing water, as illustrated in FIG. 40.

Subsequently, the dishwasher 1 repeatedly performs an operation of moving the vane assembly 400 in the second direction for the first reference time and moving the vane assembly 400 in the first direction for the first reference time again.

Thus, the dishwasher 1 may wash the dishes accommodated in the right side of the tub 30. In other words, a washing range of the linear washing portion 100 is the right half side of the tub 30, as illustrated in FIG. 40.

As described above, the dishwasher 1 washes a predetermined washing area according to the user's selection. For example, the dishwasher 1 may wash the front, the rear, the left, and right sides separately.

Hereinafter, an operation in which the dishwasher 1 receives a washing area from the user and washes the received washing area, will be described.

Figure 41:
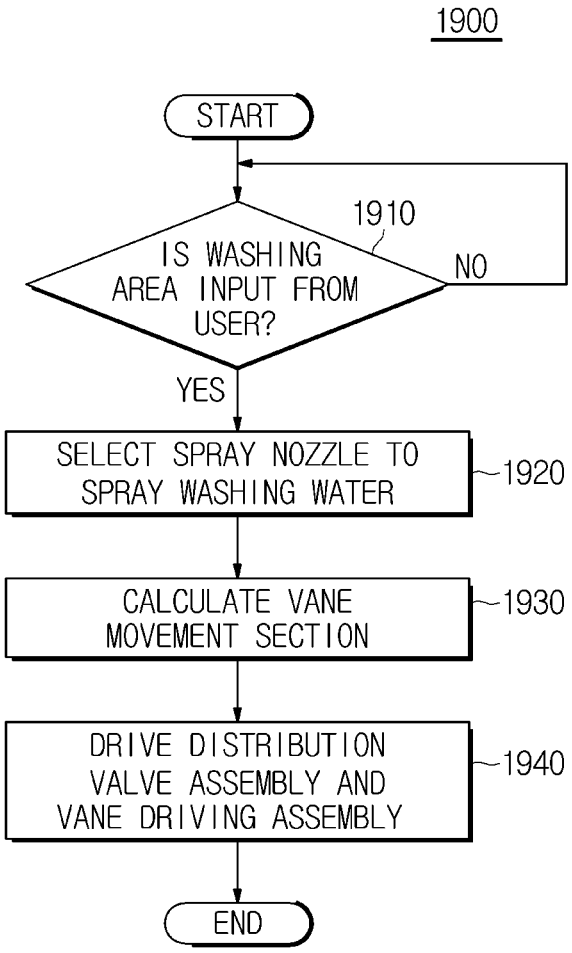
FIG. 41 is a flowchart for describing a division washing operation according to an embodiment of the present disclosure.
Figure 42A:
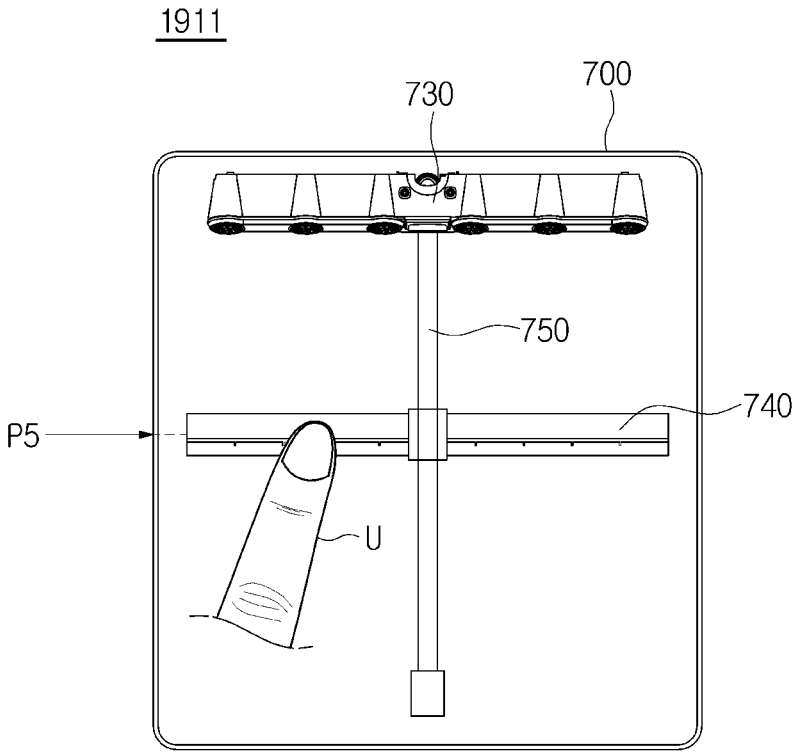
FIGS. 42A and 42B illustrate a washing area inputting method according to an embodiment of the present disclosure.
Figure 42B:
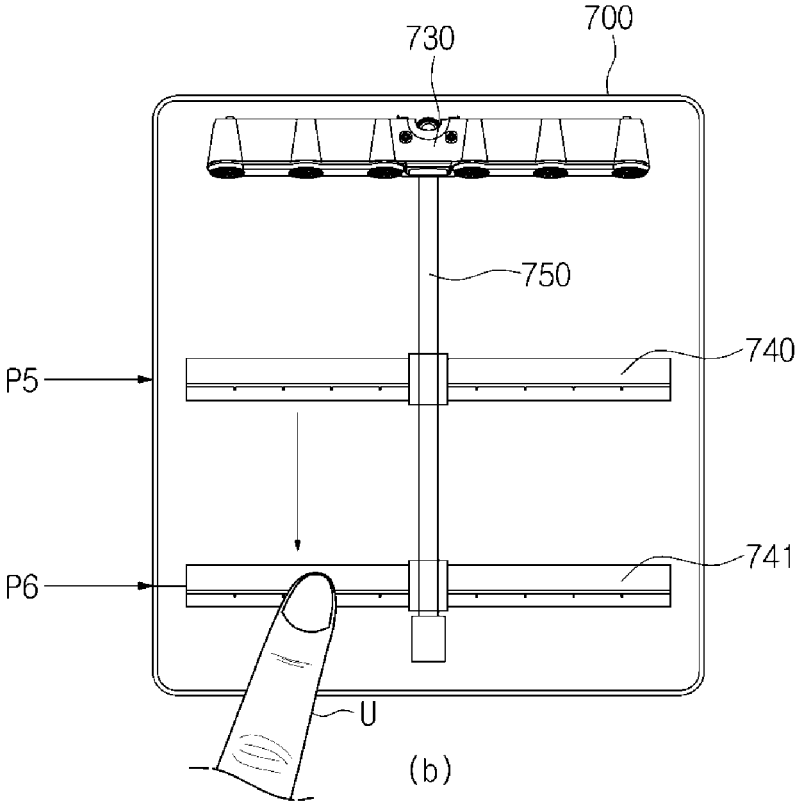
Figure 43A:
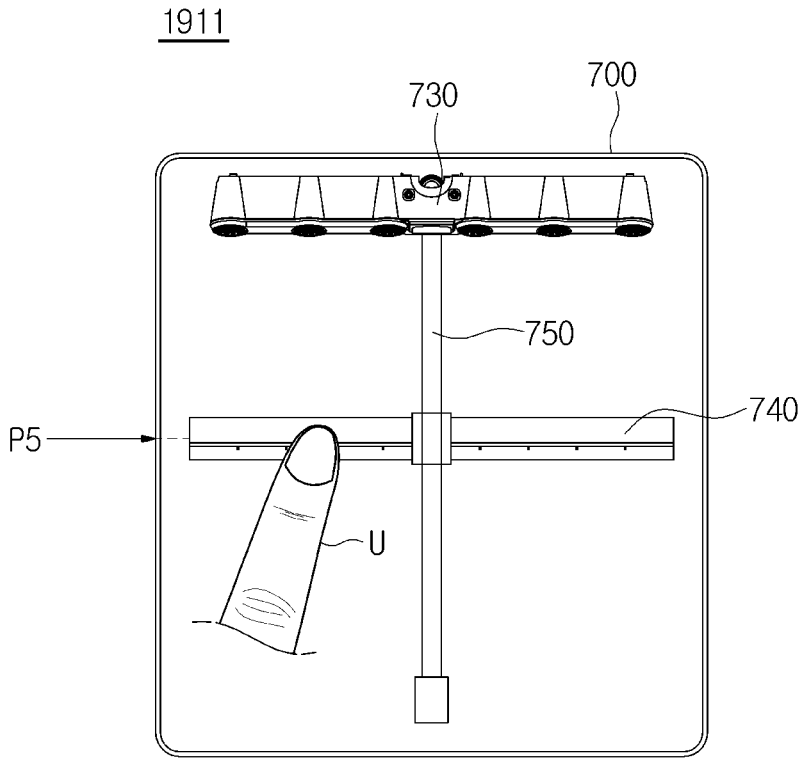
FIGS. 43A and 43B illustrate a washing area inputting method according to an embodiment of the present disclosure.
Figure 43B:
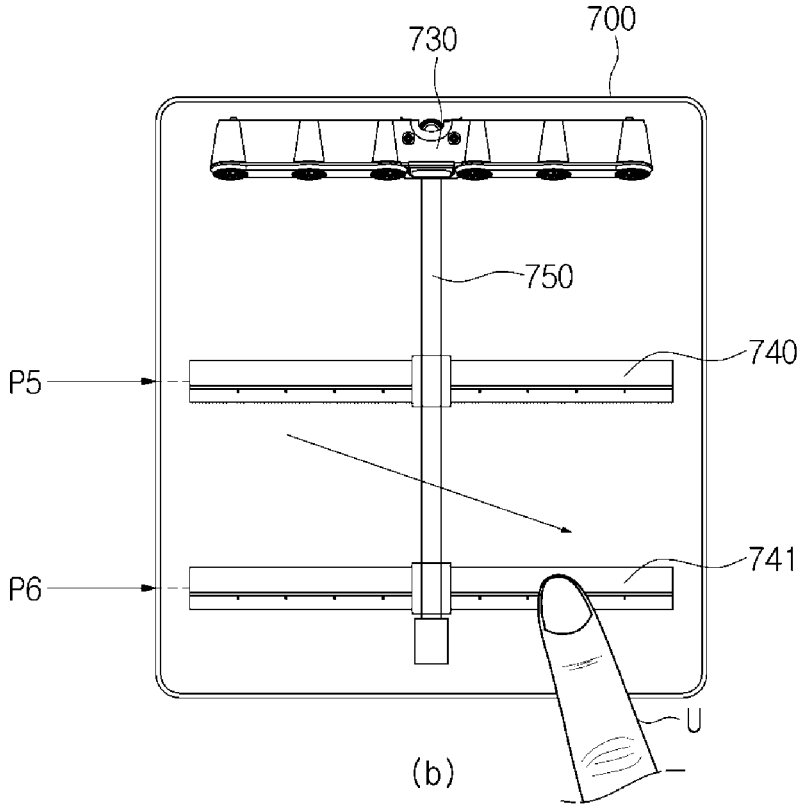

FIG. 41 is a flowchart for describing a division washing operation according to an embodiment of the present disclosure, and FIGS. 42A and 42B illustrate a washing area inputting method according to an embodiment of the present disclosure, and FIGS. 43A and 43B illustrate a washing area inputting method according to an embodiment of the present disclosure.

A division washing operation 1900 in which the dishwasher 1 receives a washing area from the user and washes the received washing area, will be described with reference to FIGS. 41 through 43.

First, the dishwasher 1 determines whether the dishwasher 1 receives the washing area from the user (Operation 1910).

The user may input the washing area to the dishwasher 1 using various methods.

A user U may input the washing area by touching or dragging the division washing screen 700 of the control panel 90.

For example, a nozzle assembly image 730, a vane assembly image 740, and a vane guide image 750 may be displayed on the division washing screen 700 of the dishwasher 1.

If the user U touches the division washing screen 700, the dishwasher 1 calculates coordinates that are touched by the user U and displays the vane assembly image 740 on the calculated coordinates, as illustrated in FIG. 42A and FIG. 43A.

Also, the dishwasher 1 determines whether the position touched by the user U is the left side or right side of the vane guide image 750.

Subsequently, the user U may move the touched portion while maintaining contact with the division washing screen 700, thereby inputting the washing area.

If the touched coordinates are moved in this way, the dishwasher 1 moves the vane assembly image 740 according to a position touched by the user U. That is, the dishwasher 1 calculates the coordinates touched by the user U every predetermined time and displays the vane assembly image 740 on the calculated coordinates, as illustrated in FIG. 42B and FIG. 43B.

Also, while the vane assembly image 740 is being moved, the dishwasher 1 displays a movement portion of the vane assembly image 740 to be distinguished from other portions in which the vane assembly image 740 is not moved.

As will be described later, the portion that is displayed to be distinguished from other portions, is the washing area.

In this case, if an initially-touched position is the left of the vane guide image 750 and a position at which touch is moved, is also the left of the vane guide image 750, the dishwasher 1 displays the movement portion of the vane assembly image 740 to be distinguished from only the left portion of the vane guide image 750 among the movement portion of the vane assembly image 740, as illustrated in FIG. 42B.

When the vane assembly image 740 is displayed so that only the left portion of the vane assembly image 740 among trajectories in which the vane assembly image 740 is moved, may be distinguished from other portions of the division washing screen 700 in this way, the washing area is the left portion of the vane guide image 750 among the movement portion of the vane assembly image 740.

If the initially-touched position is the left of the vane guide image 750 and the position at which touch is moved, is the right of the vane guide image 750, the dishwasher 1 displays all parts of the movement portion of the vane assembly image 740 to be distinguished from each other, as illustrated in FIG. 43B.

When the vane assembly image 740 is displayed so that all trajectories in which the vane assembly image 740 is moved, may be distinguished from other portions of the division washing screen 700 in this way, the washing area is all parts of the movement portion of the vane assembly image 740.

If the user U stops touch, the dishwasher 1 stops movement of the vane assembly image 740.

Also, the dishwasher 1 displays the washing area that is input by the user U. In this case, the washing area is a portion that is displayed to be distinguished from other portions while the vane guide image 750 is being moved.

Hereinafter, for understanding, a position of the vane guide 510 that corresponds to a position at which the user's touch starts, is referred to as a fifth position P5, and a position of the vane guide 510 that corresponds to a position at which the user's touch is terminated, is referred to as a sixth position P6.

As above, a method of inputting the washing area using the division washing screen 700 disposed on the control panel 90 has been described. However, the method of inputting the washing area is not limited thereto.

For example, the user may accommodate the dishes in the baskets 22*a* and 22*b* and then may mark portions of the baskets 22*a* and 22*b* in which the dishes are accommodated, or may set the washing area by attaching tags to the portions in which the dishes are accommodated.

The dishwasher 1 may calculate the washing area based on the marked portions and the portions to which the tags are attached, of the baskets 22*a* and 22*b*.

If the washing area is input (YES of Operation 1910), the dishwasher 1 selects a spray nozzle to spray the washing water according to the input washing area (Operation 1920).

For example, when the washing area is displayed only on the left of the vane guide image 750 on the division washing screen 700, the dishwasher 1 controls the distribution valve assembly 200 so that the washing water may be supplied to the left spray nozzle 330 and the washing water may not be supplied to the right spray nozzle 340.

Also, when the washing area is displayed only on the right of the vane guide image 750 on the division washing screen 700, the dishwasher 1 controls the distribution valve assembly 200 so that no washing water can be supplied to the left spray nozzle 330 and the washing water can be supplied to the right spray nozzle 340.

Also, when the washing area is displayed on both sides of the vane guide image 750, the dishwasher 1 controls the distribution valve assembly 200 so that the washing water can be supplied to both the left spray nozzle 330 and the right spray nozzle 340.

Subsequently, the dishwasher 1 calculates a movement section of the vane assembly 400 according to the input washing area (Operation 1930).

For example, the dishwasher 1 calculates a position of the fifth position P5 of the vane guide 510 and a position of the sixth position P6 of the vane guide 510 based on the washing area input through the division washing screen 700.

In detail, the dishwasher 1 may calculate coordinates of the fifth position P5 based on a position at which the user starts touch on the division washing screen 700, using a ratio of the length of the vane guide 510 with respect to the length of the vane guide image 750 and may calculate coordinates of the sixth position P6 based on a position at which the user terminates touch on the division washing screen 700.

Also, the dishwasher 1 may calculate a distance between the first position P1 and the fifth position P5 and a distance between the first position P1 and the sixth position P6. The dishwasher 1 may calculate the distance between the first position P1 and the fifth position P5 and the distance between the first position P1 and the sixth position P6 based on the coordinates of the fifth position P5 and the coordinates of the sixth position P6.

The dishwasher 1 may calculate time required so that the vane assembly 400 can be moved from the first position P1 to the fifth position P5, based on movement speed of the vane assembly 400 caused by rotation speed of the vane driving motor 520 and the distance between the first position P1 and the fifth position P5. Also, the dishwasher 1 may calculate a movement time required so that the vane assembly 400 can be moved from the first position P1 to the fifth position P5 in the same manner.

Also, the dishwasher 1 calculates a distance between the fifth position P5 and the sixth position P6 or a movement time at which the vane assembly 400 is moved between the fifth position P5 and the sixth position P6.

Subsequently, the dishwasher 1 drives the distribution valve assembly 200 and the vane driving assembly 500 so that washing can be performed on the washing area (Operation 1940).

In detail, the dishwasher 1 drives the distribution valve assembly 200 so that the left spray nozzle 330 or the right spray nozzle 340 can spray the washing water according to the washing area. Also, the dishwasher 1 drives the vane driving assembly 500 so that the vane assembly 400 can be moved according to the washing area.

Because control of the distribution valve assembly 200 has been described as above, hereinafter, a movement control method of the vane assembly 400 according to the washing area will be described.

Figure 44:
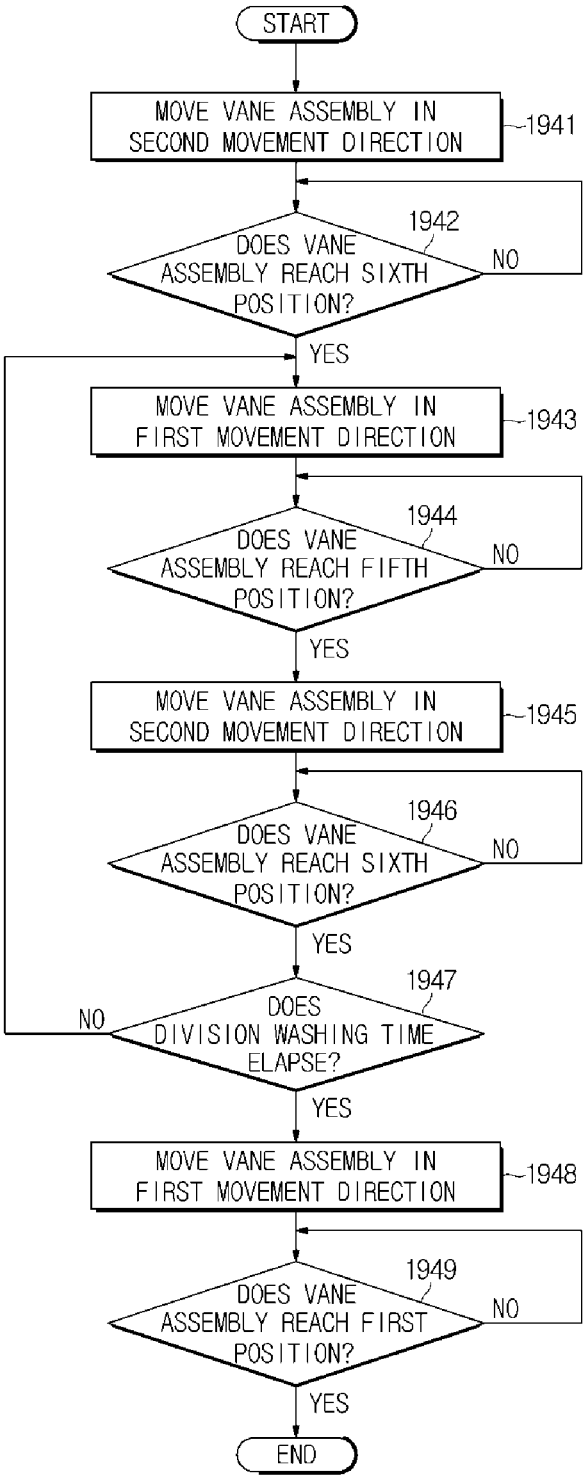
FIGS. 44 and 45 are a flowchart and a cross-sectional view for describing a vane movement control method according to division washing according to an embodiment of the present disclosure.
Figure 45:
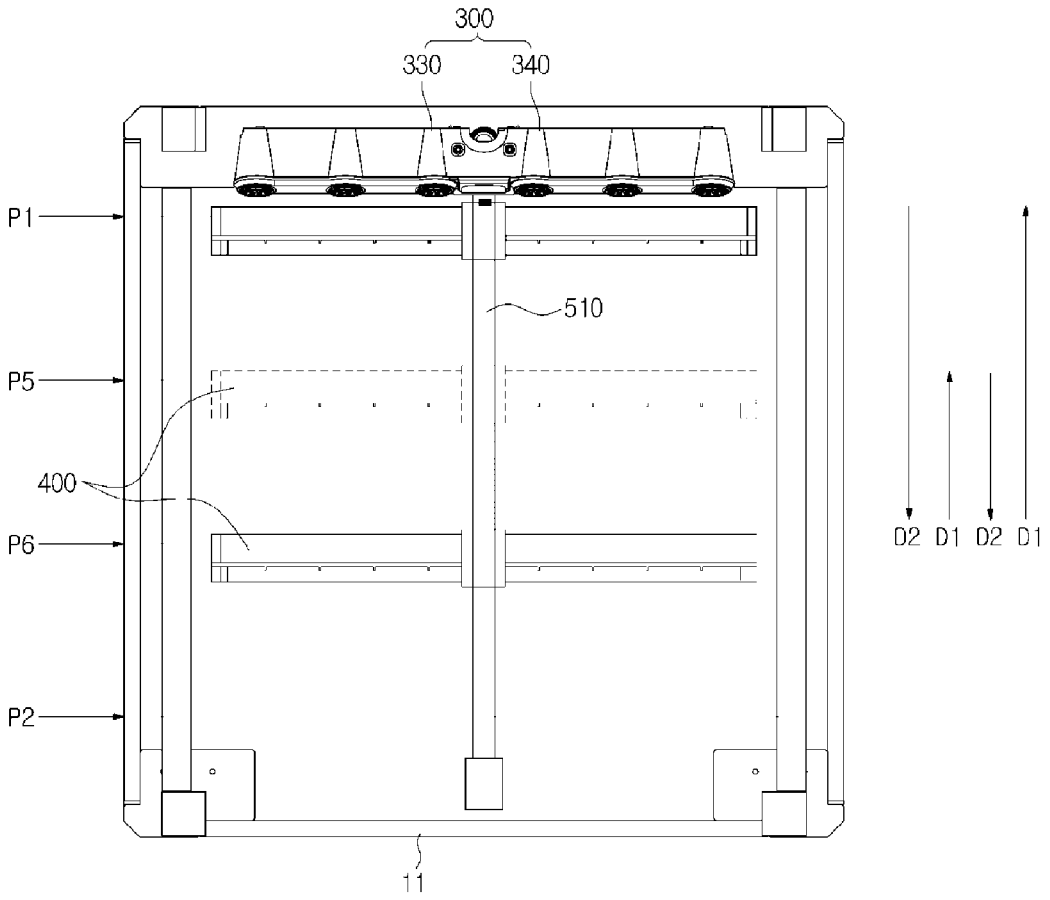

FIGS. 44 and 45 are a flowchart and a cross-sectional view for describing a vane movement control method according to division washing according to an embodiment of the present disclosure.

Referring to FIGS. 44 and 45, the dishwasher 1 moves the vane assembly 400 in the second movement direction D2 (Operation 1941). In detail, the dishwasher 1 may drive the vane driving motor 520 in the second rotation direction.

Subsequently, the dishwasher 1 determines whether the vane assembly 400 reaches the sixth position P6 (Operation 1942).

The dishwasher 1 may determine whether the vane assembly 400 reaches the sixth position P6, using various methods.

For example, the dishwasher 1 may determine whether the vane assembly 400 reaches the sixth position P6, depending on whether time at which the vane driving motor 520 is driven in the second rotation direction, is equal to or greater than time required so that the vane assembly 400 can be moved from the first position P1 to the sixth position P6.

As an example, the dishwasher 1 may determine whether the vane assembly 400 reaches the sixth position P6, depending on whether a product that is obtained by multiplying rotation displacement in which the vane driving motor 520 is rotated in the second rotation direction, by a radius of the driving pulley 530 is equal to or greater than a distance between the first position P1 and the sixth position P6.

If the vane assembly 400 reaches the sixth position P6 (YES of Operation 1942), the dishwasher 1 moves the vane assembly 400 in the first movement direction D1 (Operation 1943). In detail, the dishwasher 1 may drive the vane driving motor 520 in the first rotation direction.

Subsequently, the dishwasher 1 determines whether the vane assembly 400 reaches the fifth position P5 (Operation 1944).

The dishwasher 1 may determine whether the vane assembly 400 reaches the fifth position P5, using various methods.

For example, the dishwasher 1 may determine whether the vane assembly 400 reaches the fifth position P5, depending on whether time at which the vane driving motor 520 is rotated in the first rotation direction, is equal to or greater than time required so that the vane assembly 400 can be moved from the fifth position P5 to the sixth position P6.

As an example, when the vane driving motor 520 includes an encoder, the dishwasher 1 may determine whether the vane assembly 400 reaches the fifth position P5, depending on whether a product that is obtained by multiplying rotation displacement in which the vane driving motor 520 is rotated in the first rotation direction, by a radius of the driving pulley 530 is equal to or greater than a distance between the fifth position P5 and the sixth position P6.

If the vane assembly 400 reaches the fifth position P5 (YES of Operation 1944), the dishwasher 1 moves the vane assembly 400 in the second movement direction D2 (Operation 1945). In detail, the dishwasher 1 may drive the vane driving motor 520 in the second rotation direction.

Subsequently, the dishwasher 1 determines whether the vane assembly 400 reaches the sixth position P6 (Operation 1946).

The dishwasher 1 may determine whether the vane assembly 400 reaches the sixth position P6, using various methods.

For example, the dishwasher 1 may determine whether time at which the vane driving motor 520 is rotated in the second rotation direction, is equal to or greater than the time required so that the vane assembly 400 can be moved from the fifth position P5 to the sixth position P6.

As an example, when the vane driving motor 520 includes an encoder, the dishwasher may determine whether the vane assembly 400 reaches the sixth position P6, depending on whether a product that is obtained by multiplying rotation displacement in which the vane driving motor 520 is rotated in the first rotation direction, by a radius of the driving pulley 530 is equal to or greater than the distance between the fifth position P5 and the sixth position P6.

If the vane assembly 400 reaches the sixth position P6 (YES of Operation 1946), the dishwasher 1 determines whether a division washing time elapses (Operation 1947). Here, the division washing time may be time that is set by the user or that is previously stored so that the dishes accommodated in the front of the tub 30 can be washed.

If the division washing time does not elapse (NO of Operation 1947), the dishwasher 1 causes the vane assembly 400 to make a reciprocal motion between the fifth position P5 and the sixth position P6.

If the division washing time elapses (YES of Operation 1947), the dishwasher 1 moves the vane assembly 400 in the first movement direction D1 (Operation 1948). In detail, the dishwasher 1 may drive the vane driving motor 520 in the first rotation direction.

Subsequently, the dishwasher 1 determines whether the vane assembly 400 reaches the first position P1 (Operation 1949).

The dishwasher 1 may determine whether the vane assembly 400 reaches the first position P1, using various methods.

For example, the dishwasher 1 may determine whether the vane assembly 400 reaches the first position P1, depending on whether time at which the vane driving motor 520 is driven in the first rotation direction, is equal to or greater than time required so that the vane assembly 400 can be moved from the sixth position P6 to the first position P1.

As an example, the dishwasher 1 may determine whether the vane assembly 400 reaches the first position P1, depending on whether a product that is obtained by multiplying rotation displacement in which the vane driving motor 520 is rotated in the first rotation direction, by a radius of the driving pulley 530 is equal to or greater than the distance between the first position P1 and the sixth position P2.

As an example, when the dishwasher 1 includes a position detector 130, the dishwasher 1 may determine whether the vane assembly 400 reaches the first position P1, depending on whether the position detection sensor 132 disposed at the first position P1 detects the position identification member 131 attached to the vane assembly 400.

In this way, the dishwasher 1 may receive the washing area from the user to perform division washing, may control the distribution valve assembly 200 so that the left spray nozzle 330 or the right spray nozzle 340 can spray the washing water according to the washing area input from the user and may control the vane driving assembly 500 so that the vane assembly 400 can make a reciprocal motion.

According to an aspect of the present disclosure, a linear washing portion can spray washing water toward edges of a washing chamber while making a reciprocal motion in the washing chamber.

According to an aspect of the present disclosure, when the linear washing portion washes a small quantity of dishes by spraying washing water while making a reciprocal motion in part of an inside of a washing chamber, a washing time can be reduced, and concentrative washing can also be partially performed.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A dishwasher comprising:

a tub configured to accommodate dishes;

a nozzle assembly configured to spray washing water in a first direction;

a vane assembly configured to move in the first direction between a first position and a second position of an inside of the tub and including a reflection surface facing the nozzle assembly;

a driving motor configured to move the vane assembly between the first position and the second position of an inside of the tub;

a vane guide extending from a central portion of the vane assembly in the first direction to guide the movement of the vane assembly in the first direction between the first position and the second position; and a controller configured to control the driving motor to move the vane assembly between the second position and the first position, wherein the nozzle assembly is configured to spray the washing water toward the reflection surface of the vane assembly, and the reflection surface of the vane assembly is configured to deflect the washing water, sprayed by the nozzle assembly, toward the dishes, and the controller is configured to control the driving motor to position the vane assembly at the first position when the nozzle assembly starts the spraying of washing water toward the reflection surface of the vane assembly, where the first position is disposed adjacent to the nozzle assembly.

2. The dishwasher of claim 1, wherein the nozzle assembly is installed at one end of the vane guide.

3. The dishwasher of claim 2, wherein, if the vane assembly is not disposed at the first position in an initialization operation, the controller moves the vane assembly to the first position.

4. The dishwasher of claim 2, wherein the second position is disposed at another end of the vane guide, and the controller detects a movement time at which the vane assembly is moved to the second position from the first position.

5. The dishwasher of claim 4, wherein, if the movement time is equal to or greater than a predetermined reference time, the controller stops the movement of the vane assembly.

6. The dishwasher of claim 1, further comprising a position detector that detects whether the vane assembly is disposed at the first position.

7. The dishwasher of claim 6, wherein the position detector comprises:

a position identification member that is installed at the vane assembly; and a position detection sensor that is installed at the first position and detects the position identification member.

8. The dishwasher of claim 7, wherein, if the position detection sensor detects the position identification member, the controller moves the vane assembly to the second position.

9. The dishwasher of claim 7, wherein the position identification member comprises a permanent magnet that generates a magnetic field, and the position detection sensor comprises a hall sensor that senses the magnetic field.

10. The dishwasher of claim 1, further comprising an input unit through which division washing instructions are input from a user.

11. The dishwasher of claim 10, wherein the controller moves the vane assembly between a third position and the first position according to the division washing instructions, the third position is disposed between the first position and the second position.

12. The dishwasher of claim 11, wherein the controller moves the vane assembly between a fourth position and the second position according to the division washing instructions, the fourth position is disposed between the first position and the second position.

13. The dishwasher of claim 1, further comprising an input unit through which a division washing area is input from a user, wherein the controller moves the vane assembly between a fifth position and a sixth position that correspond to the inert-division washing area input from the user.

14. A dishwasher comprising:

a tub that accommodates dishes;

a spray nozzle configured to spray water in a first direction;

a movable vane including a surface facing the spray nozzle to redirect the water sprayed from the spray nozzle;

a vane guide provided entirely within the tub and extending from a central portion of the movable vane in the first direction to guide a movement of the movable vane in the first direction;

a motor configured to move the movable vane; and a controller configured to control a linear motion of the movable vane in the dishwasher, wherein the spray nozzle is configured to spray the water toward the surface of the movable vane, and the surface of the movable vane is configured to deflect the water, sprayed from the spray nozzle, toward the dishes, and the controller is configured to control the motor to position the movable vane at a first position when the spray nozzle starts the spraying of the water toward the movable vane, where the first position is disposed adjacent to the spray nozzle.

15. The dishwasher of claim 14, wherein the surface of the movable vane comprises different inclination angles configured to redirect water sprayed from the spray nozzle in various directions.

16. The dishwasher of claim 14, further comprising:

a second spray nozzle; and a distribution valve assembly configured to selectively distribute water to at least one of the spray nozzle and the second spray nozzle.

17. The dishwasher of claim 14, wherein the controller controls the linear motion of the movable vane to reciprocate within a portion of a total available linear motion of the movable vane.

18. The dishwasher of claim 14, wherein the movable vane is provided without a spray source in the movable vane.

19. The dishwasher of claim 14, wherein the surface facing the spray nozzle is concave.

20. The dishwasher of claim 14, wherein the movable vane is provided at substantially a same height in the dishwasher as the spray nozzle.

* * * * *